US008534490B2

(12) United States Patent
Chapin

(10) Patent No.: US 8,534,490 B2
(45) **Date of Patent: *Sep. 17, 2013**

(54) BEVERAGE CAN MARKETING DEVICE

(76) Inventor: Barry W. Chapin, Westborough, MA (US)

( * ) Notice: Subject to any disclaimer, the term of this patent is extended or adjusted under 35 U.S.C. 154(b) by 217 days.

This patent is subject to a terminal disclaimer.

(21) Appl. No.: 12/910,792

(22) Filed: Oct. 23, 2010

(65) Prior Publication Data

US 2011/0100854 A1 May 5, 2011

Related U.S. Application Data

(60) Provisional application No. 61/406,120, filed on Oct. 23, 2010, provisional application No. 61/351,258, filed on Jun. 3, 2010, provisional application No. 61/254,274, filed on Oct. 23, 2009.

(51) Int. Cl.
*B65D 1/40* (2006.01)
*B65D 3/28* (2006.01)

(52) U.S. Cl.
USPC ..... 220/729; 220/733

(58) Field of Classification Search
USPC ..... 220/619, 620, 716, 718, 729, 733, 220/906
See application file for complete search history.

(56) References Cited

U.S. PATENT DOCUMENTS

| | | | |
|---|---|---|---|
| D126,200 | S | 4/1941 | Eisenberg |
| 2,693,685 | A | 11/1954 | Stafford |
| 2,812,886 | A | 11/1957 | Weinstein |
| 3,693,829 | A | 9/1972 | Price |
| 3,894,650 | A | 7/1975 | Crump |
| 4,084,525 | A | 4/1978 | Booth |
| 4,087,018 | A | 5/1978 | Tebutt |

(Continued)

FOREIGN PATENT DOCUMENTS

| | | | |
|---|---|---|---|
| CN | 101397063 | A | 4/2009 |
| GB | 2188828 | A1 | 10/1987 |

(Continued)

OTHER PUBLICATIONS

Crown Brand-Building Packaging, Beverage Packaging Products & Services, Beverage Cans, Feb. 2007, http://web.archive.org/web/20070211023140; printed from Crown Cork & Seal website.

(Continued)

*Primary Examiner* — Harry Grosso

(74) *Attorney, Agent, or Firm* — Chapin IP Law, LLC

(57) ABSTRACT

A "clean can" beverage can includes a beverage can body and a beverage can top coupled to the body. The can top is shaped to define a groove between a lower inside edge of the rim of the can top and an upper surface of the can top. A non-toxic groove cover is disposed to cover the groove along at least a portion of the groove that is located adjacent to the openable section of the can top. The groove cover prevents collection of debris in the groove. The groove allows the can top to be wiped clean without debris getting stuck in the groove by sloping upwards towards the top of the tim. The groove can also cover the rim and an upper portion of the can body. The groove cover remains in place before, during and after opening of the can and while pouring to provide a more sanitary drinking experience.

28 Claims, 57 Drawing Sheets

(56) References Cited

U.S. PATENT DOCUMENTS

| | | | | |
|---|---|---|---|---|
| 4,579,257 | A | 4/1986 | Brandlein | |
| 4,609,123 | A | 9/1986 | Poncy | |
| 4,679,702 | A | 7/1987 | MacCarone et al. | |
| 4,741,450 | A | 5/1988 | Braude | |
| 4,749,100 | A | 6/1988 | Eberhart | |
| 4,752,016 | A | 6/1988 | Eads | |
| 4,815,628 | A | 3/1989 | Wehnert, III | |
| D300,607 | S | 4/1989 | Ball | |
| 4,834,258 | A | 5/1989 | Root | |
| 4,869,389 | A | 9/1989 | Cerrone, Jr. | |
| 4,880,136 | A | 11/1989 | Englert | |
| 4,917,258 | A | 4/1990 | Boyd et al. | |
| 4,941,573 | A | 7/1990 | Fuerstman | |
| 4,969,570 | A | 11/1990 | Harvey, Sr. | |
| 5,014,869 | A | 5/1991 | Hammond | |
| 5,103,973 | A | 4/1992 | Sato | |
| 5,105,964 | A | 4/1992 | Heath | |
| 5,108,003 | A | 4/1992 | Granofsky | |
| 5,119,955 | A | 6/1992 | Granofsky | |
| 5,125,525 | A * | 6/1992 | Tucker | 220/254.3 |
| 5,131,554 | A | 7/1992 | Kuo | |
| D329,602 | S | 9/1992 | Cochrane | |
| D329,603 | S | 9/1992 | Barrett | |
| 5,244,111 | A | 9/1993 | Merom | |
| 5,273,176 | A | 12/1993 | Diaz | |
| 5,285,924 | A | 2/1994 | Morris | |
| 5,292,022 | A | 3/1994 | Blanco | |
| 5,492,077 | A | 2/1996 | Rose | |
| 5,645,190 | A | 7/1997 | Goldberg | |
| 5,647,497 | A | 7/1997 | Labbe | |
| 5,692,633 | A | 12/1997 | Gordon | |
| 5,813,561 | A | 9/1998 | Chang | |
| D410,844 | S | 6/1999 | Hurst | |
| 5,934,497 | A | 8/1999 | Chang et al. | |
| 5,967,363 | A | 10/1999 | Allen | |
| 5,971,195 | A | 10/1999 | Reidinger et al. | |
| 5,996,832 | A | 12/1999 | Nieuwoudt | |
| 6,053,349 | A | 4/2000 | Hayes | |
| 6,065,634 | A | 5/2000 | Brifcani et al. | |
| 6,073,797 | A | 6/2000 | Barous | |
| 6,089,072 | A | 7/2000 | Fields | |
| 6,202,881 | B1 | 3/2001 | Chiag | |
| 6,241,114 | B1 | 6/2001 | Savino et al. | |
| 6,290,084 | B1 | 9/2001 | Louie | |
| 6,296,137 | B1 | 10/2001 | Bjornsen | |
| 6,321,927 | B2 | 11/2001 | Cavella | |
| 6,338,418 | B1 | 1/2002 | Derose | |
| 6,390,749 | B2 | 5/2002 | Song | |
| 6,425,493 | B1 | 7/2002 | Gardiner | |
| 6,450,358 | B1 | 9/2002 | Berro | |
| 6,460,723 | B2 | 10/2002 | Nguyen et al. | |
| D471,453 | S | 3/2003 | Stodd | |
| 6,575,324 | B1 | 6/2003 | Hamer | |
| 6,626,314 | B1 | 9/2003 | McHenry et al. | |
| 6,637,616 | B2 | 10/2003 | Couto | |
| 6,719,166 | B2 | 4/2004 | Ceolin et al. | |
| 6,729,495 | B2 | 5/2004 | Gardiner | |
| 6,817,819 | B2 | 11/2004 | Olson et al. | |
| D500,343 | S | 12/2004 | McRobbie | |
| 6,877,607 | B2 | 4/2005 | Jenkins | |
| D507,485 | S | 7/2005 | Fields | |
| 6,915,553 | B2 | 7/2005 | Turner et al. | |
| 6,992,586 | B2 | 1/2006 | Rosenfeld | |
| 7,017,769 | B1 | 3/2006 | Talman | |
| D522,860 | S | 6/2006 | LaFortune | |
| 7,100,789 | B2 | 9/2006 | Nguyen et al. | |
| 7,108,469 | B2 | 9/2006 | Jenkins | |
| 7,195,130 | B2 | 3/2007 | Pendergrass et al. | |
| D559,680 | S | 1/2008 | Jacober et al. | |
| 7,370,774 | B2 | 5/2008 | Watson et al. | |
| D603,218 | S | 11/2009 | Hollinger | |
| 7,644,833 | B2 | 1/2010 | Turner et al. | |
| 7,757,887 | B2 | 7/2010 | Gardiner | |
| D625,190 | S | 10/2010 | Pontes | |
| 2002/0050493 | A1 | 5/2002 | Ball et al. | |
| 2002/0062922 | A1 | 5/2002 | St. John | |
| 2002/0158071 | A1 | 10/2002 | Chasteen et al. | |
| 2003/0102313 | A1 | 6/2003 | Weber | |
| 2004/0020934 | A1 | 2/2004 | Olsen | |
| 2004/0064983 | A1 | 4/2004 | Joseph | |
| 2004/0108237 | A1 | 6/2004 | McClintock | |
| 2004/0206764 | A1 | 10/2004 | Gardiner | |
| 2004/0256386 | A1 | 12/2004 | Lafortune | |
| 2005/0008299 | A1 | 1/2005 | Ohe et al. | |
| 2005/0035011 | A1 | 2/2005 | McRobbie | |
| 2005/0035018 | A1 | 2/2005 | McRobbie | |
| 2005/0218013 | A1 | 10/2005 | Tabeshnekoo | |
| 2006/0070994 | A1 | 4/2006 | Tiikkainen | |
| 2006/0151501 | A1 | 7/2006 | Chang et al. | |
| 2006/0289548 | A1 * | 12/2006 | Schatz | 220/784 |
| 2007/0075089 | A1 | 4/2007 | Stein | |
| 2007/0187410 | A1 | 8/2007 | Legorreta et al. | |
| 2008/0006630 | A1 | 1/2008 | Messina | |
| 2008/0050207 | A1 | 2/2008 | Turner et al. | |
| 2008/0217347 | A1 | 9/2008 | Markaj | |
| 2008/0230544 | A1 | 9/2008 | Kim | |
| 2008/0257900 | A1 | 10/2008 | Turner et al. | |
| 2010/0243663 | A1 | 9/2010 | Jentzsch et al. | |
| 2010/0332420 | A1 | 12/2010 | Groening | |
| 2011/0138742 | A1 | 6/2011 | Mclean | |

FOREIGN PATENT DOCUMENTS

| | | | |
|---|---|---|---|
| JP | 6171650 | A2 | 6/1994 |
| WO | 9302939 | A1 | 2/1993 |
| WO | 9528328 | A1 | 10/1995 |
| WO | 0219878 | A1 | 3/2002 |
| WO | 03089328 | A1 | 10/2003 |
| WO | 2004108544 | A1 | 12/2004 |
| WO | 2009031111 | A1 | 3/2009 |
| WO | 2010040193 | | 4/2010 |

OTHER PUBLICATIONS

Beverage Industry, Packaging, www.bevindustry.com; Apr. 2003.

SaferTech, ProTop, May 2001, http:://web.archive.org/web/20010518091827; printed from SaferTech website.

Packaging Digest, New Products Materials, Nov. 2006, www.packagingdigest.com; printed from Packaging Digest website.

Indian Patents News, Philippine Inventor Develops Flip-Top Beverage Can Sanitary Cover, Aug. 2009, http://proquest.umi.com.libproxy.mit.edu/pqdweb?did=1959291881&sid=8&Fmt=3&clientId-5482&RQT=309&VName=PQD; printed from ProQuest website.

International Search Report and Written Opinion mailed Oct. 31, 2011 in corresponding International Application No. PCT/US2010/053881.

* cited by examiner

BEVERAGE CAN MARKETING DEVICE

CLAIM TO BENEFIT OF FILING DATE OF THREE (3) EARLIER FILED PROVISIONAL APPLICATIONS

This application is related to the following THREE (3) earlier filed U.S. Provisional Applications for patent, and shares common inventorship therewith:

1) Provisional Application U.S. Ser. No. 61/254,274 filed in the U.S. Patent Office on Oct. 23, 2009 entitled "APPARATUS AND METHODS PROVIDING A CLEAN BEVERAGE CAN", naming the same inventor as the present application.

2) Provisional Application U.S. Ser. No. 61/351,258 filed Jun. 3, 2010 entitled "CLEAN METALLIC BEVERAGE CAN", naming the same inventor as the present application.

3) Provisional Application U.S. Ser. No. 61/406,120 filed before the present invention, but on the same day, Oct. 23, 2010 entitled "BEVERAGE CAN TOP GROOVE COVER AND MARKETING DEVICE", and naming the same inventor as the present application.

The entire disclosure, figures, photos, teachings and contents of the above-identified Provisional Patent Applications are hereby incorporated by reference in their entirety.

RELATION TO DESIGN PATENT

The present invention discloses embodiments that are related to the ornamental designs shown in co-pending U.S. Design patent application Ser. No. 29/365,508 entitled "COUNTERSINK GROOVE COVER FOR A BEVERAGE CAN" filed Jul. 9, 2010, the entire contents and drawings of which are hereby incorporated by reference in their entirety.

TECHNICAL FIELD OF THE INVENTION

The present invention relates to beverage cans and beverage can tops or lids (can ends) and more particularly for methods and apparatus that provide for more sanitary and easier to clean beverage cans and beverage can tops and mechanisms to providing a marketing platform on a beverage can end.

BACKGROUND

Conventional beverage cans such as aluminum, tin or steel cans are commonly used to package and contain a variety of carbonated, noncarbonated, and alcoholic and nonalcoholic liquid beverages. Examples of beverages or other consumables that are packaged in beverage cans include carbonated and noncarbonated soda, pop, fruit juice, water, mixers, alcoholic beverages such as beer and wine, and other consumable and even sometimes non-consumable liquids.

FIG. 1 provides an illustration of a typical conventional metallic beverage can 100. A typical beverage can container holds twelve fluid ounces of a liquid such as beer, juice or soda. Conventional can dimensions include heights, diameters and subtle features of the can such as tapering near the top vary and depend often on vendor choice, branding and marketing requirements. Details of the construction of a typical conventional modern beverage can are disclosed in an article/paper entitled "The Aluminum Beverage Can", written by William F. Hosford and John L. Duncan that was published in the September 1994 issue of Scientific American Magazine, copyright 1994 by Scientific American, Inc. The entire contents of this paper is hereby incorporated by reference in its entirety. This paper shows various example details of conventional beverage can construction.

In FIG. 1, the typical beverage can 100 includes a can body 105 and a lid or can top 120 (as used herein, the term "can top" refers to a can lid used to cover a beverage can). The body 105 is formed from a piece of continuous metal such as aluminum alloy or steel or other metal that is drawn, ironed, extruded, stretched, pressed, molded, stamped or otherwise shaped into a cylindrical shape to form the body 105. The above referenced paper provides details on one example process of forming the can body or housing a cold forming and ironing process. Once formed, the can housing or body 105 includes a lower end 108 and an upper end 109. The lower end 108 typically tapers slightly inwards to form a base or bottom portion 106 of the can that typically tapers inwards at its lowermost end and is smaller in diameter at it base (the portion contacting a surface when the can is upright in position) than a middle area of the body 105. In many conventional can body designs, the upper end 109 or neck of the body 105 tapers slightly inward at a top of the body 105 and terminates at an upper body edge 110. The cylindrical-shaped outer surface of the body 105 typically includes decoration that provides a label on the metallic surface of the body that identifies a brand of liquid as well as the contents, ingredients, manufacturer of liquid contained within the can 100 and other information.

The can 100 shown in FIG. 1 is fully assembled, filled with liquid contents and "sealed". Sealing the can is a process performed during a bottling or canning process when a manufacturer affixes a can top 120 to the upper body edge 110 after placing liquid contents into the can body 105. In a conventional canning/bottling/seaming process, a canning machine (not shown in this figure) dispenses liquid into the body 105 and thereafter the same or a different machine affixes the can top 120 to the upper body edge 110 by crimping, seaming or pinching a peripheral edge 121 of the can top 120 around the upper body edge 110, thus forming an airtight and liquid-tight seal between the can top 120 and the body 105. This seam is sometimes referred to as a double seam and forms the rim at the top of the can. Manufacturers may make and sell can tops 120 and bodies 105 as separate individual items that are then combined as generally explained above during the canning process by a canning/bottling company or beverage/liquid manufacturer to form the can 100 as shown in FIG. 1.

Prior to canning or bottling, a conventional can top 120 (for example as shown in in FIG. 1 sealed onto the can 100) is formed using a can top press, chuck and/or mold(s) that stamp, roll, press or otherwise form a piece of metal such as aluminum alloy or steel into the desired shape of the can top 120. Once formed, a conventional can top 120 includes a central panel area or upper surface 129 that provides a top or exterior side and that has an underside facing into the can (not shown in FIG. 1) opposite the upper surface 129 of the can top 120 (i.e. the underside of the can top is exposed to the liquid contents contained within the can 100). The upper surface 129 of the can top 120 is substantially flat in some conventional can designs, and in other designs the upper surface 129 may have a slight curvature, domed or arced shape with a center region being slightly higher in elevation than a outer peripheral upper surface edge. The conventional can top 120 also includes a tab 115 affixed via a tab connector 116 to the upper surface 129 of the can top 120. The tab connector 116 may be a rivet or spot weld located at or near a center region of the can top 120. The tab 115 includes a lifting end 118 and a leveraged end 119. The leveraged end 119 of the tab 115 is aligned over an openable section 124 defined by a breakaway seam 123 on the can top 120. The openable section is commonly a circular or oval shaped region defined on the upper can top surface by being pressed, punched, scratched or etched into the upper surface 129 of the can top 120. This openable section 124 includes a breakaway seam 123 in the upper surface 129 of the can top. The tab 115 and openable section 124 allow a person to open the can 100 to dispense (e.g. drink or pour into a container) the liquid contents of the beverage can 100. Upon opening, the tab 115 remains affixed to the can top to minimize debris or garbage produced by cans that are sold and opened by consumers.

To open the can 100, a person (not shown) inserts a fingertip, fingernail or other prying device under the lifting end 118 of the tab 115 (between the lifting end 118 and the upper surface 129 of the can top 120) and applies an upward or lifting force to the lifting end 118 of the tab 115 up and away from the upper surface 129 of the can top 120. In response to the raising the lifting end 118 in this manner, the tab 115 pivots at the tab connector 116 and the leveraged end 119 applies a downward force against the openable section 124 causing the openable section 124 to be forced downwards into the can housing 105 relative to the upper surface of the can top 120. When enough force is applied, the openable section 124 breaks away from the can top 120 along the breakaway seam 123 and bends downwards and inwards into the inside of the can 100. After opening the can 100 in this manner, the tab 115 remains fixed to the top surface 129 via the rivet 116 and the openable section 124 remains connected to the can top 120 via a small region of the upper surface 129 of the can top that remains connected between the upper surface 129 and the openable section 124 (that is now depressed or bent down into the can body 105). That is, the openable section 124 remains attached to the can top 120 since the breakaway seam 123 does not completely surround the openable section 124. In this manner, the openable section 122 and tab 115 do not break off completely from the can top 120 and avoid becoming loose in the liquid contents of the can 100.

Once the conventional can 100 has been opened by a person in this manner, a person is able to dispense liquid contents from the can 100 by tipping or tilting the can 100 sideways from its upward position toward the openable section 124 (that now provide a hole in the can) in order to pour liquid from the "now open" openable section 124. The person may dispense the liquid contents of the can 100 into another beverage container such as a glass, cup, bowl or the like, or quite frequently the person may drink directly from the can 100 using his or her mouth.

U.S. Pat. No. 6,065,634 discloses some examples of conventional can top designs and also teaches and shows details of machinery to securely seal a can top to a can body using conventional techniques. This patent further shows details of an example seam between a can and can top. The entire teaching and contents of this reference patent are hereby incorporated herein by reference.

BRIEF DESCRIPTION

Conventional beverage can and beverage can top configurations such as those described above suffer from a variety of deficiencies. In particular, conventional beverage cans and beverage can tops such as the can 100 and can top 120 as shown in FIG. 1 are subject to contamination issues on their outer surfaces. Surfaces such as the upper surface 129 of the can lid or top 120 and the upper end 109 or neck of the can 100 are highly susceptible to exposure to substances that are containments or debris such as dirt, dust, grime, germs, bacteria, viruses, microbials, fungus, mold, toxins or other depositions. Exterior surfaces of conventional cans and can tops often become "dirty" or unsanitary from exposure to various environmental contaminants shortly after the canning process is complete. Additionally, liquid consumed either directly or indirectly from conventional beverage cans can become contaminated due to the design of conventional beverage cans and can top or lids.

In particular, after the can top and body manufacturing and/or canning process is complete, a conventional can and can top are often exposed to a variety of unsanitary environments. Such unsanitary environments may exist during the conventional processes of can and/or can top manufacturing, filling (canning or bottling)/seaming, packaging and shipping, and while awaiting purchase by the consuming public (e.g., while sitting on supermarket shelves and/or in refigerators or vending machines), and after purchase but before opening of the a conventional can.

FIG. 2A shows a detailed cross-sectional, profile or cutaway side view of the cross sectional shape of one example design of a conventional can top 120. Note that in FIG. 2A, the coupling between the can top 120 and can body or housing 105 are shown only generally and details of the double seam that form the rim 122 of the can are not shown in this figure. During a conventional canning/bottling process, a conventional canning machine (not shown in this figure) forms a rim 122 of the can top 120 by seaming an outside peripheral edge 121 of the can top 120 to the upper end of can body 105 to form a liquid and airtight seal between the can top 120 and the can body 105. Once the top or lid 120 is seamed to the can housing or body 105 in this manner, the inside surfaces 111 of the can are protected from the outside environment by an airtight seal. To form the seal, the outside edge 121 of the rim may be folded and wrapped around and under the upper body edge 110 to form a double seam that creates the rim 122. Examples of such a double seam rim 122 are shown in detail in later figures (for example, FIG. 21 shows an example double seam of a typical can top). The circular rim 122 continues around the circumference of the can top 120. The shape or profile (as shown in FIG. 2) of a conventional can top 129 also defines a well area, countersink or groove 130 located just inside the rim 122. Note that depending on the can top 120, the slope, profile or angle of the inside edge 127 of rim 122 of the can top 120 can be greater or less than that illustrated in this example. Depending upon the manfacturer and process of forming the can top, can housing and seaming process, the exact profile of a beverage can housing 105 and top 120 may vary form this figure.

The countersink groove 130 defined by a conventional can top 120 is a recessed crevice-like area of open space defined between the inside edge 127 of the rim 122 of the can and an outer edge 135 of the upper surface 129 (i.e. the central panel) of the can top (the outer edge 135 of this central panel 129 also generally defines the top inside edge of the groove 130). The groove 130 dips down in elevation below the upper surface 129 of the can top at the peripheral or outer edge 135 of the upper surface 129 of the can top 120. If a can 100 is positioned upright, the groove 130 is formed by the surface of the can top between an inside of the rim 122 (on the side of the rim facing the center of the can top) and dips or extends in elevation below the top surface 129 of the can top and ends where the upper surface of the can top begins (at the edge 135). This groove 130 is often the lowest point in elevation on the entire can top surface. One purpose of providing this groove is to allow the can top 120 to not distort when the contents of the can are under pressure. Thus the groove 130 provides strength to the can top design and most conventional beverage cans in use today include a groove of this nature.

In conventional can and can top designs, the groove is problematic since the groove is a countersink area that is very susceptible to collecting debris such as dirt, dust, sand, or other particulate matter that may settle onto the cap top surface and that may fall into or be pushed or wiped into the groove 130. As an example, many health conscious consumers who consume liquids from conventional beverage cans 100 have a desire to have the least amount of contamination possible in the liquid dispensed from the can 100. In an attempt to clean the can top 120 of as much debris as possible, many consumers often wipe the top 120 of a conventional beverage can 100 with a cloth or with their fingers prior to opening the can. This wiping action may result in pushing or forcing debris and contaminents such as dust and dirt into the groove 130 defined by a conventional can top 120 just prior to opening of the can. Additionally, even if not wiped, any loose dirt or contaminants that reside on the top of the can may simply shake loose during handling and fall into the groove prior to opening the can. The groove 130 defined in a conventional can top thus serves as a receptacle or collection area for much of the dirt and debris on a can top.

When dispensing (i.e. pouring) liquid contents from a conventional can from the openable section 124, a person tilts the can so that the liquid contents within the can is able to flow or be poured from the openable section. This tilting action may cause debris that resides in the groove to roll, slide or otherwise move towards a portion of the groove 130 that is adjacent or close to the openable section 124 of the conventional can 100. As the liquid contents flows out of the conventional can 100, the liquid flows out of the opening 124 and over a portion of the upper surface 129 of the can top 120, into and through the groove 130, and then over and off of the outer edge rim 122 of the conventional can 100. The turbulent flow of the liquid over this path may cause the liquid to pick up and transport debris from within the groove. Such debris or contaminants can be picked up by the flowing liquid and/or absorbed or dissolved into the liquid and transported for ingestion by the person consuming the liquid either directly or indirectly from the can. In general then, conventional cans and can tops provide for a less sanitary design and the groove 130 provides a receptacle for dirt and debris that is difficult to effectively clean. Further still, the presence of the groove 130 in the path of the liquid can introduce turbulent flow that causes extra release of carbonation within the liquid being poured from a conventional beverage can 100 prior to consumption. Thus the groove 130 in a conventional can and can top design can cause premature release of carbonation that can negatively impact the feeling and taste of the liquid as experienced by a person consuming the liquid.

Embodiments disclosed herein provide methods and apparatus to reduce or inhibit the collection of debris on the outer surfaces of beverage cans and can tops. Mechanisms and techniques disclosed herein provide embodiments that reduce health risks, cleanliness and sanitary issues posed by designs of conventional beverage cans, can tops and methods of manufacture and use thereof. Generally, embodiments disclosed herein reduce the ability of outer surfaces of a can top and body to collect, trap and/or support growth of debris or other contaminant substances. Embodiments disclosed herein thus provide "clean can" technology that reduces the ability of a can top and can to collect debris. In particular, several embodiments disclosed herein remove the surface presence of the groove in the can top design by providing a groove cover that covers and essentially eliminates the surface presence of the groove from the path of the liquid flowing form the opening of the can. The groove cover can be placed over the groove and provides an upper groove cover surface that enables easy wiping of the exterior surfaces of the can top. The groove covers slopes up the inside of the rim and thus provides a nice seamless (e.g. no coreners to clean or trap dirt) transition to wipe dirt up and off of the rim. Some embodiments fill in the groove, while others reside totally above the groove. By filling in or covering or residing above the groove and providing a smoother and cleaner can top surface (as opposed to the presence of the groove on a conventional can top), a more health friendly can top design is disclosed. Wiping of a can top equipped with embodiments disclosed herein also promotes easier removal of contaminants that resides on the exterior can top surfaces.

In particular, an example embodiment comprises a beverage can (e.g. an aluminum or other metallic can) to store fluid. The can includes a circular can top coupled to the beverage body to retain the fluid in the beverage can. The circular can top includes (e.g. defines or creates from its shape) a groove disposed substantially near a perimeter (e.g. just inside a rim of the can) of the circular top that affixes to a body of a the beverage can. An openable flap, region or openable section is defined in or on the can top to allow opening of the can and dispensing of the liquid from the beverage can. According to embodiments disclosed herein, a groove cover resides above, or covers and/or fills at least a portion of the groove in the circular can top. Once applied, the groove cover remains in place before, during and after opening an openable section defined on the can top. The groove cover becomes "part of" the can top and remains in place during dispensing of the liquid from the can.

In example embodiments, the groove cover fills a portion of the groove near or closest to the openable section in the can top. In other embodiments, the groove cover fills-in the entire groove defined in the can top. In other configurations, the groove cover extends from an inside edge that starts on the upper can top surface and extends upward and radially outward (from the center of the can) up towards a region near, at or above the top of the rim, thus providing a sloped surface from the center panel up towards the top of the rim. In some configurations, the device resides totally above the groove, and does not enter the groove at all. Even the underside of the device does not need to interfere with or fill in the groove. In yet other configurations, the groove cover extends up and over the rim or perimeter of the can top and covers and fills-in a rim groove defined at an intersection of an outer lower edge of the rim of the can top and the can body. This rim groove (at the lower outside edge of the rim of the can top) is susceptible to debris collection during handling of the can. In other example embodiments, the groove cover provides a substantially smooth surface allowing ease of wiping of debris from the can top, and prevents debris from collecting or getting stuck in the groove (both the groove in the can top, and for embodiments that extend the groove cover over the rim, for the rim groove) for portions (or all) of the groove filled with the groove cover.

The groove cover may be applied during manufacture of the can top or shortly thereafter before the top is sealed to a can body, or the groove cover may be applied during the canning process, or after the top is sealed to the can. In other embodiments, the groove cover can be an item purchased by consumers and placed onto the can top to fill-in and/or cover the groove. Certain embodiments of the groove covers disclosed herein can be removable via a handle or finger tab extending form the side of the groove cover, while other embodiments are intended to be installed onto the can top and can and remain in place for the life of use of the can.

The groove cover may be held in place, for example, by a bonding that forms between the groove cover and the can top surface, or an adhesive may be used of hold the groove cover in place, or the groove cover may include one or more appendages that interface to the can top to secure the groove cover in place as a pure mechanical fit. As an example, the groove cover may include appendages that such as flexible tabs that protrude from a portion of the groove cover that resides within the groove. The inside wall of the groove (the surface of the can top wall that drops off from the upper surface of the can top towards the bottom of the groove) may include impressions or indentations that are spaced around this inside wall.

The groove cover may be, for example, in a form of a groove ring made of food-grade plastic (e.g. polyethylene terephthalate (PET) plastic) that includes tab-like appendages that extend radially inward. Such appendages may couple to a lower end of a groove insertion section or groove cover body (a part of the groove cover that extends downwards into the groove) and extend upwards (back towards the top of the groove) and outwards towards one or both sides of the groove cover. An outward end of each tab or appendage deflects inward during insertion of the groove cover into the groove and after clearing the groove opening, deflects back outward to enter into a corresponding recess or impression defined in one or both the sidewalls of the groove defined in the can top. The appendages or tabs operate as anchors to hold the groove cover in place on the can top. That is, the tab or barb-like appendages that extend form the groove cover body can briefly deflect upon insertion (e.g. press fitting) of the groove ring onto the can top to allow the groove ring to be inserted into the groove. When the appendages deflect and clear the top outer perimeter of the upper surface of the can top, the appendages then spring back and enter into and reside in the corresponding impression in the inner groove wall, thus holding the groove ring in place. In this manner, the groove ring in this configuration is designed to be permanently attached to the can top from the time of placement of the groove cover (e.g. at time of manufacture of the can top, or just after seaming of the can top to the can) to the time of disposal of the can. It thus remains in place before, during and after dispensing of the liquid contents of the can.

In some configurations the groove ring remains in place during shipping, and before, during and after dispensing liquid from the openable section in the upper surface of the can top. Other configurations provide a removable groove ring that can be applied to a can, used while opening and drinking or pouring liquid from the can, and then taken off and reused on another can. In general, the configurations of the groove ring disclosed herein prevent dirt and debris from getting into the groove of the can top and provides for a cleaner and more tasteful and more sanitary and cleaner can drinking experience. The groove ring does not prevent all debris from collecting on the can top, however the groove ring greatly assists removal of dirt and debris when the can top is wiped by a person just prior to opening the can since the groove of the can top can no longer serve as a receptacle for such dirt or debris that is wiped away. During wiping, surface dirt on the can top is able to slide easily over the upper groove cover surface of the groove ring instead of going down into the groove.

Can manufacturing and bottling operations must be very fast. Embodiments of the groove ring and groove cover disclosed herein are quick to apply, inexpensive to manufacture and apply, and do not significantly slow down the canning/bottling process or can top manufacturing process. The designs provide for a much more cleanly drinking experience and can be marketed as such. Modern consumers are very concerned about their health and well-being and the groove ring technology disclosed herein provides a "clean-can" drinking experience. Customers of one brand of beverage might be enticed to switch over to another beverage brand due to the clean can technology disclosed herein. Thus the present invention provides a strong marketing tool since beverage cans that employ the techniques and apparatus disclosed herein provide a competitive advantage by offering a cleaner can top from which to drink from.

Other embodiments will be described in more detail herein and it is to be understood the above is not intended to be a complete summary or brief description of all embodiments, nor is the above summary intended to be limiting of the scope of embodiments described herein. It is also to be understood the embodiments disclosed herein are shown by way of example only and the spirit and scope of the inventions protected by this disclosure are not intended to be limited to these examples only. Those skilled in the art of canning, can top and can manufacturer, and related technologies will appreciate, after having read and understood this disclosure, and using hindsight derived form the teaching herein, that numerous variations on the embodiments described herein are possible and that this disclosure is not limited to these specific examples, dimensions, configurations and the like.

BRIEF DESCRIPTION OF THE DRAWINGS

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, and variations, etc. disclosed herein.

DETAILED DESCRIPTION

Figure 1:
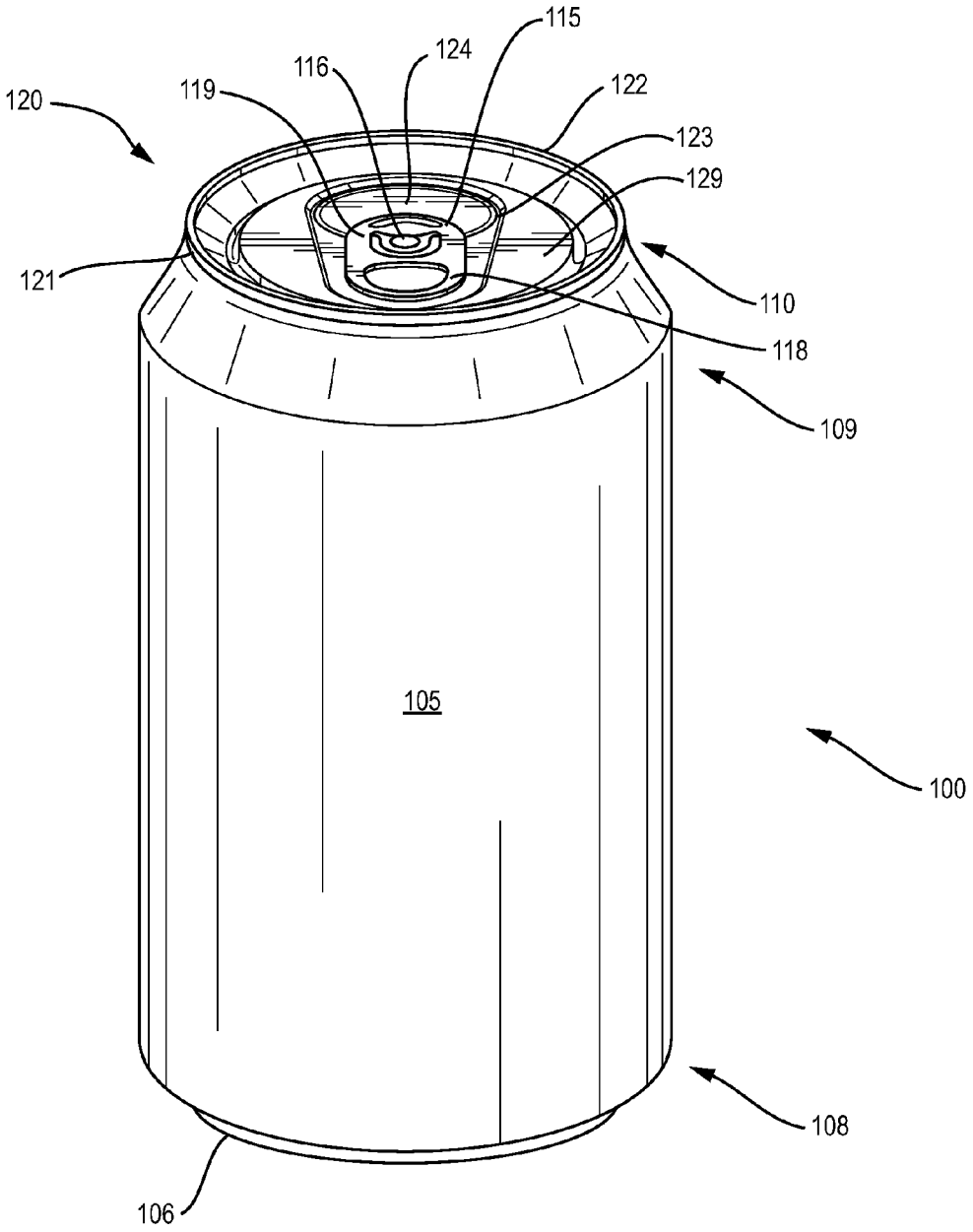
FIG. 1 (PRIOR ART)
FIG. 1 illustrates an example of a conventional beverage can.

Embodiments disclosed herein provide "Clean Can" technology that provides for more sanitary beverage cans and can tops. Beverage cans have been in use for many years in packaging of many types of alcoholic and non-alcoholic beverages such as soda, pop, soft drinks, fruit juice, beer, wine and even water. A sanitary issue that is present in conventional cans and can tops is that conventional can tops define a countersink groove, crevice, or well area that surrounds an upper surface of conventional can tops, and is typically defined just along the inside of the rim of the can. The groove is provided to add strength to the can top, especially for carbonated beverages. This groove is highly susceptible to collection of unwanted dust, dirt, debris, grime, microbes or other unwanted debris. This can happen from debris that settles onto the can top and then that falls into the groove during shifting, movement or handling of the can, or may result when a person wipes a conventional can top with a cloth or their fingers as is commonly done by today's health conscious consumer prior to opening the can. Debris and unwanted substances can also collect on the outer sides of the rim and within a crevice or seam defined between the outside edge of the rim and the sidewall of the can housing or body. That is, the rim seam in between the rim and the can housing is another area where dirt and debris can collect. In particular, six pack holders, also referred to as "hi cones", are plastic band like devices that fit snugly and stretch over the outside of the rim of a beverage can top. After passing over the outside of the rim, the six pack holder snaps in place along this rim seam. When on place, the six pack holders can force, pack or push any dirt or debris into the rim seam.

Conventional can and can top designs make it difficult to remove the debris form the groove and rim seam prior to opening the can. Removal of debris from the groove is difficult since the countersink groove on the top is rather narrow and relatively deep compared to its width. This makes it difficult to get a wiping surface such as fingers or a cloth all the way to the bottom of the groove. Accordingly, debris often remains in the groove even after wiping. Some people may wash or rinse the top of a can briefly under running water to rinse out the groove, but even then, if the contaminant or debris is stuck or wedged in place, or is sticky or is not water soluble, the debris may remain positioned in the groove. After the can is opened and liquid is dispensed from the openable section in the top of the can, debris on exterior surfaces of the can top, such as that within the groove, may come into contact with liquid as the liquid is poured form the can and passes over, into and through the grove and onto and over the rim of the can. Likewise, unwanted substances that might collect under the outside lower edge of the rim of the can can contact a person's mouth at their lower lip area when drinking directly from the can. Generally, this is a relatively unsanitary situation.

Embodiments disclosed herein generally provide mechanisms to cover and/or fill in the groove and, depending upon the embodiment, other areas of the can and can top with a groove cover material. By eliminating the groove from the upper surface of the can top (by covering and/or filling in the groove), the groove cover provides an alternative surface to an area of the can top that is normally hard to clean (e.g. the groove area). This upper groove cover surface provides a surface to bridges the gap of the groove from the upper surface of the can top (upon which the openable section is defined) to the inside edge of the rim of the can (and in some enbodiments extends over the edge of the rim and down the side of the can). By providing this upper groove cover surface, the can top can be easily cleared of debris, for example, by shaking or wiping the can top, including the upper groove cover surface. Debris no longer is able to enter the groove and thus the can top is cleaner than if the groove were present (as in conventional can tops and cans that are not equipped with the embodiments disclosed herein). Depending upon the embodiment, the groove cover may be a solid or substantially solid material (or a liquid that turns to a solid), that when disposed in or over the groove, provides an upper groove cover surface that extends from an inside edge of the rim of the can top to the edge, or slightly overlapping the edge of the upper surface of the can top. As an example, in one configuration, the upper groove cover surface has an inside edge that resides or touches the upper surface of the can top in between the openable section of the can top and the inside edge of the upper surface of the can top. As such, in this example, the groove cover spans the gap of the groove and the inside edge of the top of the groove cover rests against the upper surface of the can top but it does not cover or interfere with the openable section and thus does not interfere with opening the openable section of the can top to dispense the liquid contents. Example embodiments are used for filling in or covering the groove of metallic beverage cans, but beverage cans made of other materials, such as plastic beverage cans that include the groove defined in the can top as discussed herein, can also benefit from the embodiments disclosed herein.

Certain other embodiments provide for the groove filer to extend up and over the rim of the can and continue extending below a lower lip of the outside edge of the rim of the can. For embodiments in which the groove cover extends up and over and down the outside rim of the can, the groove cover also can fill in a gap or "rim groove" formed at the intersection of the outside lower edge of the rim of the can and the body. This rim groove is also prone to collection of debris during can handling. By covering this rim groove, and providing a substantially smooth surface to drink from that extends down the sidewall of the can housing or body, sanitary drinking conditions of the can are further improved. If the groove cover extends far enough down the outside sidewall of the can body, for user drinking directly from the can, the groove cover can eliminate contact of the metal of the can or can top with a person's mouth and lips, thus somewhat reducing a metallic taste from metal contact with the can and/or can top. The groove cover can also improve the comfort of the drinking experience by providing a less-hard surface than the metal edge of the conventional rim of a can.

In other embodiments, the groove cover is disposed into the groove (or over the groove to cover the groove) and remains adhered to the can top below a top edge of the rim of the can top and just inside of the rim of the can top. That is, in some embodiments the groove cover does not extend, protrude or otherwise reside anywhere above the top of the rim of the can top. In such embodiments, the groove cover remains adhered to the can top, and covers or fills-in at least a portion of the groove closest to the openable section of the can top.

In embodiments disclosed herein, the groove cover remains in place before, during, and after opening of the openable section in the can top, and while dispensing liquid from the openable section of the can top. In such embodiments, the liquid flows over the groove cover material as it exits the can during pouring.

In some embodiments the groove cover operates as a groove cover thus leaving some open space within the groove beneath the groove cover, whereas in other embodiments, the groove cover not only covers the groove, but also enters and fills-in substantially all of the groove. It is to be understood that all embodiments disclosed herein need not fill in the groove to its entire depth and that to save on material costs, the groove cover might only cover the groove and be a fairly thin layer that does not substantially fill in a great depth of the groove.

In general, the groove cover fills-in at least a portion of the groove on a can top and creates a surface that promotes ease of removal of the debris from the can top, such as is intended when wiping a can top. In some embodiments, since the groove cover provides an upper groove cover surface that is approximately equivalent in height to the upper surface of the can top (the surface that defines the openable section), the wiping process applied to a can top also wipes the upper groove cover surface and provides a cleaner can top than without the groove cover. Other embodiments allow the groove cover to extend slightly up the inside edge of the rim of the can top and form a ramp-like upper groove cover surface. In such cases, the groove cover provides a ramped upper groove cover surface for the wiping action to carry the debris upward over the upper groove cover surface and move the debris up the inside edge of the rim of the can top and off of the rim completely thus assisting in cleaning the can top substantially more than conventional cans in which dirt is difficult to wipe past the groove (because it may go down into the groove). Since the can top is now cleaner (as opposed to pushing debris down into the groove at an area of the groove near the openable section), liquid that flows from the opening in the can passes over the wiped upper groove cover surface thus providing a more sanitary liquid consumption experience from cans and can tops equipped with embodiments disclosed herein. This provides health and safety conscious consumers with a cleaner and healthier can drinking experience.

In general, during opening of the can, the groove cover is affixed or adhered to the can top surface and therefore remains in place during opening and pouring of liquid from the can. During dispensing of liquid from the can, the liquid contents of the can actually flows over the groove cover. Since the groove is no longer an area through which the liquid passes as it exits the can (thus the groove is said to be "removed" or "eliminated" even though it actually still exists and is still defined by the metal shape or profile of the can top), the liquid does not pick up debris from the groove due to turbulence. That is, the groove cover does not actually eliminate the groove, but merely masks its existance from the perspective of flow of the liquid from the can, and when wiping the can top to clean the can top. While certain embodiments disclosed herein show alterations of can top designs to accommodate affixing the groove cover the can top, other embodiments require no modification to the conventional shape or profile or design of the can top.

Additionally, since certain embodiments of the groove cover provide a more laminar flow of the liquid as the liquid exits the can, turbulence of the liquid is reduced (as compared to liquid flowing into and out of the groove in cans not equipped with the mechanisms disclosed herein) and therefore more carbonation is maintained in carbonated liquids that are dispensed form the can. A person drinking from a can equipped with embodiments disclosed herein may thus experience better tasting liquid since more carbonation is released in their mouth (as opposed to being released during turbulent action imposed by the conventional can top groove as is the case with conventional cans). This provides for a more pleasurable and tasteful drinking experience since the liquid is less agitated while leaving the can and therefore less likely to elicit release of carbonation prior to entering a person's mouth or a container.

Embodiments disclosed herein differ substantially from such things as removable foil tops, snap on can covers and the like since the groove cover embodiments disclosed herein do not interfere with opening of the can and remains affixed to the can before, during and after opening of the can, and while drinking or pouring from the can. The groove cover provides a smooth surface to inhibit collection of debris on the can top. Even if no wiping is performed, the presence of the groove cover causes the can to be less susceptible to trapping dirt, grime, dust or other debris (e.g. debris that does become disposed on the can top is able to more easily slide off the can top due to the presence of the groove cover). From the aforementioned overview, those skilled in the arts of can and can top production, can bottling equipment and beverage can packaging, and marketing of liquids packaged in beverage cans will now appreciate the value, novelty and non-obviousness of embodiments disclosed herein. The remaining discussion will now cover details of specific example embodiments with reference to the figures. It is to be understood that the following discussion is not descriptive of all embodiments or variations but rather covers example configurations.

Figure 3:
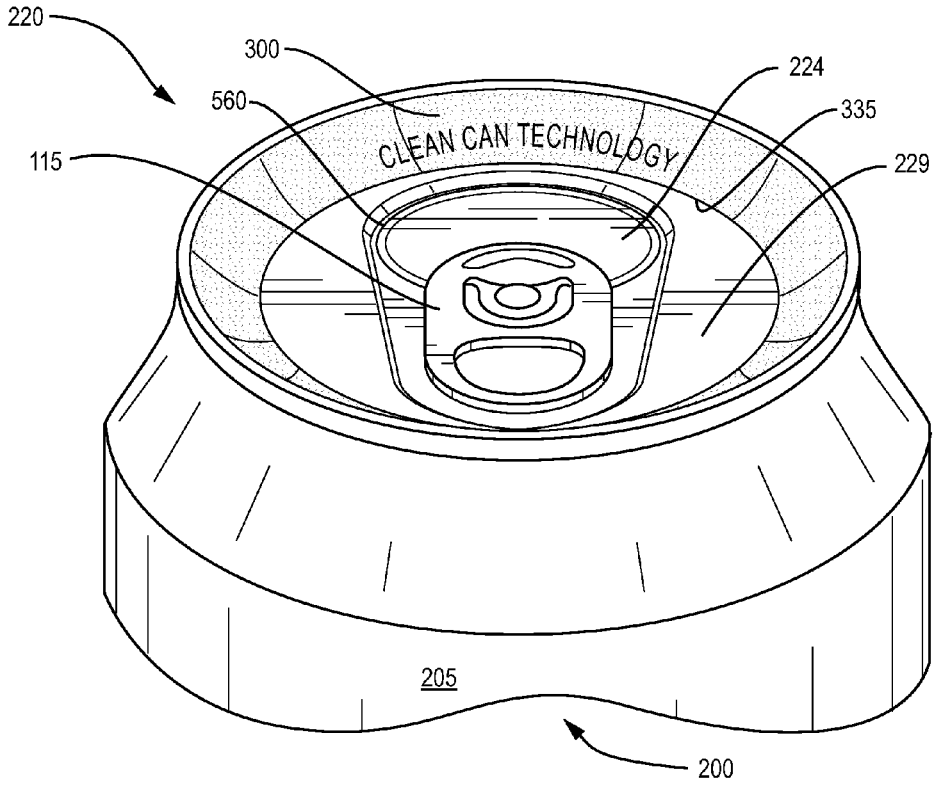
FIG. 3 illustrates an example embodiment in which a groove cover is disposed on a can top to fill-in the groove defined by the can top and that provides an upwardly curved upper groove cover surface that enables wiping of the can top to more easily remove debris from the can top (due to bowl shaped that groove cover provides to can top).

FIG. 3 illustrates an example embodiment of a beverage can 200 and a can top 220 configured in accordance with one example embodiment disclosed herein. The beverage can 200 may be a metallic beverage can made from material such as aluminum alloy, steel, tin or other metal, or may be made from material such as glass or plastic. The can 100 includes a body 200 and a can top 220 coupled to the body 200. The can top 220 is shaped or formed to define a rim 222 and an upper surface 229 that includes an openable section 224 of the can top 220. A groove cover 300 is affixed to the can top 220 and covers a groove that exists under the groove cover 300. The groove is defined by the shape of the can top and cannot be seen in FIG. 3 since the presence of the groove cover covers the groove. By providing the groove cover 300, the upper exterior surfaces of the can top 220 can be easily wiped clear of dirt and debris as compared to the same can top that does not have the groove cover 300. Thus the groove cover 300 provides a substantially cleaner can top and assists in removing debris when the can top is wiped by person prior to drinking. The groove cover 300 also provides a cleaner visual appeal and look to the can top 220 and as will be explained in later embodiments, can be colored, or can include text, or an embossed or embedded message, or can be made of temperature sensitive material that changes color when cold and that can be used for advertising and marketing purposes. It is worthy to note that the groove cover is directly visible the entire time a person drinks from the can. In FIG. 3, only one example embodiment of the groove cover 300 is shown to cover the annular countersink groove defined in or by the can top 220.

Figure 4:
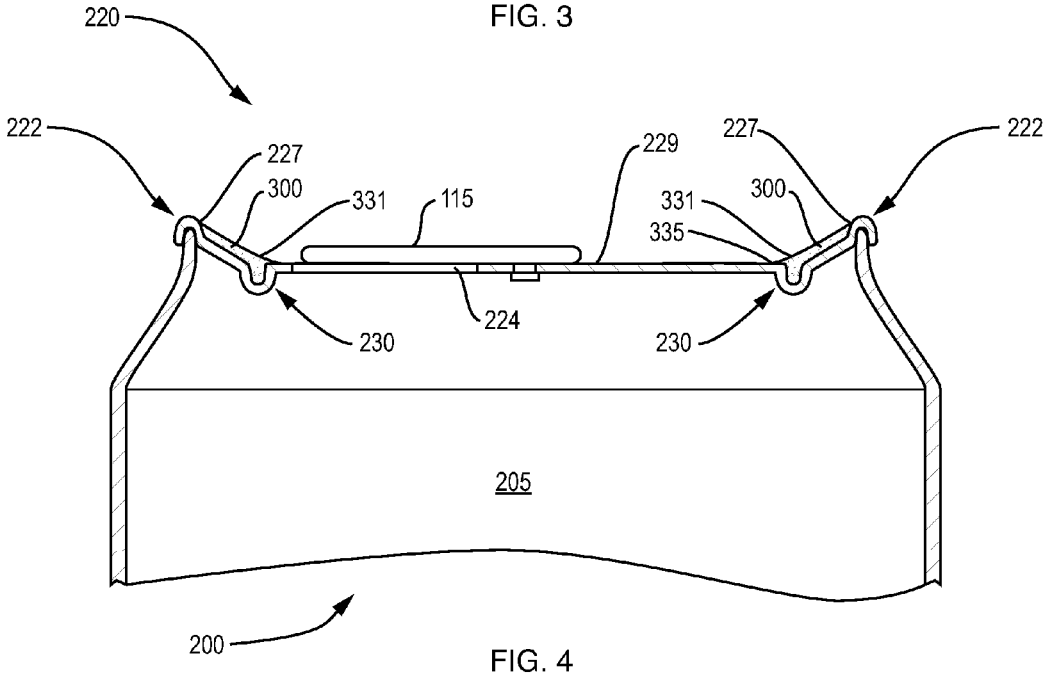
FIG. 4 illustrates an example a cross sectional view of the can top with the groove cover from FIG. 3.

FIG. 4 illustrates a cross sectional view of the shape or profile of the same can top 220 from the example embodiments shown in FIG. 3. As can now be seen in FIG. 4, the example profile of can top 220 defines a groove 230 between an inside edge 227 of the rim 222 of the can top and the upper surface 229 of the can top 220. In each of FIGS. 3 and 4, a groove cover 300 (i.e. a material) is provided in accordance with example embodiments disclosed herein and is disposed in the groove 230 to fill-in and/or cover the groove 230 in at least a portion of the groove 230 that is located adjacent to the openable section 224 of the can top 220. Generally, the groove cover 300 prevents collection of debris such as dust, sand, dirt, grime, or other contaminants within the portion of the groove in which or over which the groove cover 300 is disposed. Other advantages and benefits of the groove cover and many variations of the main idea and concept are noted throughout this document. It is also noted here that while the embodiments described here use the term "groove cover", it is not a requirement of embodiments that the groove 230 actually be filled by the groove cover material. In fact, depending on the configuration, the groove cover material does not need to fill in the groove at all and could be configured to cover the groove and operate to provide an upper groove cover surface that provides a bridge over the groove 230.

In the examples shown in FIGS. 3 and 4, the groove cover 300 extends around the entire perimeter or circumference of the annular countersunk groove 230 that exists and is defined around the can top 220. That is, the groove cover 300 is disposed in the groove 230 to entirely fill-in and/or cover the entire portion of the groove between an inside edge 227 of the rim 222 of the can top 220 and the upper surface 229 of the can top along an entire length of the groove 230 around the can top (thus forming an entire circular ring of groove cover material (i.e. a groove ring). Note that the upper groove cover surface has (or defines) an inside edge 335 that resides, rests on, or touches the upper surface 229 of the can top 220 at a location, in this particular example, that exists in between the openable section 224 of the can top and the top edge of the groove as it transitions onto the upper surface of the can top. That is, the inside edge 335 of the groove cover 300 can extend onto the upper surface of the can top, and can terminate somewhere on the upper surface of the can top before interfering with the opening of the openable section 224. As such, in this example, the groove cover 300 spans the gap of the groove and its inside edge rests against the upper surface of the can top but it does not cover the openable section and thus does not interfere with opening the openable section of the can top.

Note in this example embodiment the groove cover 300 has an outer edge 227 that terminates just inside the top edge of the rim 222 of the can. Depending upon the embodiment, the outer edge 227 of the groove cover 300 can terminate anywhere along or below the inside wall of the rim 222 of the can (e.g. terminating somewhere below the inside rim or even at or just near the top of the inside wall of the groove). Also as shown in the example in FIG. 3, the inside edge 412 of the groove cover 300 terminates just over the top inside wall of the groove. This is shown by example only and in other embodiments, the groove cover can be a material that extends and covers some or all of the upper surface 229 of the can top (as a thin layer), even covering, in some example embodiments, the openable section 224 of the can top 220. That is, the groove cover 300 in some embodiments is a material that provides an upper groove cover surface 331 that extends significantly out onto and over the upper surface 229 of the can top and overlays an covers the entire upper surface of the can top as a thin layer. In such embodiments where the groove cover 300 covers the whole upper surface 229 of the can top, upon opening of the openable section 229 of the can top 220, a portion of the groove cover material on the openable section of the can top that is bonded or adhered to the openable section 229 of the can top remains adhered during opening and breaks away from surrounding groove cover material (portions of the groove cover material 300 that do not cover the openable section 224) and remains secured to the openable section 224 of the can top as the openable section 224 of the can top is bent down and moves into the interior of the can body 205 during an opening operation of the can 200. In such embodiments, the groove cover is a material 300 that resides under the opening tab 115 of the can top used to open the openable section of the upper surface of the can top. Other embodiment include groove cover material 30 that covers all upper exterior surfaces of the can top within the confines of the rim 222 except the openable section 224 of the can top.

In other embodiments, the groove cover may be a material 300 this is a liquid, or is sprayed on, and the material 300 may cover (as a thin sprayed on layer) the tab portion 115, but is thin enough to flow through the tab and thus does not interfere with the opening operation (i.e., it does not make it harder for a person to get a fingernail or other opening device under the tab 115).

In other embodiments, the groove cover is a material that provides an upper groove cover surface 331 that extends out onto the upper surface 229 of the can top 220 and overlays an covers an upper surface of the can top as a thin layer but excluding the openable section 229 of the upper surface of the can top. In such embodiments, the groove cover is not placed or applied on the can top to cover the openable section 229.

In one embodiment, the groove cover 300 has an outer edge 414 that terminates along an inside wall of the rim of the can top whereas in other embodiments the groove cover 300 extends over a top of a rim of the can and down the outer (i.e. outside) wall of the rim of the can. By extending (e.g. as a thin layer) up and over the rim 222 of the can 200 and down onto the outer sidewall of the can body or can housing 205, the groove cover material 300 can provide a more sanitary drinking surface for areas of a person's mouth or lips that contact the sides and can top areas of the can 200.

During typical can top construction, a rivet is formed in the can top to hold the tab 115 in place. If the groove cover material 300 is placed onto the can top during can top construction (but before sealing of the can top 220 to the can housing 205), the tab 115 can be attached after application of the groove cover 300 to the can top, and thus the tab 115 can overlay or cover the groove cover 300.

Note that the groove cover 300 can have an upper groove cover surface that can provide a shape that is different that the overall profile or shape of the can top. That is, other than filling in the groove 230, the groove cover can provide an upper surface that reshapes and provides a new more-easy-to-wipe outer and upper surface of the can top. For instance, as shown in FIGS. 3 and 4, the upper groove cover surface 331 can provide a shape or profile for the groove cover that can assist a person when wiping the can top 220 for debris removal by providing a gentle upward curve surface. This upper groove cover surface 331 promotes ease of can top cleaning by eliminating the presence of groove from the can top from the perspective of the upper exposed surfaces of the can 200. This creates a clean can drinking experience and makes a consumer feel more comfortable when drinking from a can that includes embodiments of a groove cover and can top as disclosed herein.

In certain embodiments, the groove cover 300 fills-in the groove to a depth that is at least substantially equivalent to the upper surface 229 of the can top 220. Note in the example shown in FIGS. 3 and 4, an outer edge of the groove cover (a side closest to the rim of the can top) extends to an elevation along the inside edge 227 of the rim 222 of the can top 220 that is located above the upper surface 229 of the can top 220 to provide a ramp-like area that promotes ease of removal of debris up and over the rim of the can top (off of the can), and to provide a less disturbed flow path for the liquid as it is poured from the openable section. In this example in FIGS. 3 and 4, the groove cover does not extend over the top of the rim 222, but instead remains below a top of the inside edge 227 of the rim 222 of the can top 220.

In the example shown in FIGS. 3 and 4, the groove cover 300 provides an upper groove cover surface 331 extending at least between the inside edge 227 of the rim 222 of the can top 220 and the upper surface 229 of the can top 220 (thus covering and filling in the groove 230) to preventing collection of debris in the annular countersink or groove 230 defined by the can top 220. The groove filer 300 in this example thus forms a complete circle around and within the groove 230 on the can top 220 and fills-in the entire groove 230. This substantially eliminates contamination and debris collection issues presented by the groove 230. In other embodiments, the groove cover 300 has an upper surface 331 that terminates or ends somewhere along the inside edge 227 of the rim 222 of the can top.

In the particular can top example profile shown in FIG. 4, the inside edge 227 of the rim 222 of the can top extends downwards and then slopes inwards and away from the rim 222 on a slope towards the groove 230. Note this is a conventional can top profile and those skilled in the art of can top formation, can top seaming technologies, and beverage can construction and bottling technologies will understand that there are numerous can top shapes, designs and profiles and that the upper surface 229 of the can top can include other features not shown in detail in these drawings. Most of such conventional can top designs however provide for this annular countersunk groove 230 to add strength to the can top and resist internal pressures from carbonation and heat expansion of liquid contents of a can.

It is to be understood that the groove cover concepts, designs and teaching disclosed herein are applicable to any type of can top that provides for such a countersink groove at or near the inside of the rim of the can, or even for can top with strengthening grooves placed more towards the center of the can top. It is to also be understood that later embodiments will disclose can top designs that have features that accommodate a groove cover and that these are considered embodiments covered by this disclosure. Additionally, the groove covers 300 themselves, as well as methods of application of groove covers to can tops may be considered novel embodiments disclosed herein (such groove can exist and be manufactured without the can tops 220). Methods can include securing or placing the groove cover onto the can top prior to securing or seaming the can top to the can housing, as well as placement and securing of the groove cover during the actual can top seaming operation, as well as placement and securing of the groove cover onto the can top after the can top seaming operation is complete.

Figure 5:
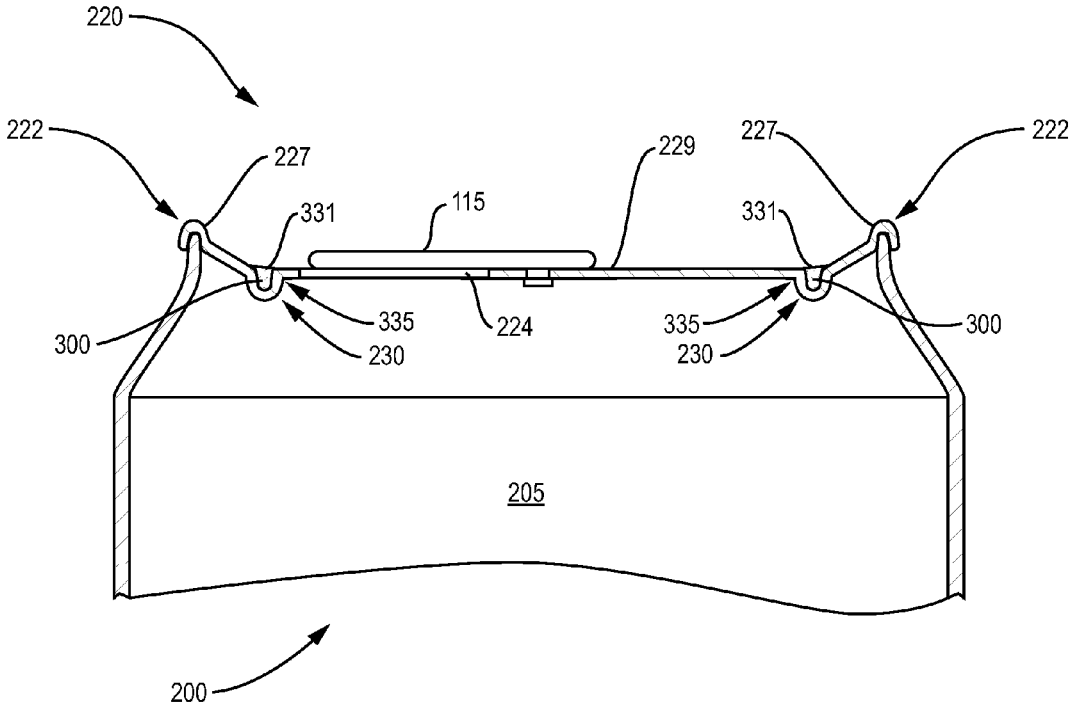
FIG. 5 illustrates an example cross sectional view of a can top that includes a groove cover that provides a substantially flat upper groove cover surface.

In other embodiments, the groove cover material 300 is formed and adhered to the surfaces of the can top and covers a larger portion of the upper surface of the can top than what is shown in FIGS. 4 and 5. As an example, the groove cover material in one embodiment can include side regions that extend out onto the upper surface 229 of the can top and come close to, or even extend under either side of the flip top tab 115 as will be explained. The groove cover material 300 can extend also extend and be disposed around the periphery of the openable section of the can top. That is, as opposed to the illustrated embodiments in FIG. 3 in which the upper groove cover surface 331 has an inside edge that terminate just over the outer edge of the upper surface 229 of the can top, in alternative configurations, the groove cover material 300 con provide an upper groove cover surface that continues onto and over the substantially flat upper surface 229 of the can top. If applied prior to securing the flip top tab 115, the groove cover material can extend over substantially all of the upper surfaces 229 of the can top. Depending on the configuration, this can include covering the openable section 224, or in the alternative, covering the entire upper surface of the can top 229, except for the openable section 224.

In such alternative configurations, the groove cover material 300 covers, and provides an upper groove cover surface 331 that extends over the entire upper surface 229 of the can top 220 (except for the alternative embodiment which would not cover the openable section 224 of the can top). In an embodiment that covers all of the upper surface of the can top (but possibly excluding the openable section), the groove cover material 300 can be applied in liquid, gel or spray on application to provide a thin layer that quickly dries, bonds and adheres over the upper surface 229 of the can top, and that flows into the fills in the groove 230 defined in the can top 220. An example is a radiation curable resin. In such a configuration, substantially all of the upper surface of the can top is covered by the groove cover material. The groove cover material can provide an upper surface 331 that is substantially smoother that the bare aluminum surface of a typical can top. This can promote ease of removal of debris that may collect or get stuck on the can top during normal can handling. Additionally, if the groove cover includes marketing information, such as embedded text, coloring, glowing material, temperature changing compounds or the like, the surface area of the groove cover material on the can top is maximized to promote visibility of such features.

In one embodiment, the groove cover 300 may be a thin pre-formed plastic part (e.g. PTE plastic) that provides a center area that resides over the upper surface 229 of the can top and that defines cutouts or an opening for the openable section of the can top and, if applied after the can top is equipped with the tab 115, a cutout for the tab 115. That is, the groove cover material may be preconfigured in a shape that, when placed onto the can top, fills in the groove 230, but allows covering of can top surface areas of the upper surface of the can top other than those occupied by the flip top tab 115 and/or the openable section 224.

In one configuration, the groove cover material 300 can be applied during can top manufacture, but prior to applying the rivet and pull tab portion 115 to the can top. This configuration thus provides a thin protective coating over most areas of the can top and extends under the flip tab portion 115 as well.

It is also to be understood that the groove cover 300 may have an outer edge that terminates anywhere along the inside edge 227 of the rim 222 of the can, or below the actual rim. As shown in FIG. 4, the outer edge of the groove cover 300 extends close to the top of the inside edge of the rim 222 of the can top 220. In alternative embodiments, the groove cover 300 may not rise so high upwards along the inside edge 227 of the can top 220. For example, in one configuration, the groove cover 300 can terminate at a position located only partially up the side of the sloped inside edge 227 that rises upwards towards the rim 222 (thus not extending up as high as is shown in FIG. 4). In other example embodiments (such as that shown in FIG. 5 to be explained shortly), the groove cover 300 only extends to the lowermost part of the inside edge 227 of the rim 222 of the can top and thus forms a substantially flat upper groove cover surface 331. It is to be thus understood that the example in FIG. 4 is not intended to be limiting, and that the groove cover 300 is intended to fill-in the groove 230 and that the groove cover 300 may have an outside edge that terminates at any position in elevation along the inside edge 227 of the rim 222. Additionally, the upper surface 331 of the groove cover can be flat, or may be partially curved, or even deeply curved. That is, the curvature (or flatness) of the groove cover upper surface 331 is not limited to that shown in FIG. 4 or 5 and these are intended to be examples only.

FIG. 5 illustrates an alternative embodiment of the groove cover 300 that is disposed in the groove 230 to entirely fill-in the groove 230 to a depth that is at least substantially equivalent to the upper surface 229 of the can top. That is, the portion or inside edge 335 of the upper surface 229 of the can top that is closest to the groove cover 300 and the upper groove cover surface 331 are substantially in the same plane or elevation with each other (i.e. a top surface of the groove cover 300 is relatively flat). Note in some embodiments, the groove cover 300 may slightly or even substantially overlap the upper surface 229 of the can top, and in certain other embodiments, the upper groove cover surface 331 may terminate at or just below the edge 335 of the upper surface 229 of the can top 220. As noted above, the inside edge 227 of the rim 222 of the can top 220 includes the sloped surface that forms the approach to the grove 230 from the rim 222, and the groove cover upper surface 331 can terminate anywhere on this sloped surface, or above it, or just below it, to accomplish filling-in the groove 230 to avoid the collection of debris in the groove, and to provide a surface 331 on the can top that enables ease of wiping debris from the upper surface 229 of the can top, across the upper surface 331 of the groove cover, and up the inside edge 227 of the rim, to enable efficient cleaning of the can top when wiping, or when rinsing with water.

In the illustrated examples, the upper groove cover surface 331 is substantially smooth. The smoothness assists in not encouraging debris to stick or otherwise collect on the upper groove cover surface 331. Additionally, the smoothness of the surface 331 assists in allowing debris to be wiped or shaken from the can top more easily (as opposed to being pushed into the groove 230 when wiped on a conventional can that does not include any groove cover 300). A difference between the groove cover 300 in FIG. 5 and that shown in FIGS. 3 and 4 is that in FIG. 5, the groove cover 300 provides a substantially flat upper groove cover surface 331, whereas the groove cover 300 shown in FIGS. 3 and 4 is somewhat concave in shape to curve upwardly from the upper surface 229 of can top 220 towards the rim 222 of the can top 220 (i.e. terminates high up on the inside edge 227) to promote ease of movement of debris towards, and up, and then over the top of the rim 222 of the can top 220 during wiping, rinsing or shaking of the can top to clean the can top. The groove cover thus provides a more sanitary can top.

Additionally, when drinking directly from a can 200 equipped with a groove cover 300, the groove cover 300 can increase drinking comfort of an area of the can top 220 that the inside upper lip of a person touches. The groove cover also avoids excess liquid from collecting in the groove and then getting sticky and drying (or warming). With the groove cover 300 in place, very little or no liquid remains behind after taking a sip form the can 200 since a person's upper lips slide away easily over the groove cover as the can is pulled away from the person's mouth (after taking a sip form the can). This causes the inside upper lip to wipe away any excess liquid and the liquid is not allowed to remain in the groove (as opposed to conventional cans and can top designs in which a person's lip does not typically enter the groove to its lower most depths, thus resulting in liquid remaining at the bottom of the groove and becoming sticky or drying in the groove). In general then, by filling in the groove, a more sanitary drinking environment is provided.

It is to be understood that in these example embodiments the side or edge of the upper groove cover surface 331 that is closest to the inside edge 227 of the rim 222 of the can top may reside or terminate at any position or height on the inside edge 227 of the rim 222. Thus in FIG. 5, the upper groove cover surface 331 meets the inside edge 227 at a location that is substantially parallel or planar with the edge of the upper surface 229 of the can top 220 (to create a substantially flat upper groove cover surface 331), whereas in FIGS. 3 and 4, the upper groove cover surface 331 is curved upwards and meets the inside edge 227 at or near the top of the rim 222. In either configuration, due to the groove cover 300, the entire region defined inside the rim 222 of the can top is somewhat bowl-like and the presence of the groove cover 300 allows for substantially easier cleaning of the can top via wiping since dirt or debris are no longer able to be pushed into or trapped within the groove 230.

In some embodiments, the groove cover 300 is a fluid groove cover that can be poured, sprayed, squeezed, or otherwise disposed into the groove 230 via an appropriate liquid groove cover applicator device, nozzle, machine, or other suitable mechanism. Application of groove cover to cans in bulk can be performed by automated equipment specifically designed for this purpose. In a simple embodiment, a person can dispense the groove cover by hand (e.g. via a groove cover caulking gun or other applicator tool) onto the can top. Depending on the viscosity of the groove cover, or the application methods and mechanisms, the groove cover can be shaped to provide the curve as shown in FIGS. 3 and 4.

In one example embodiment, the fluid groove cover 300 maintains an initial fluid or liquid state that allows the groove cover to flow or pour into the groove 230 and conform to sides of the can top that define the groove to substantially fill-in the groove 230 (or at least a portion of the groove as will be explained in other embodiments). Once applied to the can top and into the groove in this manner, the fluid groove cover 300 changes from the initial fluid state to a substantially solid groove cover 300 that adheres, bonds or otherwise attaches itself to surfaces of the can top 220 that define the groove 230. For beverage cans that contain consumables, the substantially solid groove cover is non-toxic and provides a substantially smooth upper groove cover surface 331 that extends between the upper surface of the can top and an inside edge of the rim of the can top. The groove cover 300 remains in place prior to, during, and after opening of the can.

In an example embodiment, the fluid groove cover 300 is a liquid groove cover having a sufficient viscosity to flow into and fill-in the entire circumference of the groove 230 defined by the can top 220. In other examples, the liquid groove cover, prior to changing state into the substantially solid groove cover, has a surface tension in its liquid state that causes the liquid groove cover to slightly creep up the inner side 227 of the rim 222 of the can top, as well as onto the upper surface 229 of the can top to create a slightly concave curved upper groove cover surface 331 between the inner sides of the rim of the can top and the upper surface of the can top. This slightly concave curved upper groove cover surface 331 remains when the liquid groove cover changes state into the substantially solid groove cover and promotes ease of movement of debris towards and up and over the rim of the can top during wiping of the can top to clean the can top.

From the disclosure provided thus far, using hindsight, those skilled in the art of non-toxic food packaging will now understand that there are numerous materials that can be used as the groove cover. As an example, in various embodiments, the fluid groove cover may be a caulking material (e.g. FDA approved non-toxic food grade silicon), or a resin material (e.g. a quick setting/curing epoxy based resin), or a liquid metal material (e.g. a solder), a wax material, non-toxic sealer material, adhesive material or other fluid material that can harden from its liquid form once applied to provide a solid or substantially solid groove cover 300. In situations where the can 200 is used to package consumable beverages, the groove cover is a non-toxic FDA approved material. It is to be understood that these examples are not intended to be limiting.

Depending upon the embodiment, the fluid groove cover 300 can be any one of a number of different materials (or in some cases a combination thereof). Examples of the fluid groove cover 300 can include a resin material including a hardener that causes the fluid groove cover to change state to a solid groove cover; a liquid material that cures via a curing technique to change state to the solid groove cover; a liquid material that cures via drying process to change state to the solid groove cover; a material that is initially heated to form a liquid that is then poured into the groove and that thereafter cools via convention, or via a cooling technique (e.g. cool air) applied to the hot liquid; a liquid material that cures via heating to change state to the solid groove cover a cooling technique is applied to the liquid; a liquid material that cures via cooling to change state to the solid groove cover; or a liquid material that is applied into the groove and that hardens during rotation of the can. In embodiments that provide for a liquid that is poured into the groove, if the can is rotated during cooling, the liquid will tend to rise up the inside edge of the rim during rotation while hardening. The resultant groove cover profile can be that, for example, of FIG. 4.

One example of a material used for the groove cover 300 may be an FDA approved food-grade silicone caulk (that meets 21 CFR 177-2600). Other examples can include a Bisphenol A (BPA) based epoxy resin. Another example of material suitable for the groove cover 300 may be a non-toxic paint or putty having none or a low level of solvents and volatile organic compounds (VOCs), or a non-toxic sealer or quick setting adhesive. Other examples of the groove cover can include Food and Drug Administration (FDA) compliant adhesives used for food packaging such as FDA approved hot-melt quick setting glues, resins, plastics, adhesives and/or caulks. The groove cover material can offer low shrinkage and high bonding ability to metal and provide for creation of a smooth groove cover surface once dry. It is to be understood that these examples are not intended to be limiting.

In embodiments where the groove cover is of a liquid of somewhat high viscosity, such as groove cover that is a non-toxic epoxy or FDA approved quick setting silicone caulk material, the higher viscosity allows the groove cover to be shaped upon application (with an appropriately shaped applicator nozzle) to conform to a desired curvature between the edge of the upper surface of the can to the inside edge of the rim of the can top. The groove cover can thus maintain this shape while drying, curing or otherwise hardening.

Application of the groove cover can include a wiping operation that wipes excess groove cover away and/or that provides a desired smoothness and shape (e.g. curved or flat) to the upper groove cover surface 331. The groove cover can also be color coordinated with the color of a label of the can for a nice visual appearance. It is noted that any color can be used for the groove cover material and that color can serve as a distinguishing marketing aspect of a can configured with a colored (or tinted) groove cover. Due to high speed bottling operations, a very quick setting groove cover material such as a fast hardening expoy resin can be used. The time required to set can be adjusted to be minimal by using heating/cooling, radiation, chemical treatments (e.g. hardeners) or other curing techniques know in the art of plastics and/or resin technologies to provide a suitable groove cover that adheres and cures quickly.

In the groove ring embodiments where the groove ring is pre-shaped prior to application to the can top to conform to the contours of the inside edge of rim of can top, very little curing or adhesive drying time is required, if any, since the groove ring can be adhered with a minimal amount of adhesive that can bond very quickly to the metal can and/or can top surface. The groove ring can be made of, for example, non-toxic plastic, rubber, silicon, urethane, metal, wax, polymer, food grade polyethylene, or other suitable non-toxic material. The groove material may be elastomeric and may be a dense foam or sponge material. It is to be understood that this list is not exhaustive, and that some materials listed herein may be preferable over others due to various material properties such as adherability to the can top, non-toxicity, cost, formability, cure/set time, and other factors. It is to be understood that the groove ring itself, prior to adhering or affixing to a can top is to be considered an embodiment disclosed herein.

It is to be understood that the groove ring affixed to a can top alone, prior to the can top being secured and seamed to a can housing is also an embodiment disclosed herein. Thus a can top that has not yet been seamed to the can housing, but that includes mechanisms or alterations that differ from conventional can top designs to accommodate a groove cover (several examples are shown in the figures, such as the top that includes recesses in one or both sidewalls of the groove) are considered separate embodiments.

In one configuration, since it is very important to have a high speed canning operation, a can top preconfigured with the groove cover already in place is considered an embodiment disclosed herein. In such configurations, the groove cover is adhered or otherwise secured into the groove of the can top in a manner that does not interfere with the canning operation of placing the can top or lid onto the can housing. In particular, examples of such groove cover configurations include, for example, that shown in FIG. 5. The groove cover in FIG. 5 is configured to fill-in the groove but does not rise up or reside on upper areas of the inside edge of the rim of the can, thus it does not interfere with applying the can top or lid to the can housing during the canning operation. Machines that perform the canning operation provide a chuck or can top holder device that fits into the top of the can top or lid and provides a surface that presses against the inside edge of the rim or the can while rollers on the outside edge of the can top roll the ran top and can housing collectively into a seam. In certain configurations of such canning equipment, the chuck or other device that resides within and presses against the inside edge of the rim of the can top does not need to enter the groove region of the can top. Thus, the groove cover does not interfere with canning operations and can be placed or affixed to the can top during can top manufacturing, prior to seaming the can top to the can housing.

In example embodiments, to inhibit or resist the growth microbes such as bacteria, mold, germs or the like, the groove cover 300 may contain (e.g. is embedded with, or is coated with) an antimicrobial such as, for example, Lysozyme or nisin to inhibit growth of microbials, fungi and/or bacteria that come into contact with the groove cover 300. It is to be understood that these examples are not intended to be limiting. In this configuration, a heath conscious consumer feels more comfortable in understanding that not only does the groove cover keep the can top cleaner (e.g. assists in the process of cleaning when wiping the can top), but the groove cover further resists bacterial and germ growth and related types of contamination to provide an even cleaner upper groove cover surface 331 over which the liquid flows when being dispensed from the can during drinking or pouring of the liquid into a container.

In another example embodiment, the groove cover material, whether it be a liquid, fluid or solid material, can be impregnated with one or more substances, such as esters, to add a taste, flavor or smell. In such configurations, when a person, for example, drinks directly from the can, as their lips con into contact with the can top and groove cover affixed thereto, the flavor, taste or smell of the groove cover can be perceived by the person. In still other embodiments, the groove cover material can be a biodegradable solid, or substantially solid (i.e. having some flex an pliability) material that is biodegradable (e.g. a biodegradable plastic or bioplastic such as that used in plastic straws). For example, bioplastics, also known as organic plastics, formed from renewable biomass sources such as vegetable oil, corn starch, pea starch or microbiota can be used to form a bioplastic groove ring configured as disclosed herein. These elements can add an interesting aspect to the groove cover for marketing purposes since not only does the presence of the groove cover make the can drinking experience more sanitary but also environmentally friendly.

As noted above, in one embodiment, the fluid groove cover 300 may be a liquid material that is applied into the groove and that is hardened thereafter. The liquid may be, for example, a food-grade non-toxic silicon or resin material.

During or just after application of the fluid groove cover into the groove of the can top (while the groove cover is still in a liquid state), the can 200 can be maintained in a rotating state while the liquid cures to bond to the can top and to form the shape of the groove cover. Due to centripetal forces and with proper control over a speed of rotation, the liquid groove cover 300 will naturally swell up or rise slightly up the inside edge 227 of the inside of the rim of the can (but will also remain in the groove with proper control of volume of liquid groove cover applied). Careful adjustment and control of the amount or volume of grove cover applied, temperature, curing techniques, and other factors allows creation of a groove cover 300 that completely fills in the groove 230 of the can top and that also provides enough groove cover material to rise up the inside edge 227 of the rim of the can top and provide a smooth curved surface. When the grove cover 300 hardens in this state, it will provide the substantially curved upper groove cover surface such as that shown in FIGS. 3 and 4.

Figure 6A:
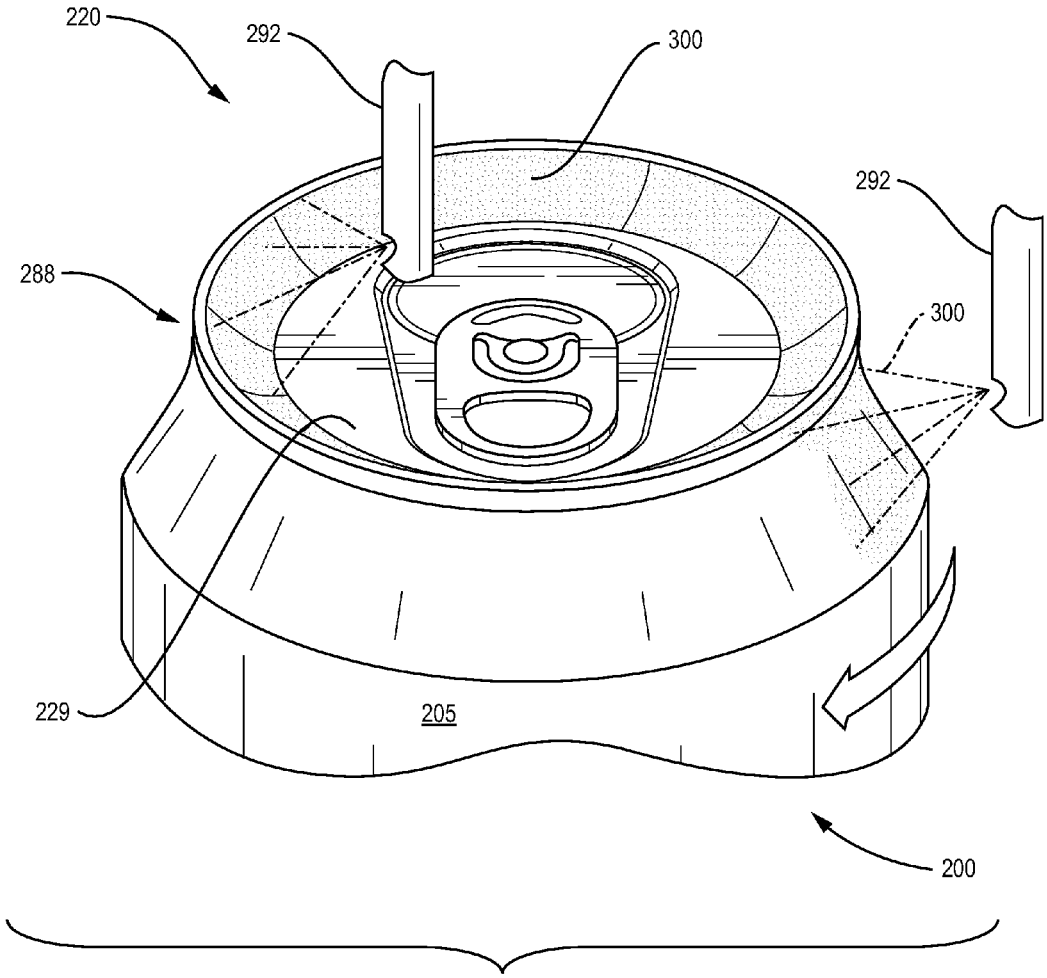
FIG. 6A illustrates an example application of groove cover material using at least one spray nozzle to spray the groove cover into the groove, and, depending on the embodiment, onto other areas of the can and/or can top.

FIG. 6A illustrates an example embodiment in which the fluid groove cover 300 has a sufficient viscosity to be sprayed onto the can top 220. One or more spray nozzles 292 supply enough spray to allow the sprayed on liquid groove cover to flow into and fill-in the entire circumference of the groove defined by the can top. When the groove cover is applied via spraying, careful choice of a spray nozzle, pressure, temperature and volume can direct a suitable amount of liquid groove cover into the groove and the surrounding areas (e.g. up the inside edge 227 of the rim 222).

In one embodiment, the groove cover 300 in its liquid state can be sprayed over the entire upper surface of the can top 220. In such a configuration, enough sprayed-on groove cover 300 is applied to allow runoff of excess groove cover on the upper surface 229 of the can top 220 to flow into and fill-in the groove 230. If the liquid sprayed on groove cover is of appropriate volume, viscosity and/or temperature, the groove cover 300 can still fill the groove and even though it may slightly contact and overlap the openable section and tab, but not enough to interfere with or hinder opening of the can. Since the upper surface 229 of the can top 220 is slightly arced upwards (has a gentle curved shape), when the can is in an upright position, as the spray nozzle(s) 229 apply the spray on groove cover 300, the groove cover can runoff and flow into the groove, as opposed to remaining as a thick layer on the upper surface 229 of the can top 220.

Spraying the can top 220 with the groove cover can further provide a benefit of coating larger regions of the upper surface of the can top with groove cover material that will provide a smoother upper surface for the can top than the original aluminum or steel surface. This embodiment provides an added benefit since when wiping, the smoother surface allows better wiping action and results in a cleaner can surface (as compared to wiping a bare metal surface that has a slight grain or texture that can trap or otherwise be more susceptible to collection of dirt, grime or other debris).

Figure 6B:
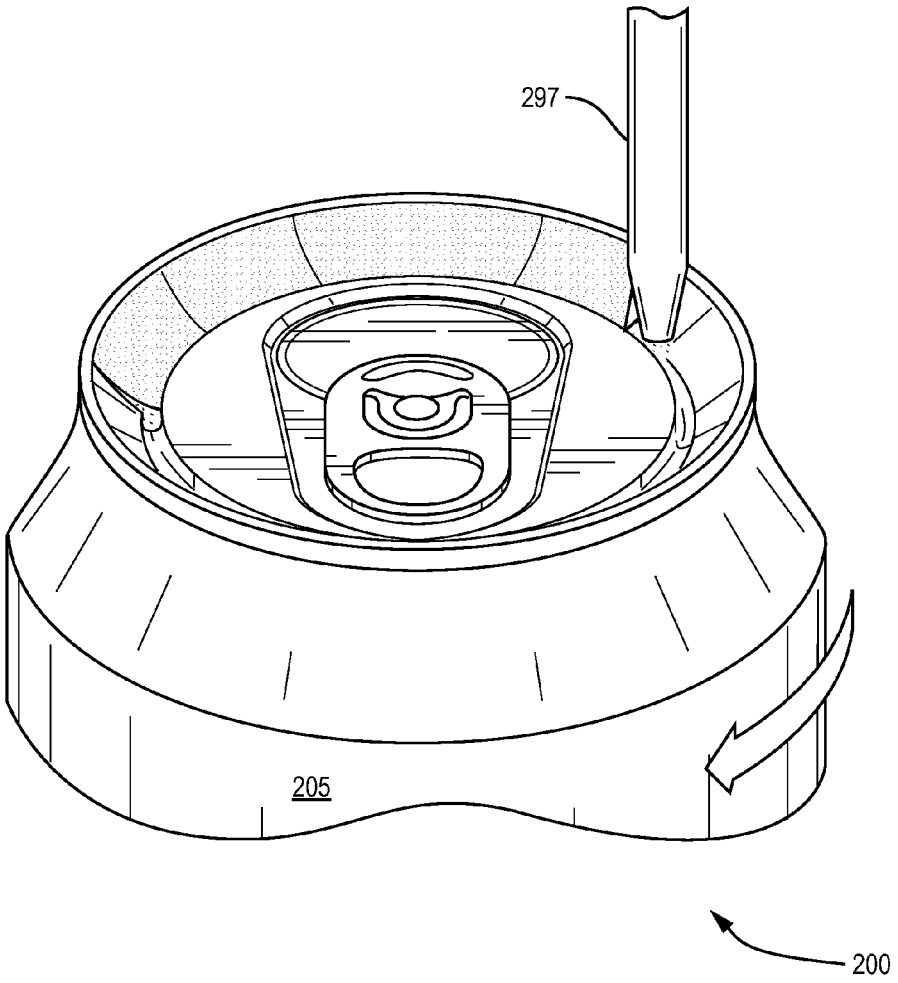
FIG. 6B illustrates an example application of groove cover using a nozzle that includes a supply tube and wiper shield to form a profile of a desired shape of the upper surface of the groove cover as it is applied onto the can top.

FIG. 6B illustrates an embodiment in which the groove cover 300 is disposed into the groove 300 of the can top 220 via a groove cover nozzle 313 that supplies the groove cover material as a thick liquid or in a caulk-like consistency. In this example, the groove cover nozzle 313 includes a supply tube 314 for supplying groove cover material 300 and a wiper shield 315 that presses, folds or forces the groove cover material into the groove, and that also properly shapes and/or forms the upper groove cover surface 331 in a profile that conforms to the shape of the groove cover as may be desired. During this groove cover installation process, the groove cover nozzle 313 is positioned above the groove 230 at a starting location, and is controlled to begin to dispense groove cover material from the supply tube 314 at a certain volume over time. As the groove cover material comes out of the supply tube 314 and is placed into the groove 230, the nozzle 313 continuously moves around the circumference of the groove. The nozzle 313 can be operated to always be positioned so that the wiper shield 315 is downstream in groove with respect to the supply tube 314 that is supplying the groove cover. As such, as the supply tube 314 move about the circumference of the groove and provides the groove cover material that flows into the groove 230, the wiper shield 315 follows behind and shapes and forms the desired profile of the upper groove cover surface 331. When the nozzle 313 has completed a full circular path around the groove while applying the groove cover in this manner and returns to its starting position, the supply tube 314 can cease supplying groove cover material and the nozzle can continue to move just past the starting point as it pulls away form the can top to create a seamless upper groove cover surface 331.

Figure 7:
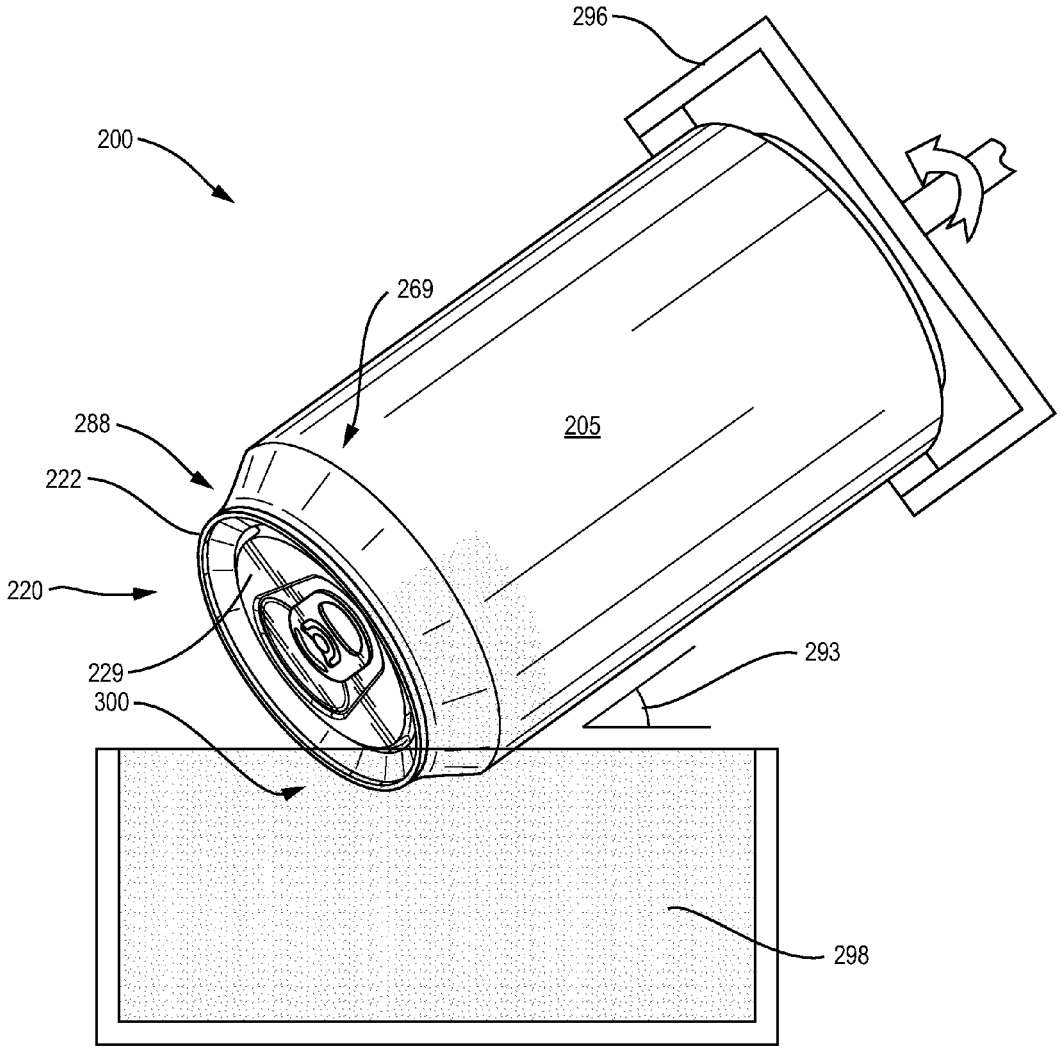
FIG. 7 illustrates an example application of groove cover material to the top and side of a can by dipping the can into a reservoir of groove cover material.

FIG. 7 illustrates an embodiment in which a liquid groove cover 300 is applied to both the body 205 and can top 220 via dipping the can 200 and can top 220 into a reservoir 298 of liquid groove cover material 300. In this particular example, the can 200 is held on an angle 293 and is rotated state by a can holder 296 (a machine capable of handling cans). In this manner, an area of the can top 220 that includes the rim 222, groove area and a slight portion of the upper surface 229 of the can top 220 are all coated with the groove cover material 300 (e.g. a non-toxic paint or epoxy resin or other suitable non-toxic material). Additionally, by careful selection of the angle 293 at which the can 200 is dipped into the reservoir 298 and via control over the depth of dipping, the groove cover material 300 can be applied onto the body 205 as it rotates.

In the configuration shown in FIG. 7, the groove cover 300 is a liquid material that is applied while dipping the can on an angle to allow the fluid groove cover to coat the sides of the rim of the can and a portion of the body. When the can is returned to an upright position, the liquid groove cover material on the inside edge of the rim of the can flows down and settles into the groove to at least partially fill the groove. Any groove cover material that may run down the side of the can is wiped off during the drying process to provide a clean lower edge 269 of the groove cover material on the body 205. Alternatively, the lower edge 269 of the groove cover material can be scored and the unwanted portion removed or peeled away.

It is noted that while FIG. 7 shows the can rotating to coat and fill-in an entire circumference or perimeter of the can and the groove and rim of the can top, in other configurations the can is dipped with the openable section oriented properly to allow the groove cover material 300 in the reservoir 298 to coat and fill the groove in the vicinity of the openable section (i.e., where a person's mouth may contact the body, rim area, and can top). In such an embodiment, the groove cover fills-in only a portion of the groove.

In embodiments disclosed herein that provide for a spray-on groove cover material, or a groove cover material that is applied via dipping the can, or where the groove cover is a painted on material, the groove cover can be provided in related embodiments as a contiguous groove cover material that is adhered to and extends up an inside edge of the rim of the can and over the top of the rim of the can and down an outside edge of the rim of the can. In such a configuration, the groove cover material 300 extends over and covers a rim groove 288 defined at an intersection of the outside lower edge of the rim of the can top 220 and the top portion of the body. In conventional cans, the rim groove is highly susceptible to contamination with dirt, grime and debris since the can is often handled with contact being made at the rim groove (e.g. hand contact). Accordingly, in this example embodiment, the groove cover material extends up and over the rim of the can and down the outside edge of the rim and onto the body to coat and cover/fill-in the rim groove. Depending on the configuration, the groove cover material can extend to different lengths down the sidewall of the can housing or body.

In one configuration, the groove cover material has a lower edge 277 that is adhered to and terminates on the body 205 at a position below a region in which a person's mouth contacts a can if drinking directly from the can. By coating the rim and upper outer surface of the body, the rim groove transition between the can top and body is largely eliminated or softened thus reducing debris collection to a minimum (as compared to having no coating in that area at all).

As illustrated in FIG. 7, the metallic beverage can 200 can include contiguous groove cover material on the body 205 that covers (and adheres to the can at) a mouth contact region of the body at which a person places his or her mouth when drinking from the metallic beverage can. In embodiments where the groove cover material 300 covers the body in this manner and in which the groove cover includes (i.e. is embedded with) a non-toxic antimicrobial, the health conscious consumer is placed more at ease in understanding that the groove cover material is resistant to growth of microbials where he or she will be placing their lower lip when drinking from the can. Note that such embodiments can include a label or designation that the area of mouth contact is a "germ free zone" to provide a visual indication of the antimicrobial region. In other configurations, the grove cover can contain a flavoring to provide a subtle taste to a person drinking from the can, or the groove ring can contain a scent to provide a smell or odor in the region of the can top that can be detectable by a person drinking from the can. The flavor or scent can be such that it is activated when wet (via the liquid from the can contacting the groove ring, or when a person puts his or her mouth on the can to drink from the can). In other configurations, the groove cover is embedded with a temperature sensitive compound that changes color based on temperature to indicate if the beverage can is cold or not. In this manner, the groove cover or groove ring can be used to indicate, visually, if the can is hot or cold. This lets a person selecting the can for consumption know via viewing the groove cover material if the can has been properly chilled and is "ready" for drinking as many drinks are preferably chilled before consumption.

Figure 8:
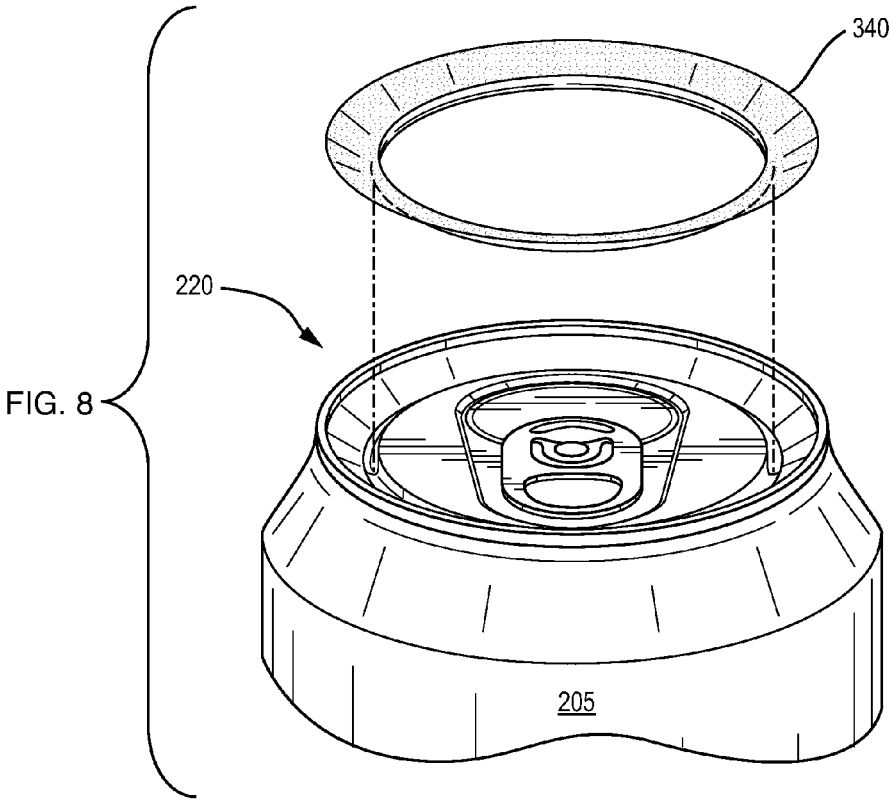
FIG. 8 illustrates an example application of a groove cover configured as a groove ring that is applied to a beverage can top.

FIG. 8 illustrates an example embodiment in which the groove cover 300 is configured as a groove ring 340 having a diameter proportionate to a diameter of a center of a circle formed by the groove 230 defined by the can top 220. In other words, the groove ring is sized to conform to the size of the groove. In these configurations, the circular groove ring 340 is disposed into or on the groove 230 to fill in at least a portion of the groove 230 defined by the can top 220. In one embodiment, the groove ring 340 is a material that is press fit into the groove 230 to fill-in the groove. Examples of such material include FDA approved food-grade silicone, rubber, or foam. Such material can be compressible to be press fit into the groove to fill-in the groove.

In one configuration of the press fit groove ring, the groove ring is press fit or snap fit into the groove and includes at least one that interfaces with a sidewall of the groove deinfed in the can top to maintain the groove ring affixed to the can top before, during and after opening of the can top. In particular, the sidewalls of the groove can include one or more impressions or indentations and the groove ring can include at least one appendage that mates with and fits into such impressions. The impressions may be spaced around a sidewall (such as the inner sidewall) that defines the groove, or the impression may be a continuous impression that extends around the entire sidewall of the groove. When the groove ring is brought into contact with the can top and aligned with (i.e. placed over) the groove, the groove ring can be pressed or snapped into the groove. The groove ring and its associated appendage(s) in such configurations has/have slight flexibility and can momentarily deform to allow the appendage(s) to deform and deflect while being pressed into the groove. Alternatively, the groove ring can have a split in it that allows temporary expansion of the groove ring when being pressed into the groove in order to expand slightly in diameter to clear the outer peripheral edge of the upper can surface (upon which the opening or openable section of the can is defined). In this manner, the groove filer (a groove ring) can expand and be press fit into the groove. The appendage(s) can be tabs that snap, slide or move into place into the impressions or indentations to hold the groove ring in place. If the groove ring is made of a rubberized compound, such as silicone, the groove ring can be pressed in place and the elasticity of the material allows the groove ring to deform briefly to enter the groove and the appendages or outcroppings can then expand again to enter the impression (s) in the sidewall(s) of the groove. Further details of groove ring embodiments and embodiments that provide can tops (i.e. lids) that are configured to receive a groove ring groove cover will be explained later.

Embodiments that provide a groove ring with a mechanical fastening means (e.g. groove cover appendage) allow for quick installment of the groove ring and prevents removal of the ring once inserted. Since no adhesive is required, no drying or curing time is needed. In such configurations, the groove ring may be preformed and made, for example, of a non-toxic food grade plastic (e.g. PTE) and the groove ring may be snap fit onto the can top. Such application of the groove ring may take place after canning is complete, or, depending upon the configuration of the canning machinery that secures the can top to the can body, the groove ring may be applied to the can top prior to the can top being secured and sealed to the can body (e.g. during or just after can top formation). Thus, various embodiment include the groove ring itself, as well as a can top with a groove ring attached, as well as a can body with attached can top and groove ring. Embodiments also include the methods of applying the groove ring to the can sealed with a can top, applying the groove ring to a can top alone, and forming a can top to include a grove ring, and forming the groove ring alone. In such embodiments, the terms "groove ring" and "groove cover" are used interchangeably. Each of these configurations is understood to be an embodiment disclosed herein.

It is to be understood that while the groove ring in FIG. 8 is a full circle, other embodiments allow for a groove ring that is only a partial circle or arc to be placed in only a portion of the groove defined by the can top. In particular, if the groove ring is not a full circle, it is preferable that the partial circle groove ring is positioned an a section of the groove that is closest to the openable section defined in the can top.

Figure 9:
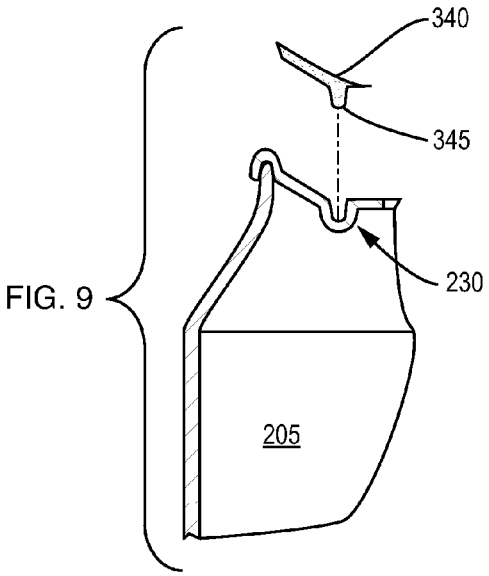
FIG. 9 illustrates an example cross sectional or profile of one side of a can top in which a groove ring is preformed to conform to a shape of the groove.

FIG. 9 illustrates another configuration that shows a cross sectional profile of one side of a can top in which the groove ring 340 conforms to a shape of the groove 230 defined by the surface of the can top (e.g. has a cross sectional profile that is shaped opposite of the shape of the side of the can top 200 that defines the shape of the groove 230 and inside edge 227 of the rim 222). The shape and cross sectional profile of the groove ring can be sized to be the same size as the groove, or if the groove ring material is flexible (e.g. silicone), the groove ring can be sized a slight bit larger that the groove dimensions and can be press fit into the groove. In a press fit configuration, the groove ring 340 can remain in the groove due to the side wall pressure and close tolerances of the fit between the groove ring 340 and the groove 230.

In other configurations, an adhesive 345 (e.g. an adhesive that is non-toxic and FDA approved when dry) may be applied to the underside of the groove ring to bond the grove ring 340 into the groove 230 and to create a tight seal between the groove ring 340 and the surface of the can top 220. After application of the adhesive, a groove ring applicator can perform a wiping operation to smooth any excess adhesive that may have oozed out from in between the groove ring 340 and the surface of the can top 230.

Figure 10:
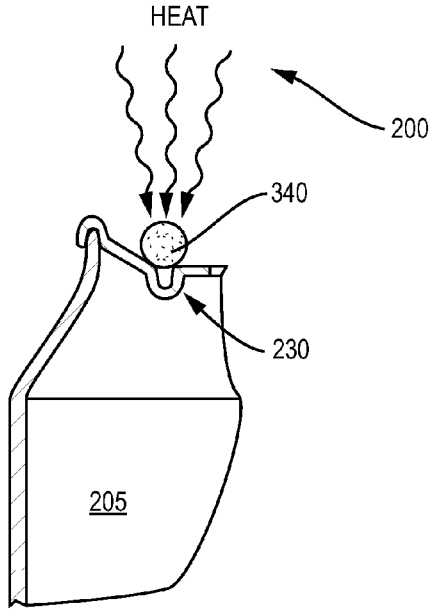
FIG. 10 illustrates an example cross sectional view of one side of a can top in which a groove ring is positioned over the groove and can be press fit into the groove, or can be melted, or otherwise treated to form a liquid that flows into the groove to fill-in the groove defined in a beverage can top.

The groove ring 340 may be solid, or substantially solid, or somewhat flexible and when placed into the groove, may flex slightly to conform to very minor irregularities of the groove 230. Examples include a silicone rubber groove ring, a plastic groove ring, a wax ring, a Styrofoam or dense foam ring, or a metal groove ring. It is understood that these examples are not intended to be limiting. Use of a groove ring can speed up the canning process since there is no time required to allow the groove ring to dry or become stable (as opposed, for example, to a liquid groove cover that must cure, be hardened, dry, etc.). Since modern canning/bottling processes are high speed, it is important to provide application of the groove cover (whether it be a liquid, or a groove ring) in a manner to does not slow down the bottling/packaging line FIG. 10 illustrates another configuration that shows a cross sectional profile of one side of a can top in which the groove ring 340 is a circular ring of material (e.g. donut shaped) that, when heated or otherwise treated (e.g. via a chemical process), melts or otherwise transforms to temporarily form a liquid that flows into the groove 230 and conforms to the shape of the groove and thereafter hardens into a substantially solid form. After melting, the liquid flows into the groove and adheres to the surface of the can top during hardening to define an upper groove cover surface that extends from the upper surface of the can top to the inside edge of the rim of the can top to fill in the groove (such as the groove cover 300 shown in FIG. 5).

As an example, in FIG. 10 the groove ring 340 may be a circular plastic, wax, hot melt glue ring, solder ring or other meltable ring of material that can be placed onto the groove after the can top 220 has been sealed or placed onto the can 200 during the canning/bottling process. The can 200 can then move through a heating or treatment area that causes the groove ring 340 to briefly liquefy and flow into the groove 230 thus filling the groove. Upon cooling or curing, the grove ring 340 solidifies to become a solid groove cover 300 and bonds to the surface of the can top 220. As noted above, when the grove cover is in a liquid state, the can top 220 may be rotated during cooling/curing to provide the curved effect to the upper groove cover surface 331 as shown in FIGS. 3 and 4.

Figure 11:
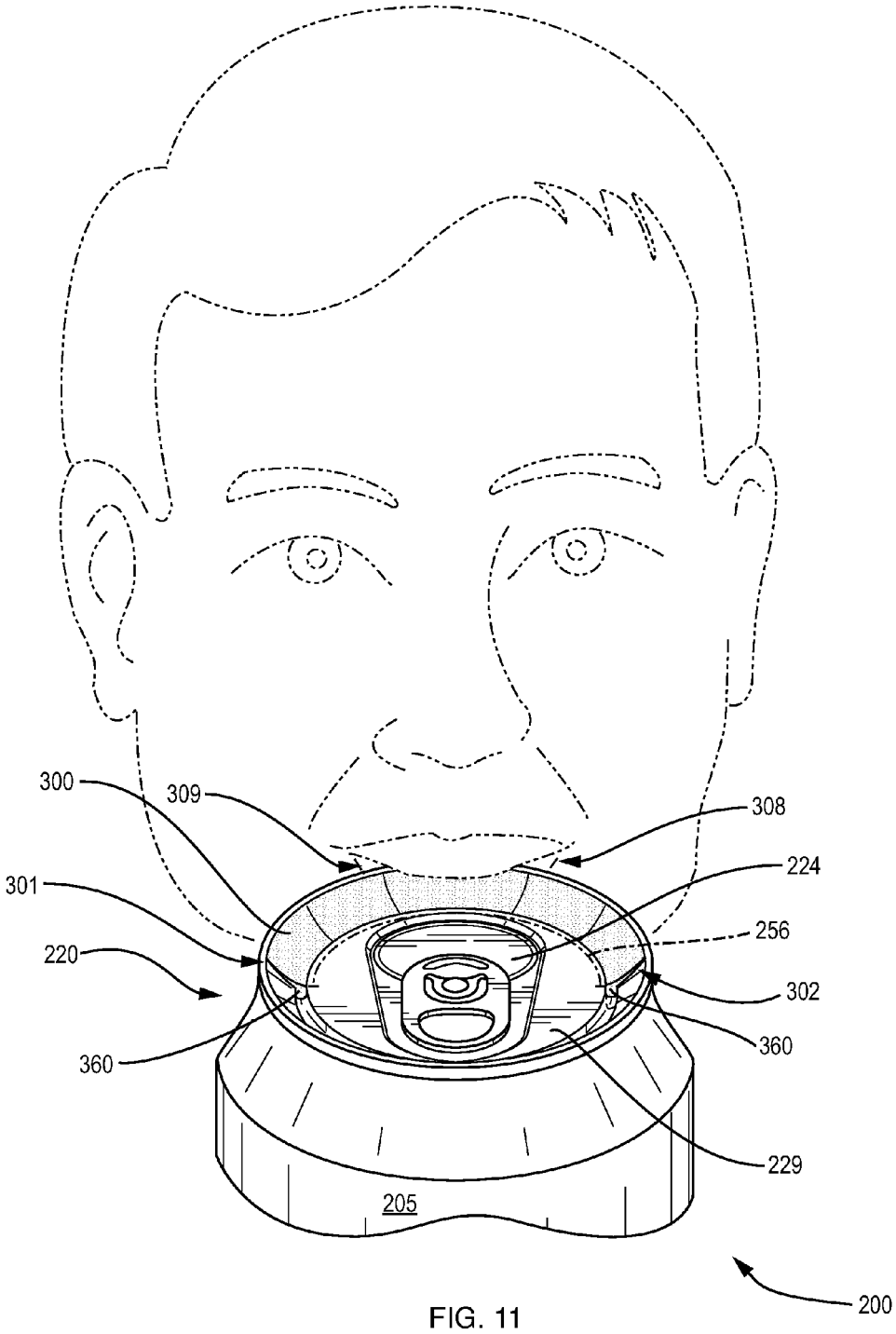
FIG. 11 illustrates an example embodiment in which the groove cover fills-in less that the entire groove in a can top.

FIG. 11 illustrates an example embodiment in which the groove cover does not extend all the way around the groove 230 defined in the can top 220. In such embodiments, the groove cover 300 is disposed in the only a portion of the groove and fills the groove in that portion to a depth that is at least substantially equivalent to the top surface 229 of the can top. It is noted that if groove cover is applied to a can top and does not substantially fill-in the groove, but only partially fill-in a depth of the groove, the presence of even some groove cover in the groove can be beneficial since the depth and width of the groove will both be made smaller, thereby reducing an amount of debris that can be trapped in the partially filled groove. In other words, even if the grove is not filled in fully, the can top with groove cover will be less resistant to the collection of debris and therefore can be considered "cleaner".

In FIG. 11, the groove cover 300 has a first end 301 and a second end 302 and has a groove cover length 256 that fills-in the groove and extends for a distance less than an entire length or circumference of the groove 230 defined around the can top 220. For portions of the groove filled by the groove cover, such as the area of the groove adjacent to the openable section 224 in the upper surface 229 of the can top 220 (the region of the groove extending for the length 256 such as that shown in FIG. 11), the groove cover 300 prevents debris from collecting in that area. Additionally, when the upper surface of the can top 220 is wiped prior to opening the can, the groove cover 300 located near the openable section 224 provides a smooth surface that enhances the wiping action's ability to clean the can. Since the groove cover is adjacent the to the openable section, when liquid flows from the can after opening, debris is not picked up and turbulence of the liquid is reduced in the example embodiment. This can enhance taste of the liquid from the can and provide for a better drinking experience.

Figure 12:
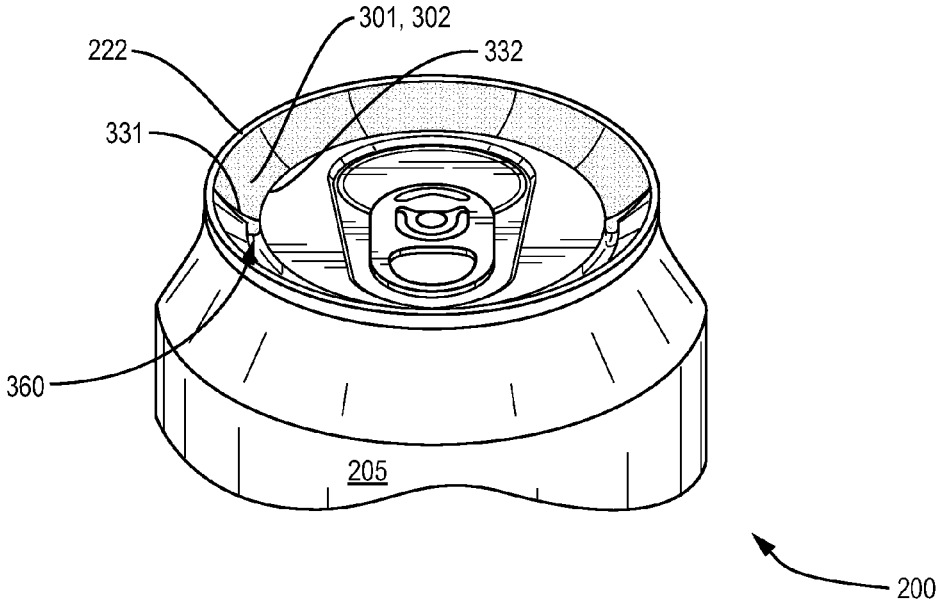
FIG. 12 illustrates an example embodiment in which ends of the groove cover define debris traps that can trap loose debris within the groove that may slide or move within the groove when the can is tilted to dispense liquid contents of the can.

FIG. 12 illustrates an embodiment in which at least one of the first end 301 and the second end 302 of the groove cover 300 define a debris pocket or trap 360 to trap debris that slides within portions of the groove 230 that do not contain the groove cover 300 during tilting of the metallic beverage can 200 to pour a liquid contents of the can from the openable section 224 in the upper surface 229 of the can top 220. The debris pocket or trap 360 is formed by having the upper groove cover surface 331 extend slightly further in distance around the groove 230 than a lower surface 332 of the groove cover 300. That is, the upper groove cover surface 331 overhangs the groove and forms a trap underneath the upper surface 331 that can collect debris.

This configuration of a debris trap or pocket is formed if, for example, the groove cover is a material of caulk-like consistency (e.g. somewhat thick and gooey) and a groove cover applicator machine or device, such as a caulking nozzle, continues to move around the groove even after ceasing to supply and apply the caulking into the groove. In such cases, the lower side 332 of the groove cover sticks closely to the sides of the can top that define the groove, while the upper groove cover surface 331 (that is not contacting as much surface area of the groove on the can top) stretches slightly longer and follows the still moving caulking nozzle. This creates the debris trap 360. In this manner, the upper groove cover surface is formed to protrude as a slight overhang over a small unfilled section of the groove at each end of the groove cover 300, thus forming debris pockets or traps at each end 301 and 302. Once the groove cover has hardened and is bonded to the can top 220, if the can top is wiped for cleaning and any debris (e.g. sand, dirt, dust, etc.) is pushed into the parts of the groove that are not filled by the groove cover 300, if such debris slides within the grove 230 towards the openable section 224, for example during pouring, the debris gets trapped by the debris pocket trap 360. This results is a more sanitary pouring/drinking experience since less debris is likely to leave the groove 230 and come into contact with the liquid being poured from the can 200.

In another configuration, if the groove cover is a preformed groove ring (as shown in FIG. 8, such as a plastic groove ring) but that does not fully extend all the way around the groove, the debris trap can be preformed into the groove ring by having the upper preformed edge of the grove ring extend further around the groove that the lower preformed edge of the groove ring. When the groove ring is pressed or glued or otherwise adhered into the portion of the groove 230 and is aligned so that the center part of the groove ring (the part equal distance from either end) is aligned substantially with the openable section of the can top, the debris traps on either end become operable to trap debris such as loose sand, dust, dirt, etc. that may move or slide within the groove towards the direction of the can tilting when liquid is poured from the can.

In one embodiment, a portion of the groove cover 300 located closest to the openable section 224 of the can top is substantially a center region along the groove cover length. The first end 301 and second end 302 of the groove cover 300 extend a substantially equal distance away from the center region to respective locations 301, 302 within the groove 230 defined by the can top, the respective location being beyond mouth contact regions 308, 309 on the can top 220 when a person drinks directly from the metallic beverage can 200.

Other embodiments provide a can top 220 alone (without a body) configured as explained above in FIGS. 3 through 9 (i.e. such embodiments do not include the can 200). The can top 220 is shaped to define a rim and an upper surface that includes an openable section of the can top. As explained above, the can top shape further defines a groove 230 between an inside edge of the rim of the can top and the upper surface of the can top. In embodiments of the can top alone, a groove cover 300 may be included and disposed in the groove to fill-in the groove in at least a portion of the groove that is located adjacent to the openable section of the can top prior to sealing of the can top onto a body. That is, this example embodiment covers a can top in which the groove cover is pre-applied into the groove defined in the can top. In such embodiments, the pre-disposed groove cover can be of a configuration that does not interfere with the canning operation (i.e. The groove cover can be applied into the grove and canning machinery can still crimp opposing side of the rim of the can top to form the rim that is sealed to the body. Thus, a can top sold by can top manufactures may provide can tops that contain a groove cover already installed. As explained above, the groove cover prevents collection of debris in the at least a portion of the groove in which the groove cover is disposed and assists in removal of debris during wiping of the can top.

Figure 13:
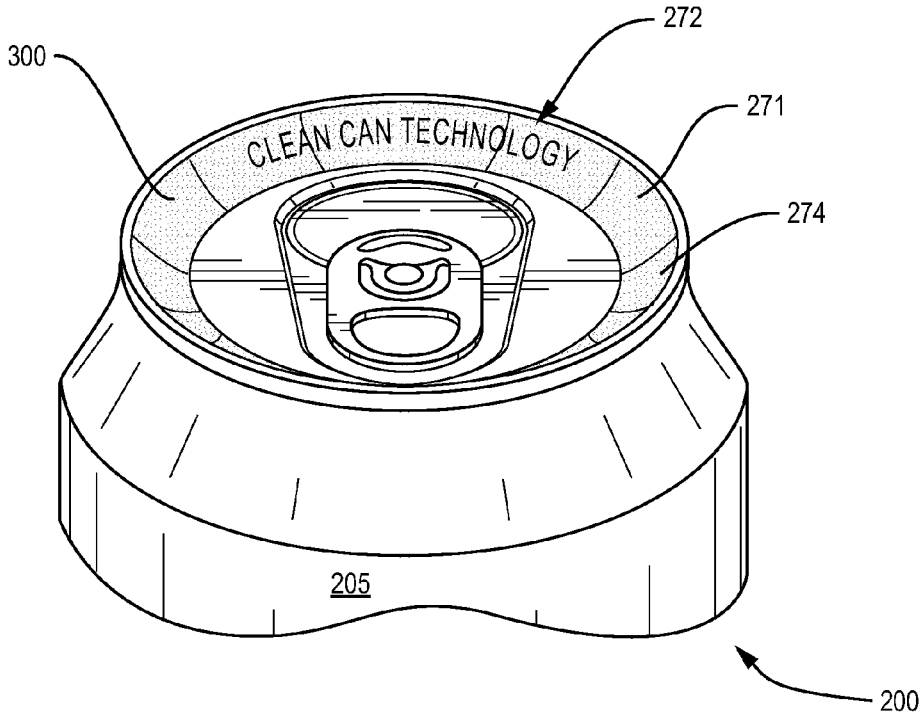
FIG. 13 illustrates various examples embodiments in which the groove cover is colored, tinted, translucent or transparent, or embedded with a printed message or visually interesting materials (e.g. sparkles, metallic flakes, colored beads, etc.).

FIG. 13 illustrates additional example variations on the embodiments noted above. Such variations include providing a color agent or tint 271 embedded in the groove cover 300 to allow the groove cover to be color coordinated with a color of the can 200 (e.g. with labeling placed on the can). Alternatively, the groove cover 300 may be a transparent or semi transparent material that can be tinted with a given color 271 or that may be clear, or the grove cover 300 may be include a substance that glows in the dark or radiates to provide a visually appealing radiant effect to the can top in dim or dark lighting conditions. The groove cover may also be embedded with visually interesting particles or materials such as reflective sparkles, metallic flakes, colored beads or other small objects. Such features can be useful within with the groove cover for product marketing purposes and to distinguish the can top from competing products.

Other example embodiments such as shown in FIG. 13 provide for insertion of a message 272 in the groove cover using characters, text, symbols or other information to be embedded within, or placed or printed within or under the transparent or semi-transparent groove cover. As an example, any phrase such as "CLEAN CAN TECHNOLOGY" or "PATENT PENDING" or "HAVE A NICE DAY" can be printed on a transparent non-toxic medium such as a plastic or cellophane strip and then this strip can be placed into or under the groove cover (e.g. just before or during application of the groove cover to the can top 300), or placed, stuck or printed on the inside edge of the rim of the can top 220. Once the printed message or other item is in place within the grove 230 (or on the inside wall of the rim), the item is thereafter covered and sealed in place by the transparent or color tinted groove cover allowing the message to be visible underneath and through the groove cover. In one configuration, the message may continue around the circumference of the inside edge of the rim. The message is visible to viewers of the can top and provides a mechanism to inform consumers of the clean can, or for use in marketing purposes. In other examples, the groove cover may be a preformed groove ring and the message may be built into this ring. In this case, the ring can simple be installed into the groove as explained herein and the printed message, design and/or figure/picture can be visible to the consumer on, in or under the groove ring.

In other embodiments, the printed message can be applied to the inside sidewall of the rim and/or the sidewall(s) of the groove of the can top, and the groove ring can be transparent and can be installed over this printed image. This allows the message or words to be visible through the groove ring. If the groove ring is transparent and has a profile or cross section shape that magnifies an image (e.g. an upper groove cover surface have a bulging or rounded upper groove cover surface profile such as that shown in FIG. 16D), this allows the printed message, image or other insignia (e.g. logo of manufacturer of contents of can) to be magnified by the groove ring of transparent material that resides over the printed message. In such a configuration, the groove ring 300 magnifies the text, image or other insignia 272 (FIG. 13) that resides underneath or behind the groove ring (i.e. resides on the surface of the outside groove sidewall) and provides the appearance to a person viewing the image or text or message that it is larger in size that the actual print used. Thus, a message 272 under a groove ring 300 such as that shown in FIG. 16D can be magnified to provide a visually appealing can top 220. In such configurations, the groove cover is a non-toxic material that has a cross section profile that provides magnification of an image within or under the groove cover.

Other example embodiments include mixing visually appealing substances 274 with the groove cover prior to application of the groove cover 300 into the groove 230. Examples of such substances 274 including sparkles (non-toxic metallic or plastic particles) mixed into the groove cover prior to application of the groove cover to provide an interesting visual appearance within the groove cover.

Referring now briefly back to FIG. 1, it is noted that certain designs of conventional can bottoms 106 provide a circular bottom edge having an outer diameter that allows one can 200 to be easily stacked on top of another can 200. That is, the outer diameter of the bottom edge of the can bottom 106 is slightly smaller than an inside diameter of the rim 122 of a conventional can 100, allowing the bottom of an upper can to be received and held in place (from a side-to side movement perspective) with the rim of the lower can when the cans are stacked.

Figure 14:
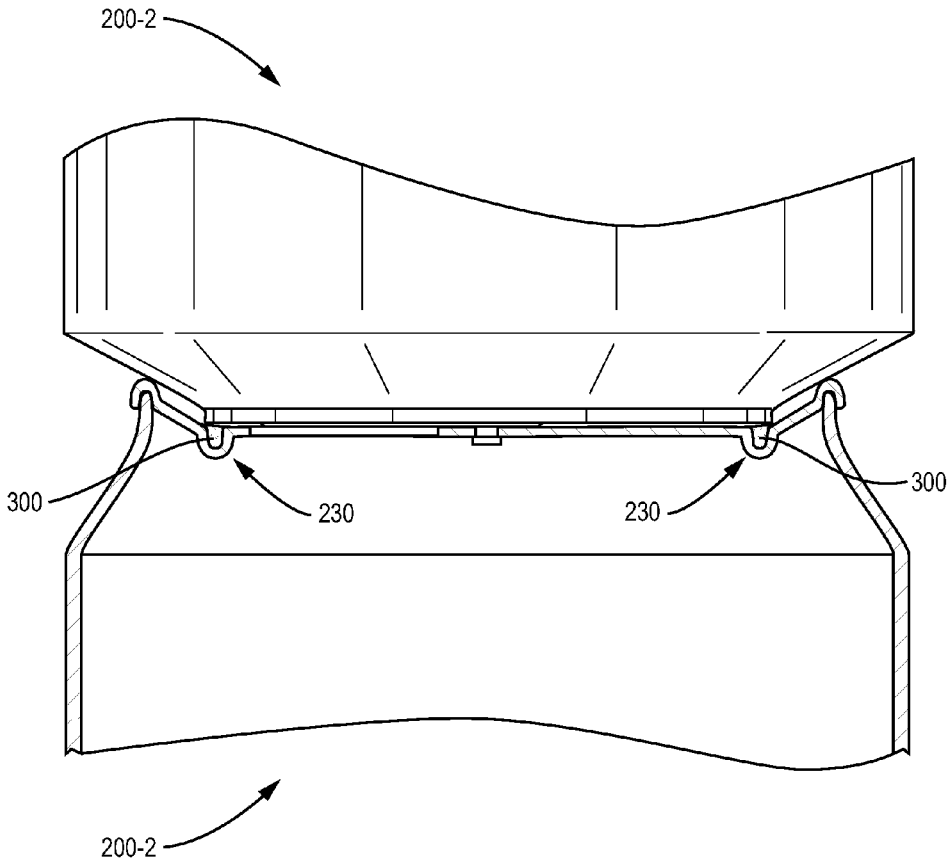
FIG. 14 illustrates an example embodiment in which the groove cover fills-in the groove defined in the beverage can top but does not interfere with stackability of cans (i.e. does not interfere with the bottom of an upper can that fits into the rim of a lower can for stacking purposes).

FIG. 14 illustrates a cross sectional view of an upper can 200-1 stacked on top of a lower can 200-2 that includes a groove cover 300 disclosed herein that fills-in the groove 230 only to a depth that does not interfere with the stackability of a can 200-1 that has a shaped conforming to a conventional can bottom shape. That is, as shown in FIG. 14, the groove cover 300 fills the groove 230 but not so much as to interfere with the ability of the bottom of the upper can 200-1 to rest properly within the rim of the lower can 200-2.

Figure 15:
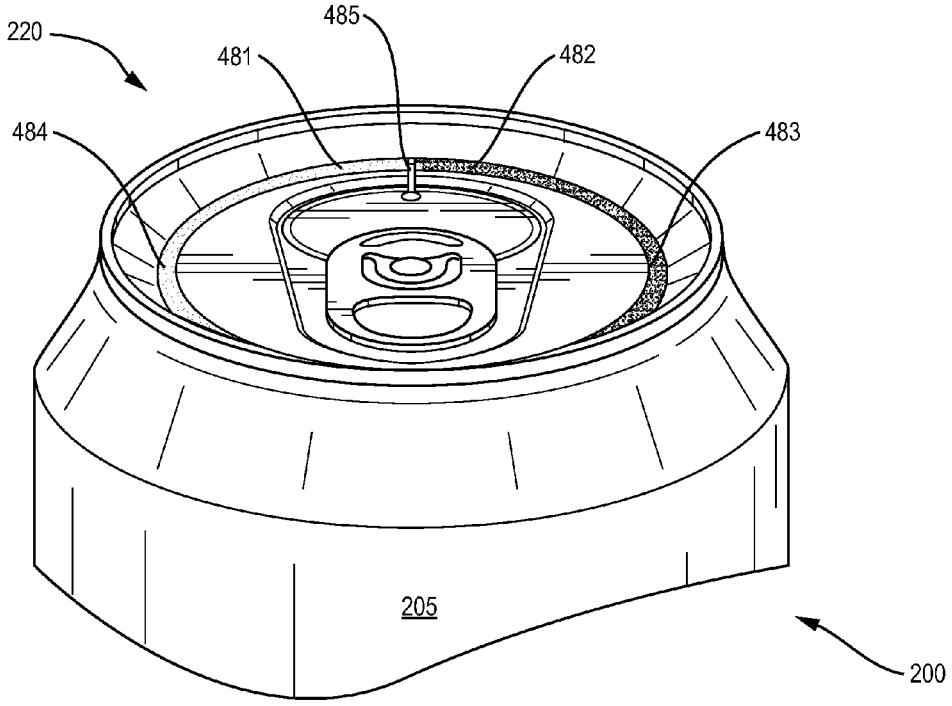
FIG. 15 illustrates a can top including a groove cover that includes chambers or reservoirs of liquids that, when combine via opening of the can, mix to produce a radiant glow within the groove cover.

FIG. 15 shows an example embodiment in which the groove cover includes an activatable liquid radiant material that is activated causing the groove cover material 300 disposed within the inner rim of the can to glow or illuminate when the can is opened. In this example embodiment, the groove cover 300 can be configured to contain two separate compounds 481, 482 such as liquids that are maintained within two separate compartments 483, 484 formed by the groove cover 300 within the groove 230. The compartments can be separated with a thin wall section 485, such as for example, a thin plastic material or wax membrane. This thin wall section 485 can include a thin tether that passes through the groove cover material 300 and protrudes from the groove cover and that is adhered to the openable section 224 of the upper surface 229 of the can top 220. Accordingly, when the can 200 is opened, the openable section 224 depresses into the body and tugs on the attached tether that is coupled to this thin barrier 485 (the barrier 485 keeps the two liquids from mixing during shipping and prior to opening the can). The opening action thus causes the thin wall section 485 to which the tether is attached to pull a bit and dislodge from its original position within the groove cover 300. This causes the formerly separate fluid components to now be joined and to be able to flow and mix together. Upon mixing, a luminescent chemical reaction occurs and a glow is produced (in a manner similar to how a cartridge in a glow stick is broken causing the liquid compounds in the glow stick and the cartridge to be able to mix to produce a colored glow). The groove cover in this configuration can thus secure and define each compartment 481, 482 that maintains the fluid components. In one configuration, the groove cover including the activatable radiant material (i.e. the separate compounds that are able to mix and glow upon opening the can) can be preformed (e.g. as a groove ring) and placed into the groove to avoid complicated creation of separate compartments and addition of liquid glow components during application of the groove cover. In other words, a preformed groove cover ring including the tether wall 485 and liquid compartments that hold ingredients, that when mixed together cause a glow effect, can be used as the groove cover 300.

FIGS. 16A through 16E show various example alternative configurations of a groove cover 300 as well as example can top profiles of can tops or lids configured with the groove cover 300 within a groove 230 in accordance with example embodiments disclosed herein. Note that details of how the can top or lid joins to the can housing are not shown in these figures and such details will be shown in later figures. Rather, FIGS. 16A through 16E are intended to shown different groove shapes or profiles, as well as different groove cover profiles or shapes. It is to be understood that these are examples only and are not intended to be limiting of the invention. These figures also illustrate that there can be various configurations of groove cross sectional profiles of can tops. It is to be understood that the groove cover 300 shown in FIGS. 16A through 16E may be any type of groove cover material disclosed herein. As examples, the groove cover 300 may be a liquid groove cover that hardens into a substantially solid material that bonds to the surface of the can top, or the groove cover 300 may be a pre-shaped groove ring that is pressed or secured via adhesive into the groove 230.

Figure 16A:
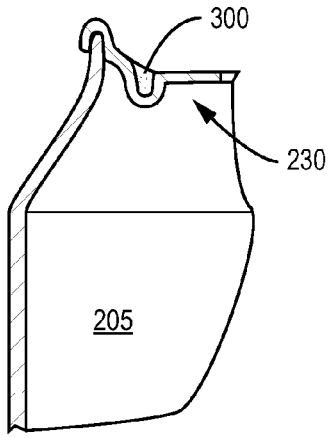
FIG. 16A through 16E illustrate various examples of different cross sectional profiles of different shaped grooves of can tops and various example embodiments showing different cross sectional profiles of possible groove cover shapes and configurations.
Figure 16B:
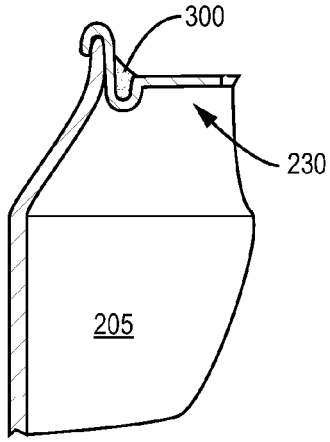
Figure 16C:
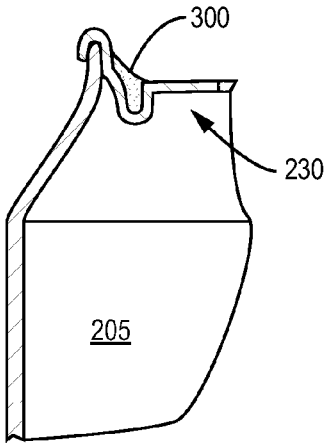
Figure 16D:
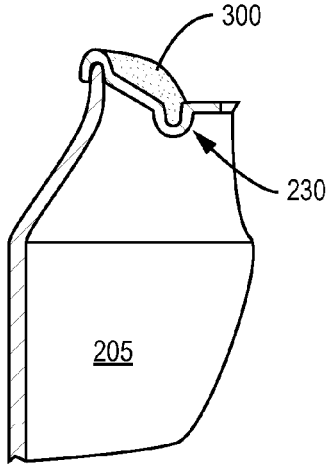
Figure 16E:
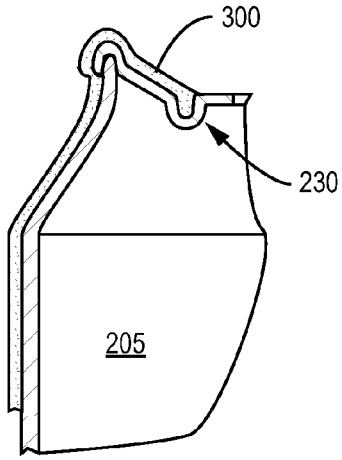

While particular profiles of groove covers 300 are shown with particular can top groove shapes or profiles in FIGS. 16A through 16E, it is to be understood that a given groove cover profile can be used with more than one type of can top groove profile, and vice versa. As an example, in FIG. 16B, the groove profile of the grove 230 of the can top provides for a rim of the can that has an outside groove wall the descends vertically downward towards the bottom of the groove (as opposed to a sloped or curved outer groove wall as shown in other figures). For the groove cover 300 shown in FIG. 16B, the upper surface of the groove cover 300 is shown to slope a bit from the outer groove wall across the top of the groove to the upper surface of the can top. It is to be understood that this upper groove cover surface can be substantially horizontal and flat thus horizontally extending the upper surface of the can top horizontally across the groove to the outer groove wall (as opposed to rising up on an angle up towards the rim of the can as illustrated in FIG. 16B). In other configurations, the upper groove cover surface can be gently curved upwards. A curved upper groove cover surface promotes ease of wiping dirt and debris off of the upper surface of the can top and over the edge of the rim to allow for ease in cleaning the can top when wiping.

Example above descriptions disclose placement of a groove cover 300 into the groove 230 defined on a can top 220 to reduce or eliminate the ability of the groove to collect debris by covering and/or filling-in some or all of the groove, and in some cases creating a smooth surface that extends upwards from the upper can surface towards the rim and top edge of the can to promote wiping of dirt away and off of the can top, thus resulting in a cleaner can top that provides a more sanitary drinking experience. The groove cover material is operable to be secured to a can top of a beverage can to cover at least a portion of a groove defined by the can top. In some configurations, the groove cover is maintained in place in the groove by an adhesive that adheres the groove cover to an upper outer surface of the groove section, and in other configurations the groove cover material can bond to the can top surface. In other configurations, a mechanical fit (e.g. press fit) of the groove cover with the can top secures the groove cover in place.

As noted above, the groove exists between an upper surface of the can top and an inside wall of a rim of the can top. This is the major groove or countersink defined on metallic beverage can tops and is structurally defined in, on, or by the can top for strength purposes to allow the can to better withstand internal can pressures exerted by pressurized (e.g. carbonated) liquids such as carbonated soda or beer. The groove cover material provides an upper groove cover surface that inhibits collection of debris within the groove after installation of the groove cover. Though not limited as such, in many embodiments, the groove cover has an inside edge that ends between the openable section of the can top and the top edge of the upper surface of the can top (prior to that edge dropping off into the groove 230). In other words, in most configurations, the groove cover 300 can reside in and fill-in the groove and can extend partway onto the upper surface of the can top, but its inside edge stops prior to covering the openable section of the can top. In this manner, the groove cover substantially eliminates the groove (and its ability to be prone to collection of debris) within interfering with opening of the can to dispense the liquid contents.

Embodiments disclosed herein further include designs of groove cover rings (groove rings) and can tops that facilitate securing the groove cover to the can top. In particular, where an adhesive is not used (for example due to a curing or drying time of the adhesive that might slow down the bottling process), the groove cover and can top are able to interface via mechanical action between the two surfaces that prevents easy removal of the groove cover. The following discussion discloses a variety of embodiments of groove covers, can tops, can top manufacturing techniques, can top seaming techniques (to secure the top to the can housing), and groove cover (groove ring) construction, design and application techniques (methods for applying the groove cover to the top) to provide for the overall result of filing in the groove and thus removing the presence of the groove with respect to the outer surfaces of the can top and beverage can. In this manner, these techniques result in a much more sanitary and environmentally acceptable beverage can. A can with a groove cover is health conscious can that can assist in preventing sickness and the spread of germs since the groove cover promotes ease of can top cleaning (as opposed to pushing dirt and germ laden debris into the groove where it is hard to clean out). The result is a new type of beverage can that can be marketed to the consuming public to appeal to their interest in cleanliness and health consciousness. The addition of a groove cover to an aluminum beverage can design is inexpensive and is quick to apply and does not significantly slow down the canning/bottling process.

Figure 17:
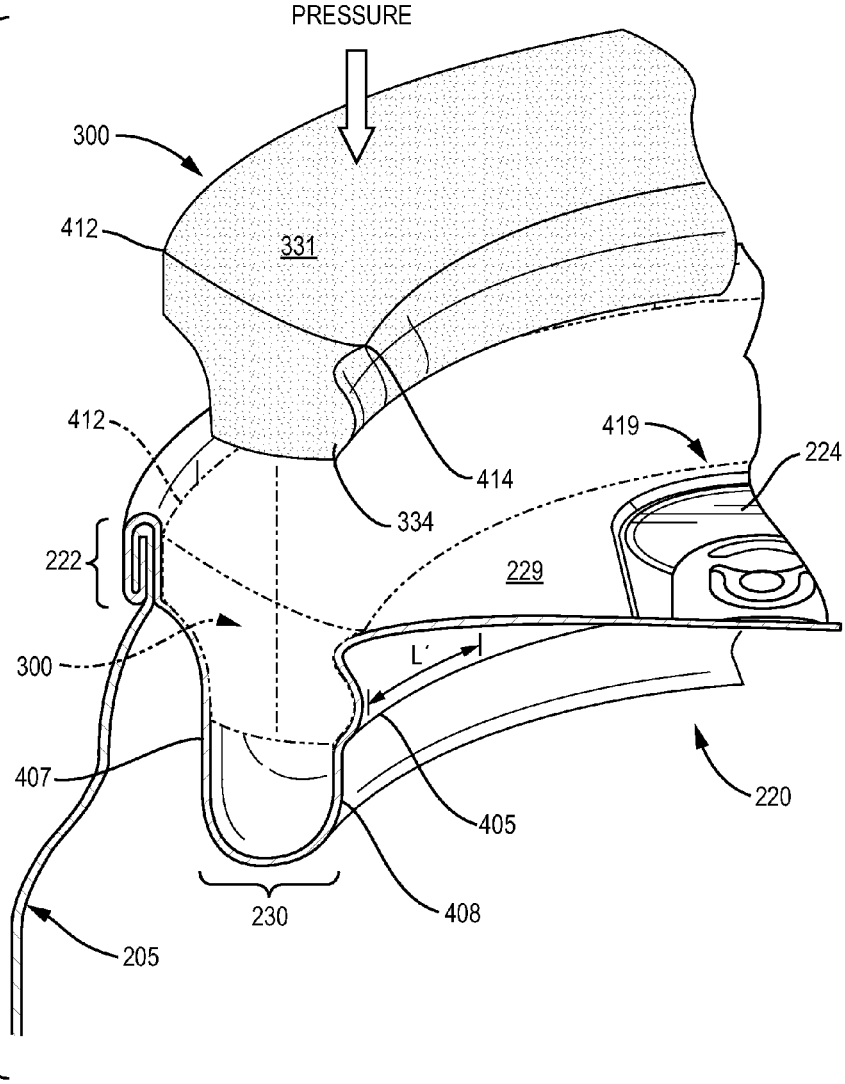
FIGS. 17, 18A, 18B and 18C illustrate an example embodiments that includes an impression or recess in a sidewall of the groove into which one or more appendages of the groove cover matably attaches or fit into to secure the groove cover in place.

FIG. 17 illustrates a cutaway view of one side of an example can top 220 in which the can top 220 has a groove 230 having an example groove shape or profile that is configured with an impression 405 on its inner groove sidewall 408 that allows a correspondingly shaped groove cover 300 to be inserted and secured in place on the can top 220. The impression causes the sidewall of the groove to extend inwards towards the center of the can top. In this example the can top 220 is shown as double seamed to a can housing 205 using a double seam (as is commonly know in the art), but it is to be understood that a can top or lid alone that is not yet seamed or sealed to a can housing, but that includes the impression 405 (as well as methods of forming such a can top) is/are to be considered embodiments disclosed herein as well.

In this example in FIG. 17, the groove cover 300 is illustrated as residing initially above the groove 230 defined in the can top 220 (as it would exist prior to insertion or installation into the groove). It is to be understood that groove covers 300 (apart from being inserted into the can tops and cans) disclosed herein that are designed to fit into the groove of a can lid 220 (but that are not yet installed into the groove) are all considered embodiments protected herein. In FIG. 17, the dotted outline of the groove cover 300 within the groove 230 shows how the groove cover appears once inserted or installed into the groove 230. Methods of insertion and installation of groove covers into can tops/lids 220 (whether such lids 220 are seamed to a can 200 or not) are also disclosed herein and are considered embodiments covered by this disclosure.

The groove cover 300 includes an upper groove cover surface 331 that inhibits collection of debris within the a portion of the groove 230 into which the groove cover 230 is inserted. In this example, the upper groove cover surface 331 extends across the top of the groove 230 (i.e. spans the groove 230). This upper groove cover surface 331 extends between its outside edge 412, that resides when inserted into the somewhere along the inside edge of the rim 222 of the can top 220, and an inside edge 414 that terminates somewhere along the upper edge of the upper can top surface 229. The groove cover 300 includes a groove cover body 333 that extends downward from the upper groove cover surface 331. When inserted into a groove 230 of a can top 220, the groove cover body extends into the groove 230 defined in the can top 220. The groove cover 230 also includes the upper groove cover surface 331 that provides an outside edge 412 and an inside edge 414. The groove cover body 333 includes at least one surface (e.g. the exterior surface defined by the groove appendage 334) that affixes to a groove sidewall surface (e.g. an impression or recess 405 defined within the outer or inner groove sidewalls 407, 408) of the can top 220 that defines the groove 230 in order to secure the groove cover 300 into the groove 230 on the can top 220. That is, the groove appendage 334 inserts into the groove recess 405 to hold the groove cover in place.

As can be seen in the cutaway view in FIG. 17, in this example the inner sidewall of the groove cover 300 has a shape or profile including an appendage 334 that corresponds to a shape or profile of the inner sidewall 408 of the groove 230 (i.e. that fits into the recess 405). In particular, in its inserted position, the groove cover 300 includes a groove cover body that extends downward from the upper groove cover surface 331 and extends at least partway into the groove 230 defined in the can top 220. The groove cover body includes at least one surface that affixes to a groove sidewall surface (e.g. 407 and/or 408) of the can top 220 to secure the groove cover 300 into the groove 230 on the can top 220. To affix the groove cover 300 in place in the groove, in this particular example, the groove cover body 333 includes at least one groove appendage 334 that extends outward from the groove cover body 333 (the appendage extends radially inwards towards the center of the can top 220 in this example, but this is outward relative to the main body of the groove cover). The groove appendage 334 is operable to interface with (i.e. insert into) a corresponding impression 405 on at least one sidewall (the inner groove sidewall 408 in this example) of the groove defined in the can top/lid 220 to securely hold the groove cover 300 in place on the can top 220 upon insertion of the groove cover into the grove defined on the can top. In this manner, once the groove cover 300 is inserted into the groove (e.g. press or snap fit into the groove), the groove cover 300 remains in place affixed to the can top 220.

Note that when the groove cover 300 is fully inserted into the groove 230 of the can top 220, the inside edge 414 rests or terminates at a location 419 located somewhere in between an outside edge of the openable section 224 of the can top and an upper inside edge of the top of the groove 230 (or in other words, the outside edge of the upper surface 229 of the can top). That is, the inside edge 414, as shown as location 419 in FIG. 17 (and as shown in other figures but not specifically enumerated), rests firmly against the upper surface 229 of the can top 220 (at location 419) somewhere between the upper edge of the inside sidewall of the groove and the edge or beginning of the openable section 224 of the can top. The groove cover 300 thus does not interfere with or cover the openable section 224 of the can top in these example embodiments. As a result, the groove cover 300 can be applied to the can top during manufacture (either during manufacture of the can top itself, or during application/seaming of the can top to the can housing, or shortly after the can top is seamed) and the groove cover 300 need not interfere with the opening of the can by the consumer. The upper groove cover surface covers the groove 230 by spanning the opening at the top of the groove 230 between the groove cover insides edge 414 and the groove cover outside edge 412, thus providing a new surface 331 over which the liquid from the can 200 flows when poured. It is to be understood that the upper groove cover surface 331 may be flat, or may have a slope of a low or high angle, depending upon the embodiment. The surface 331 may be curved in a concave manner as illustrated, to provide a gently curved sloping surface from an area at or near the top of the rim of the can down towards an outside edge of the upper surface (i.e. center panel) of the can top. In other embodiments, the surface 331 may be convex and can "bubble out" providing a domed appearance as it extends from the rim 222 of the can towards the upper surface 229. Other embodiments provide for a profile of the surface 331 that starts at outer edge 412 and initially becomes convex and then, as it continues towards inside edge 414, becomes concave. Such a profile is called an "ogee" edge profile.

The groove cover material 300 may be a substantially solid material (but may have some flex and deformation capability under force) and may be made from a material such as a plastic, rubber, silicon, resin, epoxy, dense foam or other material that is pre-shaped into a circular groove ring that can be placed and secured into the groove (e.g. press fit) defined by the can top. As a specific example, the groove cover material 300 can be constructed from an inexpensive semi-flexible non-toxic food-grade plastic material and can be molded or vacuum formed in large quantities. The groove cover 300 can be a ring-shaped to provide a groove cover for the entire circumference of the groove around the can top, or may only a part of the circumference of the total groove 230. In embodiments where the groove extends only part of the way around the groove 230 to only be part of an arc of a circle, a center the groove cover 300 arc would be placed in alignment with the openable section 224 to prevent liquid from entering the groove 230 upon pouring from the can 200. Depending on the embodiment, the groove cover 300 can be ring shaped and can include a split or break in the ring (thus making it not a fully contiguous ring of material). Such a split or break in the ring can allow temporary expansion/deformation of the groove cover 300 from its ring shape to allow temporary expansion of the diameter of the ring during press fit insertion into the groove 230 defined in the can top 220.

In the example illustrated in FIG. 17, the groove appendage 334 is a substantially continuous appendage that extends outward from the groove cover body 333 along (i.e. around) an entire circular length of the groove cover body 333. This continuous appendage 334 is operable to interface with a continuous impression or recess 405 that extends around an entire perimeter or circumference of at least one sidewall (the inner sidewall 408 in this example) of the groove 230 defined in the can top 220. It is to be understood that the impression 405 could be formed on either the inner groove sidewall (as shown) or on the outer groove sidewall 407, or on both sidewalls 407 and 408 and that the groove cover 300 could have corresponding appendages or outcroppings formed to interface to such impressions (an example of such a configuration of a groove cover with multiple appendages on both inner and outside sides, and a can top having groove sidewalls shaped to accommodate such a multi-appendage groove cover are discussed later in FIG. 21).

In an example configuration in FIG. 17, the groove cover 300 is a circular ring-shaped groove cover having a central diameter substantially equal to the central diameter of the groove 230 (relative to the entire can top) existing between an upper surface of the can top and an inside wall of a rim of the can top. The ring-shaped groove cover 300 has a groove cover body 333 that extends downwards from the upper groove cover surface 331 and is shaped to conform to at least a portion of a shape of the groove defined by the can top 220. The groove cover body 333 includes inner and outer sidewalls, at least one of which secures to inner and outer groove sidewalls defined by a surface of the can top (the illustrated example showing the inner groove cover sidewall having the appendage 334 that inserts into the impression 405 on the inner groove sidewall 408 in this example).

Figures 18A, 18B, 18C:
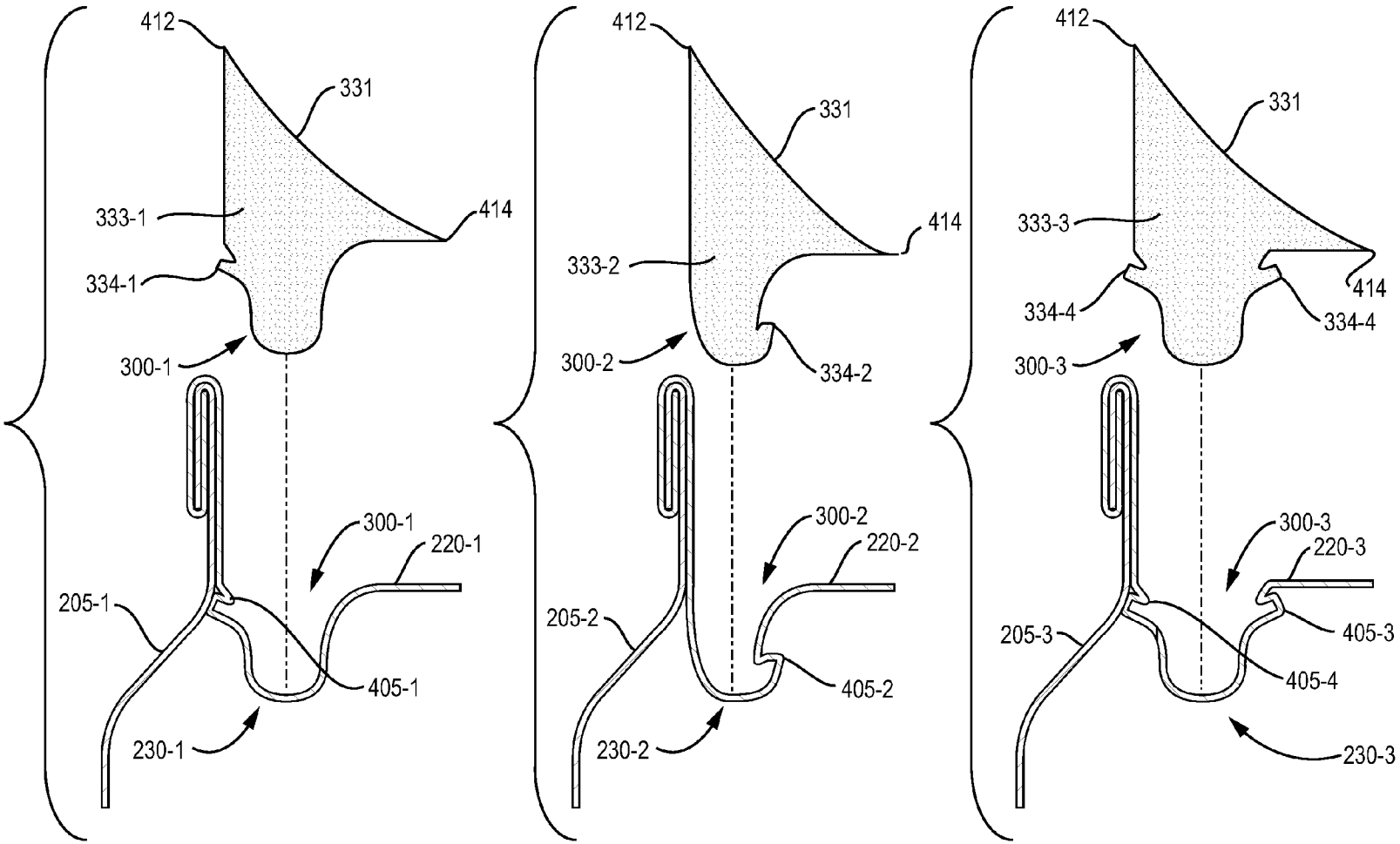

FIGS. 18A, 18B and 18C illustrate examples of cross sectional profiles of example groove covers 300, as well as example can top configurations that provide groove profiles into which the groove covers can be inserted and held in place, as configured in accordance with example embodiments disclosed herein. In these illustrated examples, each groove cover 300 includes at least one appendage 334 that, upon insertion of the groove cover 300 into the groove 230 of the can top 220, interfaces with a corresponding impression 405 (e.g. notch, slot, dent, depression) or other impression to securely hold the groove cover 300 in place within the groove 230 of the can top 220. The groove cover appendage(s) 334 is/are compressible/deformable inwards, towards the groove cover body 333 from which it/they extends, during insertion of the groove cover 300 into the groove 230 as the grove cover body 333 passes through an opening of the groove 230. Thereafter, the appendage(s) 334 uncompress/undeform outwards into the corresponding impression(s) 405 on at least one sidewall of the groove 230 after clearing the opening. The groove cover appendage(s) 334 anchor the groove cover 230 into the groove 230 defined by the can top 220. In this manner, once inserted, the groove cover 300 remains in place on the can cop.

In the examples illustrated in FIGS. 18A-18C, the groove cover appendage(s) 334 are illustrated as tooth-like barbs. Note the drawings in FIGS. 18A, 18B and 18C are not necessarily to scale. As an example, the thickness of the bards 334 may be think to provide them more flexibility. Each appendage is coupled at a first lower end to the groove cover body 333 (i.e. towards a lower end of the groove cover body 333) and has a second upper end that extends upwards and outwards from the groove cover body. Once inserted into the groove 230, the appendage(s) come to rest into the corresponding impression(s) on at least one sidewall of the groove 230 after insertion of the groove cover 300 into the groove 230. The appendages 334 anchor and affix the groove cover in place on the can top to prevent its removal. The groove cover configured in this manner remains in place once the can leaves the manufacturing facility and before, during and after opening of the can top to dispense its liquid contents.

In one configuration, the groove appendage 334 is at least one outcropping of groove cover material that extends outwards from at least one sidewall of the groove cover body 333 towards a sidewall 407, 408 (e.g. in FIG. 17) of the groove 230 defined by the can top 220. The groove cover material 333 (the body and appendages 334) is flexibly deformable to allow brief deformation of the outcropping (the appendages 334) during insertion of the groove cover 300 into the groove 230 of the can top 220 and allows at least some un-deformation of the outcropping into a corresponding impression on the at least one sidewall of the can top towards which the outcropping extends. Thus, during insertion of a groove cover having one or more appendages such as those shown in FIGS. 18A through 18C, the appendages 334 deflect inwards towards the groove cover body to allow the groove cover to be inserted into an opening of the groove. Once the appendage(s) 334 have cleared the opening of the groove and are resident at the adjacent impressions(s) 405 to which they correspond, the appendage(s) 334 can spring back outwards and into the impression(s) 405 formed in the sidewalls of the groove of the can top. Once the appendages 334 have sprung back outwards (relative to the main body of the groove cover) into the impressions 405, they remain in place in this position to prevent easy removal of the groove ring from the can top 220. In this manner, the can top 220 includes an installed groove ring that covers and fills-in the groove to avoid collection of dirt and debris in the groove. The groove ring 300 is thus anchored firmly in place via the interlocking design and shape of the groove ring and corresponding can top.

In FIG. 18A, the groove appendage 334-1 extends radially outward (with respect to the center of the circular ring) from the groove cover body 333-1 of the groove cover 300-1 and interfaces, as shown in the lower diagram in FIG. 18A, with a corresponding impression 405-1 formed in the outer sidewall of the can top 220-1.

In FIG. 18B, the groove appendage 334-2 extends radially inward from the groove cover body 333-2 (relative to the radius of the can top 220-2) of the groove cover 300-2 and interfaces, as shown in the lower diagram in FIG. 18B, with a corresponding impression 405-2 formed in the inner sidewall of the can top 220-2.

In FIG. 18C, there are two groove appendages 334-3 and 334-4, wherein appendage 334-3 extends radially outward from the groove cover body 333-2 (relative to the radius of the can top 220-2) and appendage 334-4 extends radially inward (again relative to the radius of the can top 220-2) from the groove cover body 333-3 as shown. In the case of two groove appendages, one on each side of the groove cover body 333, each can insert and interface, as shown in the lower diagram in FIG. 18C, with a corresponding impression 405-3 and 405-4 formed in the inner and outer sidewalls of the can top 220-3.

Note that formation of the impressions and other structures in sidewalls of a can top 220 to secure a groove cover 300 in place will be discussed shortly. It is noted here that formation of groove rings 300 such as those shown in FIGS. 17 and 18A, 18B and 18C (as well as other figures) can be achieved, for example, by an extrusion machine that extrudes, for example, hot plastic having the required groove cover profile from an orifice. As the groove material is extruded, it can be bent or shaped to form a ring or circular shape that when hardened, forms the groove ring. Thus, one technique for forming groove rings with profiles such as that shown in FIGS. 18 (A, B and C) is to use an extrusion machine for extruding rubber, plastic or another material into the groove ring shape or profile. Other techniques for formation of articles of this sort such as plastic or rubber vacuum formation techniques using molds can also be used as well.

It is also noted that there are numerous variations that can be made to the can top 220 shown in FIGS. 18A, 18B, 18C and other figures disclosed herein that can operate to secure a groove cover 300 in place. For example, the impressions 405 can be sharply formed, or may have more rounded transitions between their edges and surfaces. For example, the impressions 405 in the FIG. 18 series of figures can be made as sharp indentations in the sidewalls of the groove during the can top formation process, or may have more smooth curved profiles.

There are numerous issued patents that cover the construction process of can tops or lids 220 (also referred to as can ends), as well as seaming processes for coupling or seaming the can tops 220 to the can housings or can bodies 205. As an example, U.S. Pat. No. 6,089,072 discloses a process and machinery for forming a can end having an anti peaking bead. The term bead is what is referred to herein as the groove of the can top. This patent is incorporated by reference herein in its entirety. Other patents know to the applicant will be cited in an Information Disclosure Statement upon filing of the Utility patent.

It is to be understood that can tops or lids 220 having groove profiles configured as illustrated in these examples as well as others disclosed herein are also considered embodiments disclosed herein, even if such can tops 220 do not include an inserted groove cover 300. That is, a can top 220 defining a groove 230 having sidewalls, impressions or other portions formed as disclosed herein to maintain a groove ring in place is considered an embodiment disclosed and protected herein, even if no such groove ring is yet installed.

In the cross sectional profile examples illustrated in FIGS. 17 and 18A, 18B and 18C, the groove appendages 334 and groove sidewall impressions 405 into which those appendages reside are drawn as continuous appendages and impressions that continue along (i.e. around) an entire length of the groove cover material 300 and along the sidewall(s) (407 and/or 408) of the groove defined in the can tops 220. This is one example configuration and in other configurations, there can be groove appendages 334 spaced at intervals (e.g. substantially equal spacings) around the circumference of the groove cover body 333 (i.e. around the inner sidewall of a groove ring at predetermined locations).

Also of note in FIGS. 17 and 18A, 18B and 18C, the groove cover 300 provides the upper groove cover surface 331 that provides an inside edge 412 and an outside edge 414, each of which, upon insertion of the groove cover 300 into the groove 230 of the can top 220, depresses snugly against a surface of can top to create a substantially smooth transition between the inside edge of the rim of the can top and an upper can top surface. The edges 412 and 414 provide a transition from the metallic beverage can surface (i.e. the upper surface of the can top) to the upper groove cover surface 331 that is smooth and that substantially eliminates the groove from the can top surface by providing the upper groove cover surface 331. Once installed in the groove 230, the groove cover 300 remains secure and affixed in place on the can top 220 before, during and after opening of an openable section 224 in the can top 220 to dispense liquid from the can 200. Note that the arrows shown in FIG. 17 on either side of the inside and outside edges 412 and 414 of the upper groove cover surface 331 indicate that in some embodiments, there is some flexibility to these edges. This allows the groove cover 300 to be pressed snugly into the groove when engaging the appendage (s) 334 with the sidewall impression(s) 405. When the downward insertion force (used to insert the groove cover) is removed, the slight flexibility of the inside and outside edges 412 and 414 provide a slight counterforce in the upwards direction on the groove cover 300. This slight counterforce can maintain a tight seal between the inside and outside edges 412 and 414 and the surface of the can top on either side of the groove. As such, the edges 412 and 414 can create a tight seal and not allow liquid, dirt or debris from getting under the groove cover 300.

FIGS. 19A, 19B, 19C and 19D show top views of example configurations of a can top or lid 220 and groove cover or groove ring 300 in accordance with example embodiments disclosed herein.

Figure 19A:
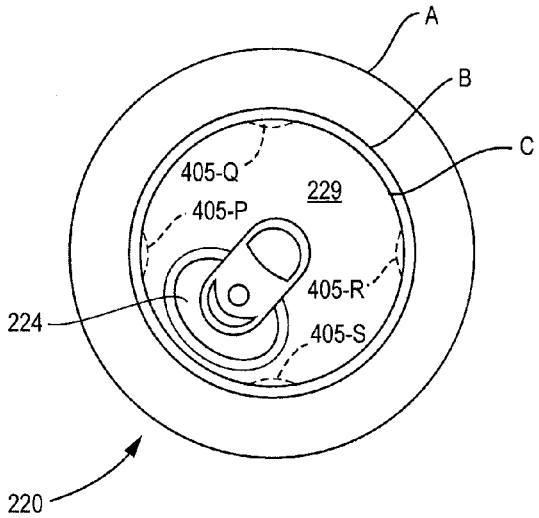
FIG. 19A shows an upper view of a beverage can in which the can top includes impressions spaced around the inner sidewall of the countersink groove to secure a groove cover in place.

In particular, FIG. 19A illustrates a top view of a can top 220 that includes four periodically (e.g. evenly) spaced impressions 405-P, 405-Q, 405-R, and 405-S formed in the inner sidewalls of the groove 230 defined in the can top 220. Note the impresses 405 are shown as dotted lines since they are indentations into the inner sidewall 408 of the groove 230 and would not necessarily be visible from a top view. In FIG. 19A, circle A represents the outermost edge of the can top 220 prior to seaming of the can top 220 to a can housing. Circle B represents the bottom of the groove 230, and circle C represents the inside edge or top of the inside sidewall 408 of the can top 220. The openable section 224 can be seen on the upper surface 229 of the can top.

Figure 19B:
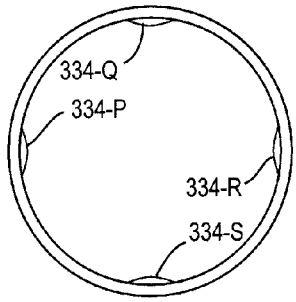
FIG. 19B shows a top profile example of a groove cover for use with a beverage can shown in FIG. 19A.

FIG. 19B illustrates a top view of a corresponding groove cover 300 that includes four groove appendages 334-P, 334-Q, 334-R and 334-S that can interface and affix the groove cover 300 to the can top 220 if the groove cover 300 were inserted into the groove of the can top shown in FIG. 19A. In such example configurations, when the groove cover 300 in FIG. 19B is inserted into the groove of a can top in FIG. 19A, each groove appendage 334-P, 334-Q, 334-R and 334-S interfaces, upon insertion of the groove cover 300 into the groove 230 of the can top 220, to a corresponding impression 405-P, 405-Q, 405-R, 405-S on the at least one sidewall (the inner sidewall 408 in this example) of the groove 230 defined by the can top 220. Note if the groove cover 300 in FIG. 19B is used with the can top 220 in FIG. 19A, the groove cover 300 should be rotationally aligned so that each appendage 334 engages with the can top 220 at a position of a corresponding impression 405 in the sidewall of the groove 230.

In an example configurations in FIGS. 19A and 19B, there can be multiple groove appendages 334 (four in the illustrated example in FIG. 19B) spaced at intervals around the groove ring 300. In this example, the groove appendages 334 might be ¼ to ½ inch in length in the direction marked "L" in FIG. 18B. Such a groove ring 300 would use less material (e.g. less plastic) than a groove ring in which the appendage(s) 334 run the continuous length of the groove cover material 300.

Figure 19C:
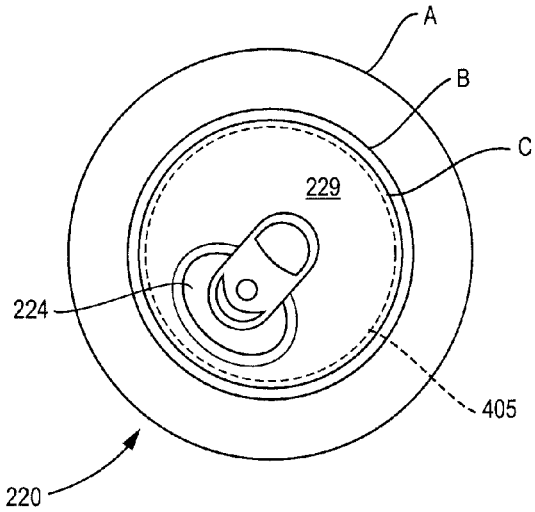
FIG. 19C shows an upper view of a beverage can in which the can top includes a single continuous impression around the inner sidewall of the countersink groove to secure a groove cover in place.

FIG. 19C shows a top view of a can top 220 that has a continuous impression (shown by dotted line) around the entire inner sidewall of the can top. This impression can be formed during can top stamping (i.e. during manufacture of the can top).

Figure 19D:
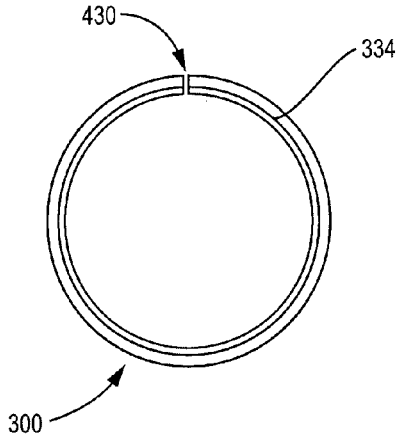
FIG. 19D shows an example of a groove cover for use with a beverage can shown in FIG. 19D.

FIG. 19D shows a groove ring with a continuous appendage that can be inserted into the can top in FIG. 19C. Note the groove ring 300 shown in FIG. 19D includes a split or break in the groove ring to allow expansion of the groove ring during insertion into the groove. In this example, the groove cover material is a semi-flexible circular shaped non-continuous groove ring having a first end and a second end that are adjacent to each other to define a split 430 in the groove ring, thus forming a split groove ring 300. To install the split groove ring 300 into the groove defined in the can top, a machine presses the first end into the groove and continually presses the groove cover into the groove defined in the can top along a length of the groove cover until reaching the second end of the split groove ring. In this manner, the groove ring can be installed by a press or a roller mechanism that begins at one end of the groove ring and presses the groove ring into the groove in the can top as it works its way around the circumference of the groove ring, with full insertion being completed when the roller reaches the second end of the groove ring. For press fit installations, the split groove ring can be press fit into the groove and the split 430 defined in the groove ring 300 allows brief expansion of the groove ring while being press fit into the groove.

Note in configurations such as those in FIGS. 19A and 19B in which the groove cover 300 has groove appendages 334 spaced at intervals around the groove cover body 333, the groove ring 300 can be inserted into a groove 230 of a can top 220 that has a continuous impression 405 (such as that shown in FIG. 19C). That is, in one configuration, even though the groove cover 300 in FIG. 19B includes separate groove appendages 334-P through 334-S spaced at intervals, the groove defined in the can top 220 can provide a continuously running impression as shown in FIG. 19C that extends around the entire inner/outer sidewalls(s) 407 and/or 408 (i.e. around the entire circumference of the groove on the inner and/or outer sidewalls. In such cases, the groove ring 300 can be press fit into the groove without requiring alignment of the groove appendages 334 with specifically positioned impressions.

Figure 20:
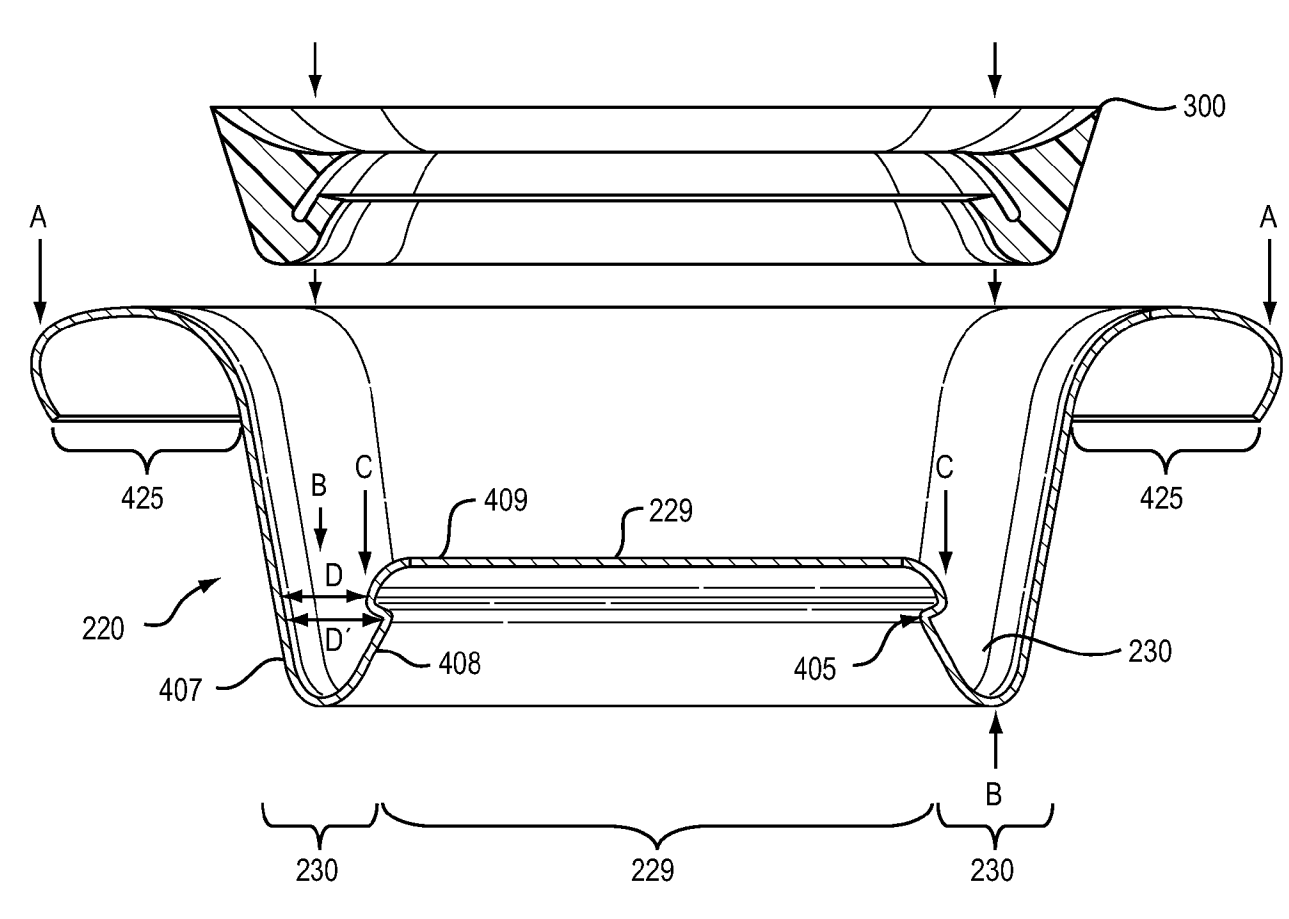
FIG. 20 shows a cross sectional or profile view of a can top and groove cover in accordance with one example embodiment that uses an appendage to secure to the can top.

FIG. 20 illustrates a cross-sectional view of a can top 220 and groove ring 300, each configured in accordance with example embodiments. The illustration in FIG. 20 shows a cross sectional view of an entire can top 220 and entire groove ring 300, whereas the views in FIGS. 17 and 18A-18C show only a cutaway of one side of a can top and groove area. The groove ring 300 shown in FIG. 20 can be equivalent to the groove ring shown from its top view in FIG. 19D.

The can top 220 for a beverage can in FIG. 20 includes an upper surface section 229 that defines an openable section (224 in Figure of the can top. A seaming edge section 425 extends around a periphery of the can top 220. The can top 220 includes a groove section 230 (also referred to as groove 230) that couples the upper surface section 229 of the can top to the seaming edge section 425 of the can top. The groove section 230 defines the countersink groove in the can top surface between the upper surface section 229 and the seaming edge section 425 of the can top. The groove section is configured to secure a groove cover 300 to the can top 220 to fill-in the groove section between the upper surface section 229 and the seaming edge section 425 of the can top 220. The groove section 230 includes an inner groove sidewall 408 that extends below an outer peripheral edge 409 of the upper surface section 229 of the can top 220 towards a bottom of the groove 230. An outer groove sidewall 407 returns upwards from the bottom of the groove towards the seaming edge section 425 of the can top 220. The upper region of the groove defines a upper cross groove distance "D" that is less than a lower cross groove distance D' (D-prime) defined in an lower region of the groove. The lower cross groove distance D' can be, for example, the distance between the outer groove wall to the inner most part of an impression in the sidewall (where inner most means closest to the radial center of the can top). In this manner, the can top 220 shown in FIG. 20 defines a lower part of the groove that accommodates a part of the groove cover 300 (an appendage that is directed radially inward towards the center of the can top in this illustrated example) that prevents removal of the groove cover 300 once installed.

Another way of describing the illustrated diagrams of the can top in FIGS. 18A-18C and 20 are that the groove has an upper groove opening or neck and that a lower region f the groove has a cross distance from inner groove sidewall to outer groove sidewall that is greater than the upper groove opening or neck. By having the groove dimensioned a bit wider in a lower area of the groove (lower the opening), a portion of the groove cover can enter and remain in place in the wider area thus prevent ease of removal of the groove cover. A groove cover (liquid that may be pour in, or a solid that may be pressed in) designed to be inserted into a groove having this characteristic becomes affixed within the groove and requires significant force or can deformation (i.e. crushing the can to deform the top significantly) to remove the groove cover from the groove in the can top. This allows the groove cover, once in place, to remain as "part of" the can after shipment from the canning facility. The groove cover thus remains in place before, during and after opening of the can and while drinking or pouring the liquid from the can. This provides for a cleaner dispensing of the liquid since no debris can collect in the groove due to the presence of the groove cover.

It is to be understood that the outer grove cover edge 412 as shown in the foregoing example groove covers 300 can reside or rest at final position once the groove cover is inserted at any position along the inside edge of the rim or at any vertical position on the outside groove sidewall of the groove defined in the can top 220. By way of example, the illustration in FIG. 17 shows the outer edge of the groove cover residing at a position below the rim of the can and generally equal to or level with the upper edge of the upper surface of the can top upon with the openable section is defined. In alternative configurations, the groove cover body and upper groove cover surface can be formed to provide a steeper slope to the upper groove cover surface and the outer edge of the groove cover can reside or terminate at a higher position along the inside edge of the rim of the can top 220. In doing so, a continuous smooth and upwardly curved surface is provided that bridges the gap of the groove from the upper surface of the can top (upon which the can opening is defined) to the rim of the can top. This creates a can top (with groove cover) with a bowl like profile having upwardly curved sidewalls (formed from the groove cover) and can be very beneficial for several reasons.

In particular, when wiping the can top, the upper groove filer surface can provide a surface over which debris is more easily wiped away off of the top surfaces of the can top (as opposed to a flat horizontal upper groove cover surface). Additionally, by having the upper groove cover surface 331 terminate at its outer edge that is higher up and even quite close to the top of the rim of the can top, a smooth gently sloping surface is provided over which liquid is dispensed from the can. This can reduce turbulence in the liquid, which for carbonated beverages, can increase the amount of carbonation that remains present in the liquid (i.e. less turbulence results in more carbonation remaining in the liquid). For certain beverages such as soda, increased carbonation may increase the taste and drinking experience for the person consuming the liquid. Accordingly, embodiments disclosed herein the provide a groove cover for the groove of the can top can result in less turbulence induced into the liquid when poured from a can that includes the groove cover. This can result in a better more tasteful drinking experience as compared to a conventional can top in which at least some of the liquid must pass through the groove upon exiting the can (i.e. when being poured from the can). In such conventional can tops (with no groove cover present), the existence of the groove causes more turbulence in the liquid, thus releasing more carbonation. The groove ring reduces this turbulence and hence can serve to increase the stability of the carbonation within the liquid, resulting in a tastier drinking experience. The groove ring in such instances can also be referred to as a flavor ring or taste ring, as well as a clean can or clean ring.

Figure 21:
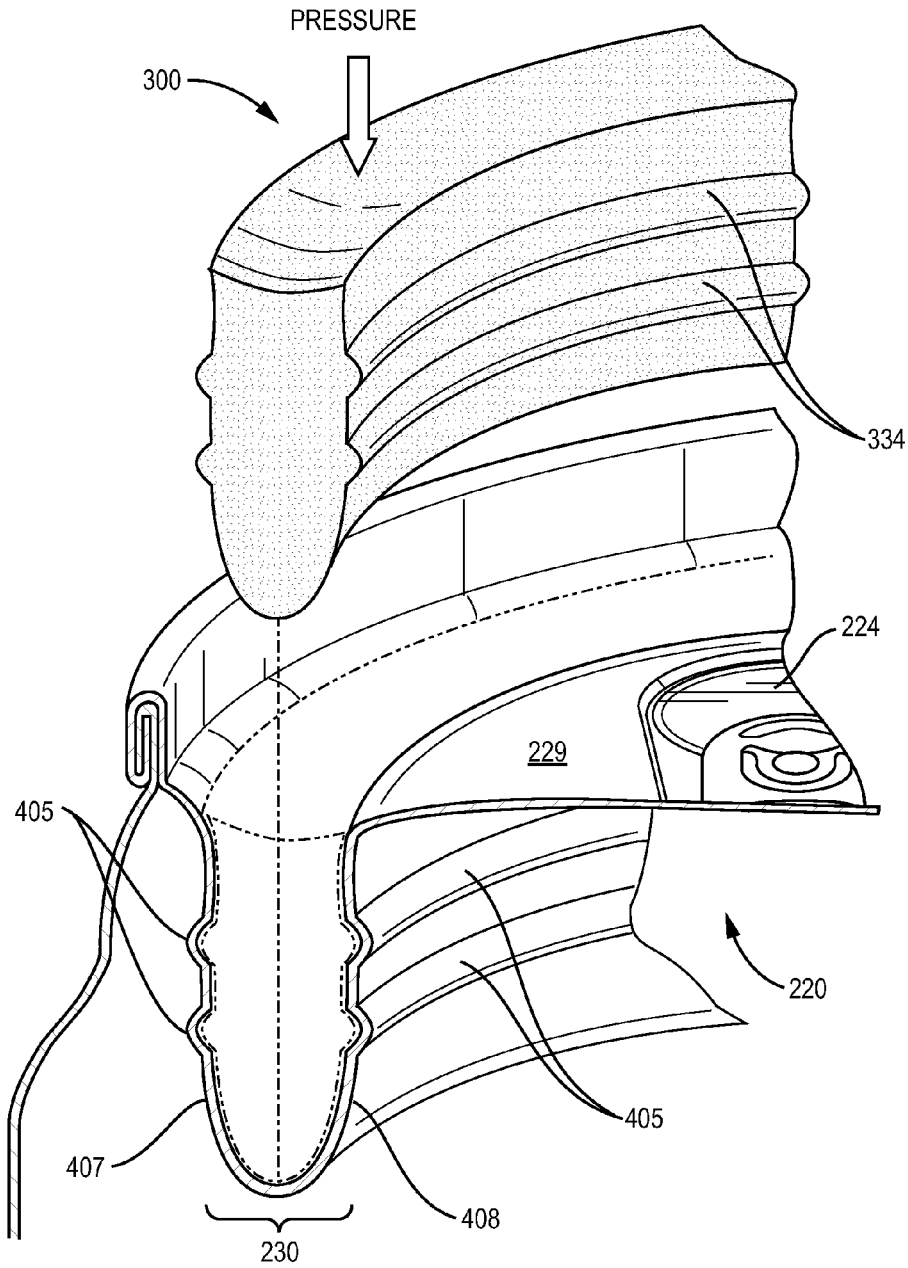
FIG. 21 shows a cross sectional or profile view of a can top and groove cover in accordance with one example embodiment that uses multiple appendages to secure to a can top.

FIG. 21 illustrates another example of a groove cover 300 and can top 220 configuration in accordance with embodiments disclosed herein. In FIG. 21, both the inner and outer sidewalls of the groove 230 defined in the can top 220 include multiple impressions 405 that in this example, form slightly rounded impressions in the sidewalls of the groove 230. It is to be understood that the rounded nature of the impressions is shown by way of example only, and that the impressions formed in one or both sidewalls of a can top disclosed herein are not limited to rounded impressions. As an example, the impressions can be angled impressions that provide for more defined or sharper outer edges to better grip or bite into a groove cover inserted into such a groove. Additionally, the scale of the drawing and depth of the groove shown are not intended to be limiting.

The illustration in FIG. 21 shows that to install the groove ring, pressure is applied to the upper groove cover surface of the groove ring 300 causing the groove ring to be press-fit into the groove 230 of the can top 220. The material from which the groove ring 300 is manufactured, such as a semi-flexible plastic, rubber or resin material, can have a density and deformability characteristic allowing it to deform slightly during insertion. This deformability and the ability for the material to return to its general original shape allows the groove ring to be inserted once and then to conform thereafter to the shape of the sidewalls of the groove. By providing impressions, dents, notches or the like in one or both sidewalls of the groove (either continuously around the entire groove, or spaced at periodic intervals), the groove ring 300 can be affixed and secured into place quickly so as not to slow the top manufacturing process or the canning/bottling process.

Figure 22:
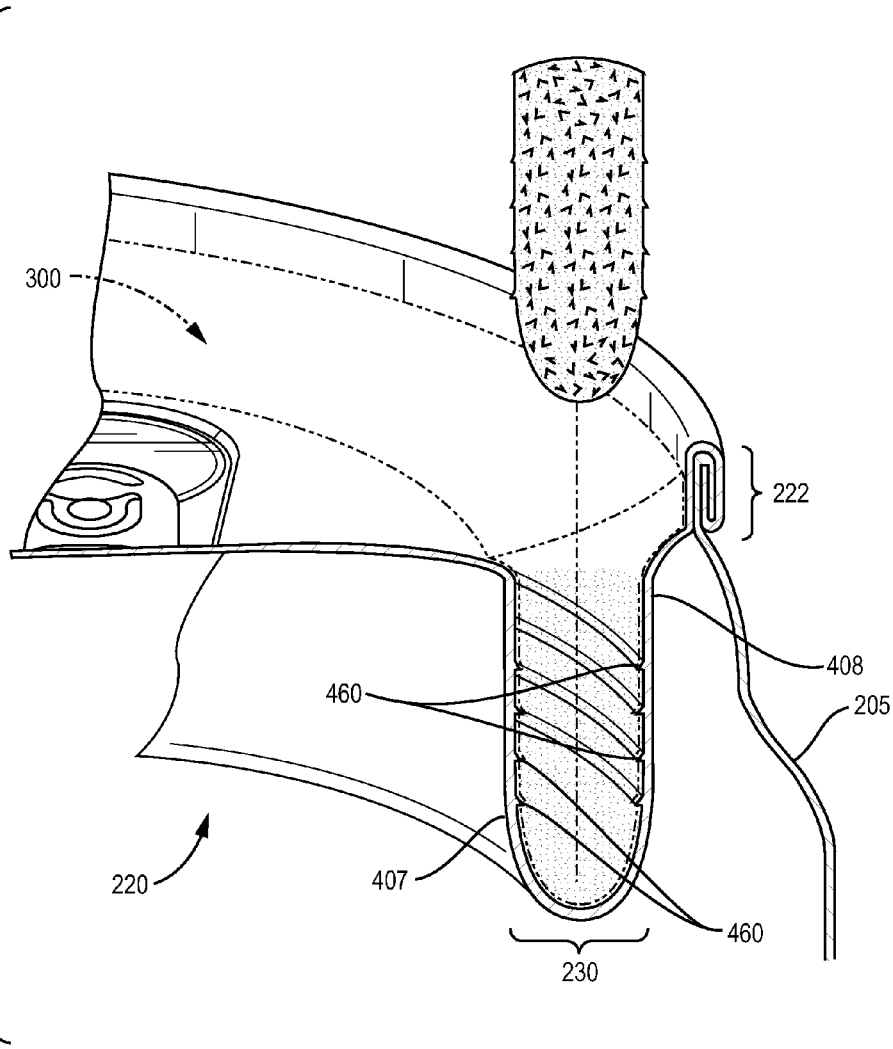
FIG. 22 shows a cross sectional or profile view of a can top and groove cover in accordance with one example embodiment that uses scored or knurled metal within one or both sidewalls of the can top groove to secure the groove cover to a can top.

FIG. 22 shows another example of a can top 220 that defines a groove 230 that has been configured with anchors 460 such as edges or teeth to maintain a groove cover 300 (shown in dotted lines) in place within the groove 230. In particular, in the example can top 220 shown in FIG. 22, the sidewalls of the groove have been scored, scratched, knurled, stamped or otherwise pressed or formed to create groove anchors 460 that can be sharp appendages, teeth, edges or barbs that stick outwards from one or both sidewalls (both in this example) of the groove. In this particular example, both the inner and outer sidewalls of the can top material (e.g. aluminum) that forms or defines the groove sidewalls are shaped to include one or more groove anchors that in these examples are downward pointing barbed edges. There may be more than one anchor 460 per sidewall, and the anchors 460 need not be continuous as illustrated. In the illustrated example, there are four anchors 460 that are formed as downward pointing edges on each sidewall. It is to be understood that four anchors is not intended to be limiting, and there may be any number of anchors per sidewall, or only anchors 460 on one sidewall but none, or a different number of anchors 460 on the other sidewall.

In the illustrated example the anchors 460 are continuous edges that run the length of the sidewall around the entire circumference of the groove 230. In other configuration, such anchors 460 are outcroppings of metal that are spaced periodically around one or both groove sidewalls. If the anchors 460 are quite short in length (i.e., they do not run the length of the groove), they may be short metal barbed teeth, fins or edges that are carved via a tooling or knurling process thus causing small portions of the metal from which the aluminum can top is formed to be shaped as shown in the figure (or as individual barbs). They can be quite small and short in length, or they may be longer edges. In other words, by disturbing the smoothness of the metal sidewalls within the groove 230, the sidewalls can be formed to provide a gripping action on the groove cover 300 thus maintaining it in place within the groove for the useful life of the can.

The purposes of these protruding anchor teeth or barbed edges 460 is to provide a groove sidewall surface that can grip and bite into groove cover material 300 that is pressed into the groove to 230 prevent removal of the groove cover 300 once inserted. The dotted line in FIG. 22 shows an example outline of how a groove cover (e.g. groove ring) would appear after installation into the groove. Note the anchors 460 are shown as existing within the groove 230, but it is to be understood that they could also be formed along the inside edge of the rim of the can top above the opening of the groove.

Figure 23A:
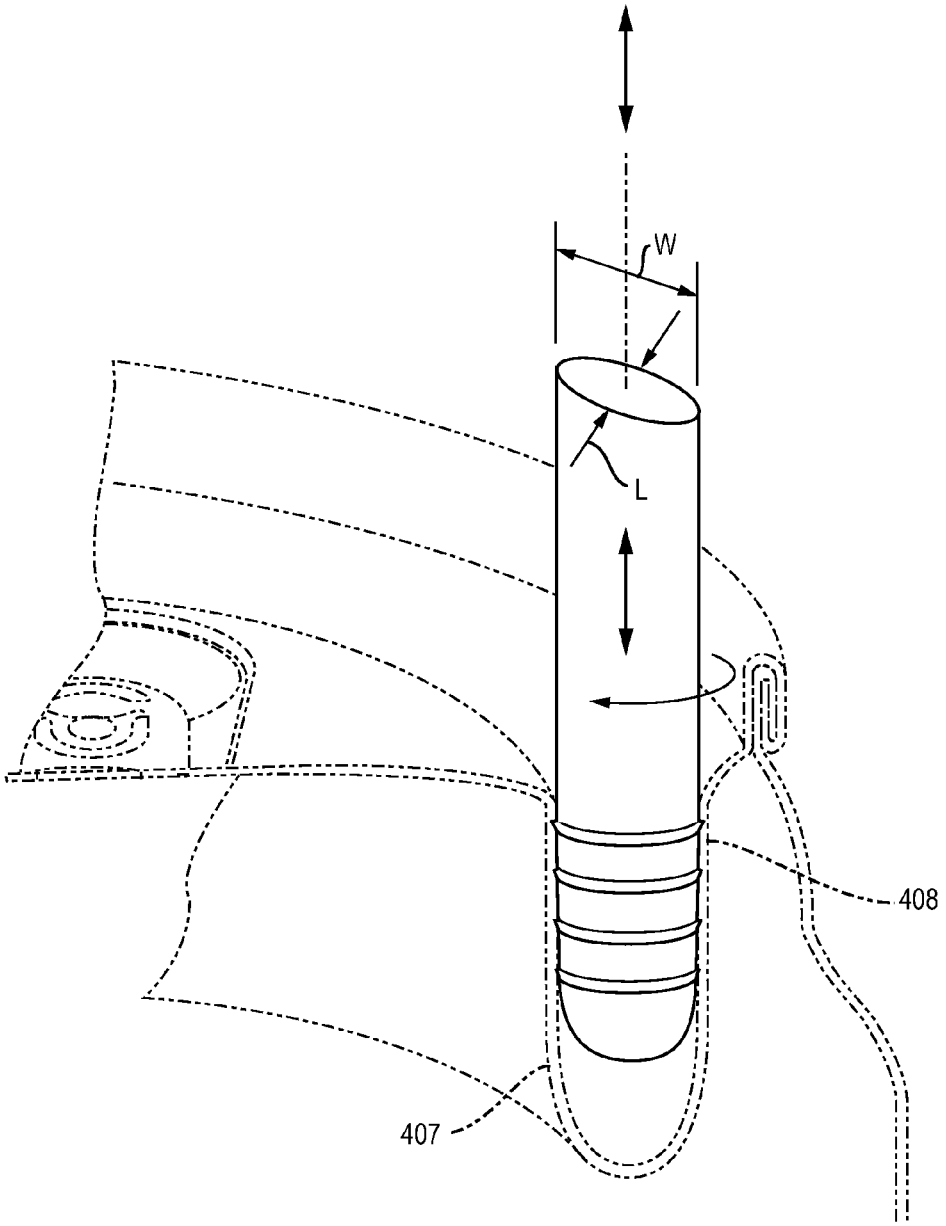
FIG. 23 shows an example of tooling of a groove of a can top to prepare the surface to receive and grip onto and secure a groove cover onto the can top.
Figure 23B:
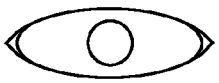

FIGS. 23A and 23B illustrate an example tooling, machining or can top forming technique to produce the protruding edges in the sidewalls of a beverage can top in accordance with one example embodiment. In this example, a hardened metal tool, such as a knurling tool, is sized to be lowered into place in the groove of a can top (this can be done just after can top formation, or after seaming of the can top to the can housing). Upon rotation of the tool, carving edges of the tool come into contact with the metal sidewalls 407, 408 of the can top that form the groove 230. Then either via rotation of the can top, or movement or rotation of the tool within and/or around the circumference of the groove on the can top, the metal protruding edges are carved, knurled or otherwise created or formed into the sidewalls of the can top groove 230. Note that the depth of carvings and the length of the protrusions are made small enough so as to not impact the integrity of the strength of the sidewalls of the can top and the groove cover material can be soft and pliable enough to be gripped securely by the edges 460.

FIG. 23B illustrates an example top view of the tool shown in FIG. 22A. This figures illustrates the elongated shaping of the tool which, when oriented in the vertical direction of the drawing, can be placed into the groove 230 defined in the can top 220. Then, once rotated, the tips of the cutting edges engage with the sidewalls of the groove 230. Once in contact, the can top can be rotated (or the can may be rotated if such edges 460 are formed after sealing the can top to the can housing). The cutting tool can be moved around the circumference of the groove in the can top to form the edges as illustrated in FIG. 22. This process can be performed very fast so as not to slow down the canning operation is performed just after seaming the can top to the can housing.

In an alternative configuration, can top formation techniques using pressing, drawing, bending, rolling, and stamping can provide for formation of a can top 220 that includes the addition of groove sidewall protrusions as generally described with respect the above can top configurations. Thus a can top containing sidewall protrusions on one or both sides of groove sidewall that are designed to secure a groove cover in place within the groove defined by the can top is considered an embodiment disclosed herein. Likewise, can top formation techniques and methods of crating can tops and groove covers and methods of securing the groove cover into the groove of a can top are considered embodiments disclosed herein.

Figure 24A:
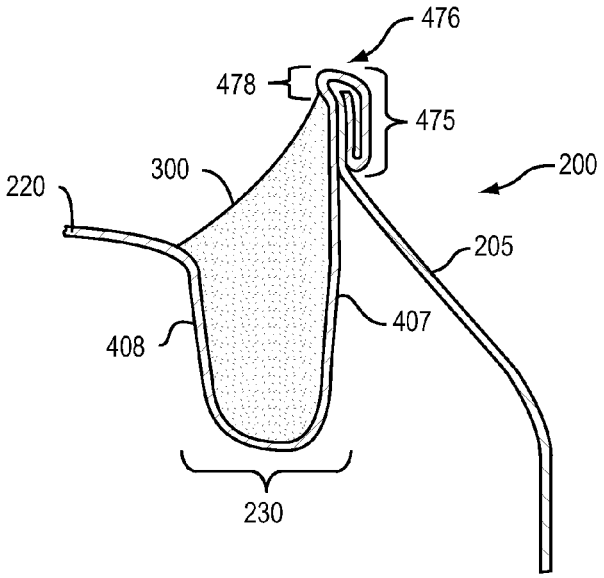
FIGS. 24A and 24B, 25, 26 and 27 show example cross sectional profiles of can tops and groove covers that can be secured to a can top by using a deformed rim of can.

FIG. 24A illustrates a side profile view (of only one side) of another configuration of a can top 220 seamed to a can housing 205 in accordance with an example embodiment. In FIG. 24A, to secure the groove cover 300 in place within the groove 230, the rim 475 formed by the can top 220 that is seamed to the can 205 is deformed and bent inwards slightly at its top to create a radially inward facing lip 476. This deformation or inward lip 476 can be formed at the time of sealing of the can top 220 to the can housing 205. In this configuration, the groove 230 does not require impression(s) within the groove sidewalls 407, 408 that define the groove in the can top in order to maintain the groove cover in place. Instead, in this configuration, the deformed rim with the inward facing lip 476 maintains the groove cover 300 in place.

In the configuration in FIG. 24A, the upper edge of the rim is formed to curl in or bend in towards the center of the can top forming a lip 476 on the rim. The innermost edge 478 of the lip 476 of the rim 475 has a diameter (relative to the center of the circular can top 220) that is less than a diameter of an inside edge of the rim located lower on the inside of the rim. In this manner, when a circular groove ring 300 is inserted into the groove (e.g. snapped, formed or rolled into place), the upper inwardly facing lip 476 maintains the groove cover 300 in place. As shaped, once the groove cover 300 is inserted into the groove and resides under this lip or edge 476/478, the groove cover 300 is secured in place and this can rim formation as shown prevents easy removal. The groove cover 300 can be installed during the canning/bottling process before package of the can 200 or alternatively, the can top may be sealed/seamed to the can housing, and the rim bent in the manner shown, the groove cover inserted thereafter. In all cases, this groove cover 300 is maintained in place before, during and after opening of the can by a consumer to dispense liquid contents of the can 200.

Figure 24B:
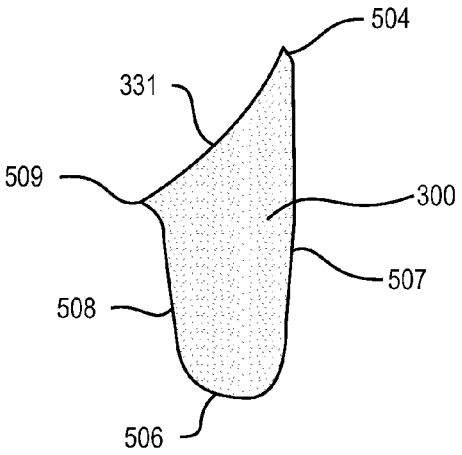

FIG. 24B shows one example cross sectional profile of a groove cover ring 300 that can be used with a can 200 and can top 220 such as that shown in FIG. 24A. As shown, the groove ring 300 in this configuration includes an outside wall 507 that resides, when installed in the groove 230, adjacent to the outer sidewall 407 of the groove 230. At or near the upper end of the outside wall 507, the groove ring 300 includes an inward taper 504 that resides, when fully installed onto the can top, under the inwardly bent upper edge 476 of the rim 475. The upper surface 331 of the groove cover 300 slopes inward and downward with a gentle concave curve towards the upper inside edge 414. This surface 331 promotes ease of wiping debris up and off of the can top. The body width of the groove cover can be sized so that the upper inside edge 414 of the upper groove cover surface 331 is pressed firmly and maintains a tight seal between its underside and the upper surface of the can top 220. Note that this inside upper groove cover surface edge 414 resides in between the openable section 224 of the can top 220 and the groove 230 and does not interfere with the opening the can to dispense liquid. When wiping the can top to clear any dirt, dust or debris that may be present, the debris is able to be wiped smoothly up over this edge 509 and up and across the gently curved upper groove cover surface 331 and over and off the deformed lip 476 of the rim 475 of the can top 220.

Figure 25:
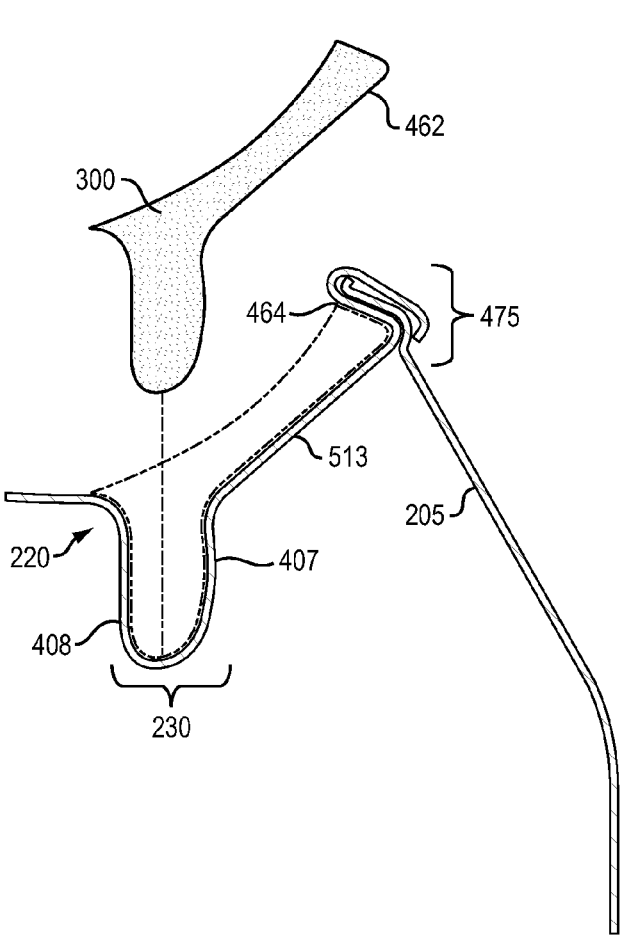

FIG. 25 shows another configuration of a groove cover 300 and can 200 and can top or lid 220 that is able to secure the groove filer 300 to the can top 220. In FIG. 25, the can top 220 is of a design that provides an upwardly sloping inside edge 513 that rises up and extends from a top of the outside sidewall 407 of the groove 230 towards the rim 475 of the can 200. In this example configuration, the rim 475 is also bent radially inward towards the center of the can top 220. Forming the rim 475 in this manner (or bending or rolling the rim 475 inwards after or during sealing the can top to the can housing) creates a groove cover pocket 464 that contains and secures an outer end 462 of the groove cover 300 once inserted into the groove 230. The un-inserted profile of the groove cover 300 is shown above the can top 220 in FIG. 25. The dotted line version of the groove cover 300 is also shown as it appears after insertion and installation into the groove 230 on the can top 220. Once inserted into the groove 230, the outer end 462 of the groove cover 300 resides within the groove cover pocket 464 formed by the rim 475 being bent or formed to deflect inwards towards the center of the can top 220. It is to be understood that the bent rim shown in FIG. 25 can be formed during the sealing/seaming process of attaching the can top 220 to the can housing 205, or can be done afterwards by a second rolling process that uses a chuck and roller (not shown in this figure) that provide this desired rim shape or configuration.

Like the discussion above with respect to the groove cover 300 in FIGS. 24A and 24B, the groove ring 300 shown in FIG. 25 can include a split allowing deformation of the circular shape of the groove cover during the insertion process. This allows the groove ring 300 to be compressed and made smaller in diameter to allow insertion into the groove and under the bent rim of the can top. Alternatively, the groove ring 300 in each of FIGS. 24A, 24B and 25 can be placed into the groove 230 prior to deformation or bending inwards of the rim 475 and the rim can then be bent to hold the groove cover in place.

Figure 26:
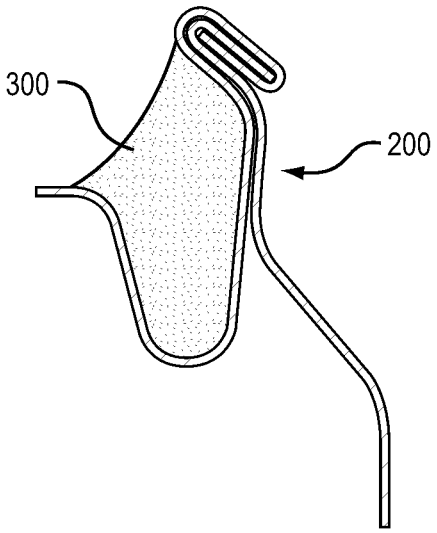

FIG. 26 shows a configuration of a can 200 that is similar to the can and can top configuration in FIG. 24A. However, in FIG. 26, the entire rim 475 of the can top is bent radially inwards towards the center of the can top (whereas in FIG. 24A, only an upper portion of the rim is bent, formed or deflect inwards). In FIG. 26, the bend causing the rim 475 to deflect or point inwards occurs at a location approximately where the aluminum can top material 220 meets or touches the aluminum can housing 205 (at the beginning of the double seam area). It is to be understood that method embodiments disclosed herein include creating this rim shape either during the seaming of the can top 220 to the can housing 205, or alternatively, the rim 475 can be deflected inwards via a second machining operation using a chuck and roller to bend the rim to be shaped as formed in any of FIGS. 24A, 25 and 26.

Figure 27:
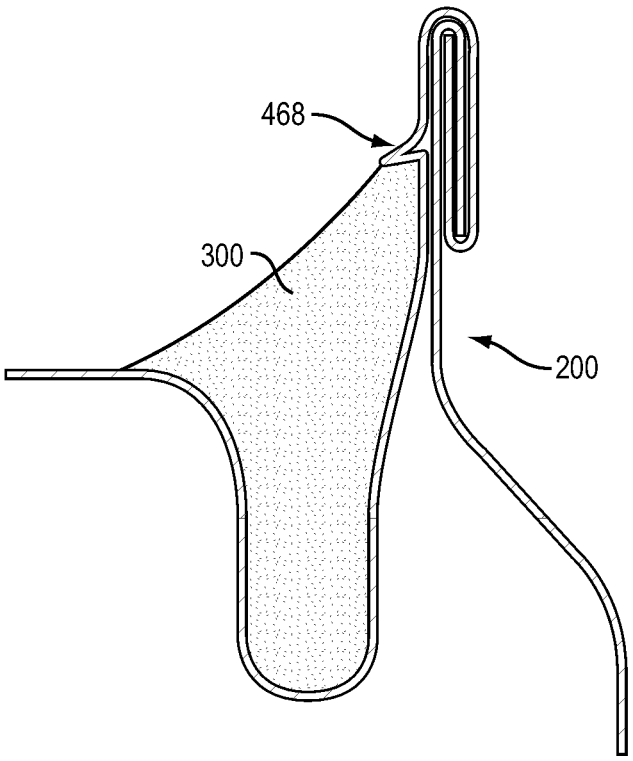

FIG. 27 shows an alternative configuration of a beverage can 200 that has a can top having an inner rim protrusion 468 formed in the rim of the can. The inner rim protrusion 468 is a slight deformation or outcropping of metal of the rim that forms an inner lip 468 that is below the top of the rim (i.e. resides along an inside sidewall of the rim of the can 200). This lip 468 can maintain the groove cover 300 in place within the groove 230. This protrusion 468 can be formed during the stamping or manufacture of the can top 220. Alternatively, this protrusion 468 can be formed (or accommodated for in the roller profile if already present in the newly stamped can top 220) when performing the rolling and seaming operation to seam the can top to the can housing.

It is also to be understood that the groove cover 300 in each of these embodiments can be placed or installed within the groove either after the rim is shaped as shown and described, or before such shaping, or during such shaping. That is, if the groove cover 300 is made of a material that suitably resists compression (i.e. is hard enough to not compress too much), the groove cover 300 can be placed into the groove as shown in FIGS. 24A, 25 and 26 and 27 prior to bending or shaping the rim in this manner, and then during the seaming process, or after seaming is complete but before the rim is bent or formed as shown, a chuck that fits into the can top (that is used in conjunction with rollers that form the double seamed rim 475) can be made to accommodate the presence of the groove cover while allowing the bending or shaping of the rim to take place.

In other example embodiments disclosed herein, the groove cover 300 provides a device that is a pre-formed material such as the groove ring embodiments discussed above to at least partially cover a ring-shaped countersink groove 230 disposed or formed within a drinkable end of a beverage can 200. The pre-formed material 300 includes a first surface configured to fit into at least a portion of the ring-shaped groove (the portion can include going all the way around the ring, and also can include going down into the entire depth, or it may extend down less than the entire depth of the countersink groove). The groove cover device 300 also includes a second surface configured to provide a span between at least an inner edge of the ring-shaped groove and an outer edge of the ring-shaped groove at the drinkable end of the beverage can. In one configuration, at least a portion of the inner edge near the openable section of the can top terminates at a location located on the central panel of the can top (the upper can top surface) that is in between the openable section (but not overlapping the openable section) and the upper inner edge of the groove. In this manner, the groove cover does not interfere with opening of the can, and as liquid is poured out from the openable section, the liquid flows over the groove cover and not into the groove (which is filled in or covered with the groove cover). In this manner, the pre-formed material 300 is configured to prevent beverage poured out of the beverage can from occupying the ring-shaped groove during consumption of the beverage by a consumer or when being poured into another container such as a glass or cup. In example configurations, the pre-formed material 300 is ring-shaped. When installed on the beverage can top, the pre-formed material includes or defines an opening through which to consume a beverage in the beverage can.

FIGS. 28 through 31 illustrate example configurations disclosed herein in which the groove cover 300 can be shaped as a preformed plastic, rubber or other material piece that operates as a device that snaps on or attaches over the rim 222 of the can top. In these configurations, the groove cover 300 does not require adhesive to remain in place on the can top, though such embodiments can include an adhesive for additional holding strength. In the examples shown in FIGS. 28 through 31, the groove cover material 300 may be somewhat flexible and is configured to pressably connect to an upper end, lid or can top 220 of a beverage can 200.

Figure 28:
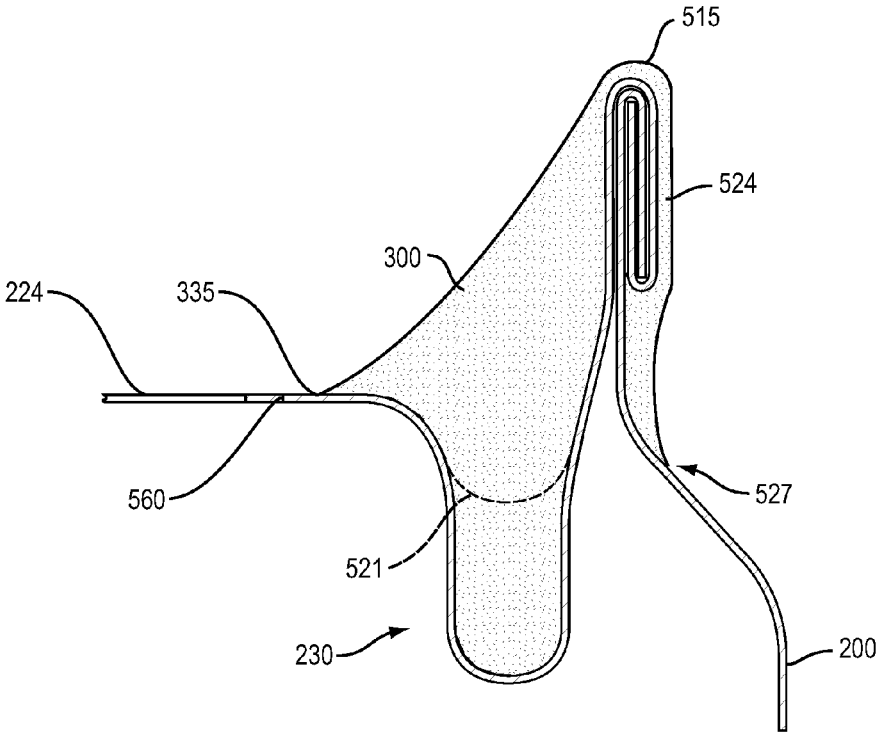
FIGS. 28 and 29A and 29B show an example cross sectional profile of a groove cover that can secure itself to a conventional rim of a conventional beverage can.
Figure 34:
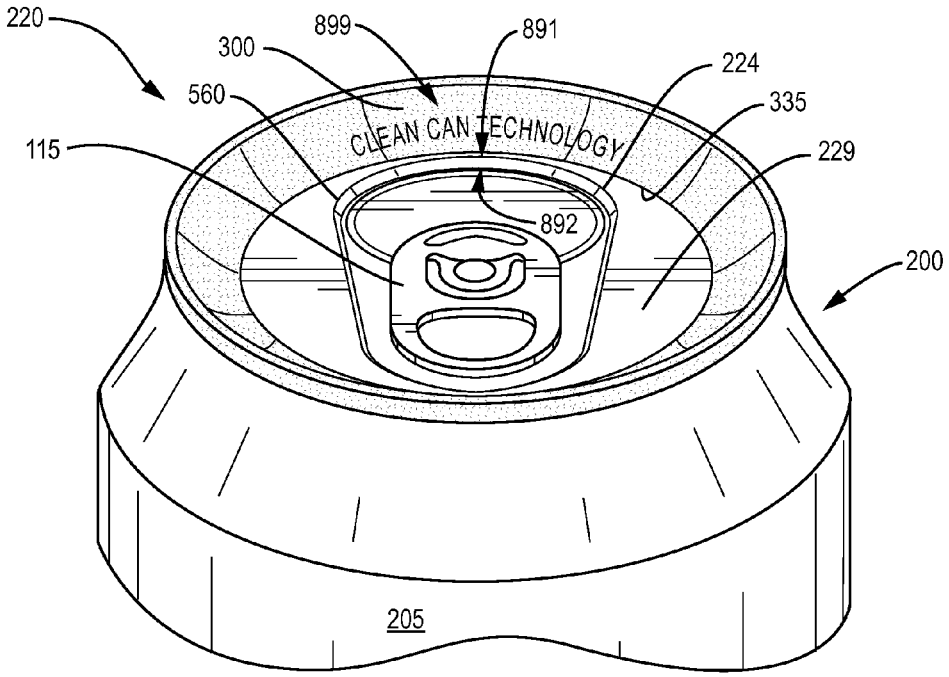
FIG. 34 show a view of the embodiments in FIGS. 28 and 29A and 29B as installed over the rim of a beverage can.

FIG. 28 illustrates a side profile or cross sectional profile of the groove cover 300 that operates as a groove cover attachment that covers the groove 230 and also extends up and over the rim of the can, and down the exterior sidewall of the rim, and secures along the rim groove at the underside the rim of the can where the rim intersects with the can body or housing. FIG. 34 illustrates a version of the embodiments in FIGS. 28 through 31 installed onto a beverage can.

Figure 29A:
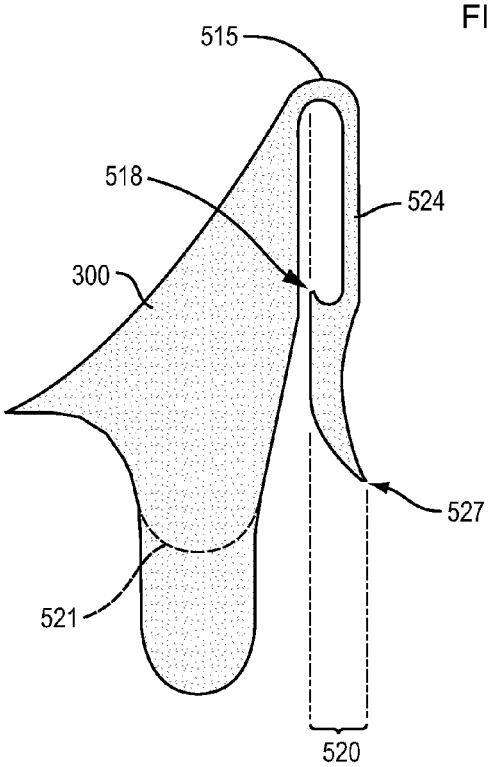

FIG. 29A shows the same groove cover attachment 300 but uncoupled from a beverage can. In such configurations, the groove cover 300 is referred to as a groove cover attachment 300 since it secures or attaches to the rim of the can. In the illustrated example in FIG. 28, the groove cover attachment 300 for the beverage can includes a groove covering section 514 that covers at least a portion of a countersink groove 230 defined in a can top. The groove covering section 514 prevents debris from entering the portion of the countersink groove that is covered (recalling earlier FIG. 12, the groove cover need not extend around the entire circumference of the groove 230). The groove cover attachment 300 further includes a rim connector section 524 that extends from the groove covering section 514 up and over a top and down an outside edge of the rim 222 of a can top. The rim connector section 524 is operable to secure the groove cover attachment 300 to the rim 222 of the beverage can Like the earlier embodiments, the groove cover attachment 300 illustrated in FIGS. 28, 29A and 29B covers and/or fills in the groove 230 of the beverage can to prevent debris from collecting in the groove 230 and provides an upper surface 331 having an inner edge 335 that terminates at an inner edge position 560 located on the upper surface 229 of the can top. The inner edge position 560 is located on an upper surface 229 of the can top somewhere inbetween an outside edge of the openable section 224 of the can top and a top inside edge region of the countersink groove 230 defined in the can top. That is, the groove covering section 514 has an inside edge 335 that contacts the upper can top surface 12 29 in between the groove 230 in the openable section 224 of the can top thus not interfering with opening of the openable action in 224 when a consumer opens the can to dispense liquid from the can. In this manner, the groove cover 300 is able to be secured to the can 200 by attaching to the rim 222 and prevents debris from entering the groove 230 while at the same time providing or defining a central opening defined by the inside edge 335 that does not interfere with the openable section 224 of the can top. The inside edge 335 remains pressed against the upper can top surface 229 and allows liquid is poured from the openable section 224 and flow up and over the upper groove cover surface 331 and off of the top 515 of the groove cover attachment 300.

In the example embodiments shown in FIGS. 28 through 31 (and for FIGS. 34 and 35), the inside edge 335 of the groove cover material 300 is maintained in a state of pressure, or with a downward force or compression, against the upper can top surface 229 by spring like action of the connection between the groove covering section 514 and the rim connector section 524. This is, upon manufacture of the groove cover 300, there can be a slight bias built into the device 300 to cause the groove covering section 514 to be bias or spring loaded towards the rim connector section 524. As an example, if this bias were great enough, rim connector tip 518 shown in FIG. 29A may come onto contact with the backside surface of the groove covering section 514. In this manner, when the device 300 is placed on the rim of the can, its natural tendency or bias is to hug or grip the rim and provide a downward spring like pressure of the inside edge 335 against the upper can top surface 229 of the can top.

Figure 29B:
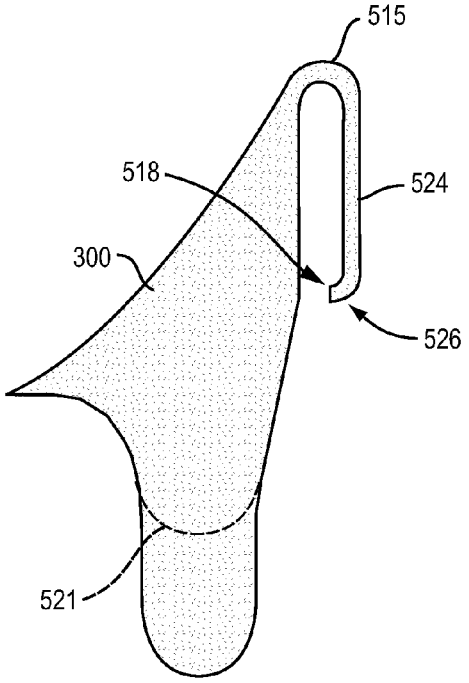

FIG. 29B shows that the groove cover attachment 300 provides a rim connector tip 518 that couples to the rim groove formed on the underside of the exterior of the rim 222 of the can top 220. Since the groove covering section 514 and the rim connector section 524 are coupled to form an integral device that covers the rim, the lower portion of the groove covering section 514 resides within the groove 230, while the rim connector section 524 wraps around the top and outside edge of the rim 222 and secures with the rim connector tip fitting into the rim groove formed where the rim 222 and can housing 205 intersect. The inside surface of the groove covering section 514 that faces the inside surface of the rim 222 (inside with respect to the center of the can top) and the inside surface of the rim connector section 524 that faces the outside surface of the rim 222 define a rim cavity into which the rim 222 of the beverage can fits. In this manner, the groove cover attachment 300 snaps over and covers a rim of the beverage can and is held in place with the rim connector tip 518.

Note that depending upon the embodiment, the amount or volume of the groove covering section 514 material that actually is present and fills-in or occupies the groove 230 can vary. In some embodiments, the groove covering section 514 can be a thin layer that does not actually enter the groove 230 defined in the can top at all. As an example, in one configuration, at its thickest part, the total thickness of the groove covering section 514 from the upper groove cover surface 331 to the underside is about the thickness of a coin (e.g. about 1 millimeter). However, as illustrated in FIGS. 28 and 29A and 29B, the groove cover material 300 enters into and occupies some portion of the groove 230. In one configuration, the groove cover material 300 extends all the way to the bottom of the groove 230. In other configurations, the material of the groove covering section 514 extends only partway into the groove 230, as shown at dotted line 512 in FIGS. 28, 29A and 29B.

In FIGS. 28, 29A and 29B, the groove cover 300 is an integral cover that is circular in shape and the rim connector section 524 is operable to be flexible enough to deform slightly when pressed against the top of the rim 222 of the beverage can 200 to allow the rim connector section 524 to stretch around and pass over the exterior side of the rim 222 of the beverage can while an inside surface of the groove covering section 514 resides against an inside edge of the rim 222 of the beverage can 200. In this manner, the circular shaped groove cover 300 can be stretchably fit over the rim of the can and snaps into place. In example embodiments, the groove cover attachment 300 is an integral cover that is ring shaped (e.g. a circle) and fits over the rim and groove area of a beverage can. A diameter of a center of the rim cavity defined in the integral cover is substantially the same as a diameter of a centerline of a rim of the beverage can. That is, the radius, as measured from the center of the can top 220 to the center of the rim, is the same as the radius of the ring shaped groove cover attachment 300 as measured from the center of its ring shape out to the rim cavity defined by the space between the rim connector section 524 and the groove covering section 514.

In some embodiments, the ring shaped groove cover attachment 300 includes a cutaway or break in its circumference. In such embodiments, the groove cover attachment 300 is not a complete circle, but rather includes a first end and a second end (much like the embodiment shown and described in FIG. 19D). The first and second ends define a break in the ring shape between the first end and the second end. The break allows deformation of the integral cover 300 to allow fitting over a rim of a beverage can during installation. In one installation method, the first end is pressed in place over one section of the rim of the beverage can top, and as this first end snaps or comes to rest in place, a device (e.g. a part of an installation machine, or a persons finger) can continue to apply pressure to the top 515 of the groove cover attachment 300 and can slide along this top surface 515 as more and more of the groove cover attachment snaps into place over the beverage can rim.

In one configuration, the upper surface 331 slopes upward in a direction from the upper surface 229 of the can top towards the top of the rim 222 of the can top, thus providing a surface 331 over which debris wiped from the can top can slide up and over the rim 222 of the can top to be removed from the can top 220. In one configuration, the upper surface 331 slopes upward from the upper can top surface 229 towards the top of the rim of the can top in a concave profile.

As shown in the configuration in FIG. 29B, the rim connector section 524 extends under an exterior side 526 of the rim of the beverage can and hooks (via rim connector tip 518) onto a rim groove defined at the intersection of the rim of the can top and the beverage can housing. In the illustration in FIG. 29A, the rim connector section 524 extends below the rim of the beverage can and includes a lower tail section 527 that tapers to a point and lays flat against the exterior top sidewall of the beverage can housing. That is, the lower exterior section of the rim connector section 524 tapers to a lower edge that resides flush against the can housing. Note that the exterior end or tail section 527 can extend further down the side of can housing to provide a surface that is cleaner to drink from and that covers the can housing where a person's mount would normally contact the can.

The configuration in FIG. 29B can be used with six pack carriers that stretch over the top of the beverage can and hook onto the underside of the time of the beverage can. Six pack carriers can also work with the version shown in FIG. 29A, and a notch could be provided somewhere along the exterior curved surface that extends upwards from the lower tail section 527 to grip onto such a six pack holder.

Also note that the embodiments shown in FIGS. 28, 29A and 29B allow for stacking of the beverage cans. Additionally, the top section 515 of the groove cover attachments can have a slight bevel or recess to accommodate the bottom of a beverage can stacked on its top surface 515.

It is to be understood that while the embodiments in FIGS. 28, 29A, 29B are described as having the rim connector section being a continuous ring around the entire periphery of the rim 222 of the can, other embodiments can allow for segments of fingers in the shape of the profiles shown in these Figures to extend over only certain segments of the rim of the can. Looking ahead briefly again to FIG. 34, this figure shows the top 515 and rim connecting section 524 to be a continuous circle around the entire rim. In another configuration, the rim connecting section can be a series of disconnected sections, each appearing as a finger-like appendage extending from the groove covering section 514 and extending up and over the rim. A configuration in this manner provides a more visually striking appearance. For example, consider an embodiment where there are rim connecting extensions 524 having the profile as that shown in FIG. 28 every one-half inch around the rim, followed by no groove cover material so that the next one-half inch of the rim is open, uncovered and exposed. Depending upon the color of the groove cover material selected, this can provide a striking contrast to the shinny silver metallic color of the beverage can rim.

Likewise, if the groove cover attachment 300 is made of material that is impregnated with a temperature sensitive material that changes color, for example, if the can is cold, the appearance of the groove cover attachment can change color based on the temperature of the can.

Figure 30:
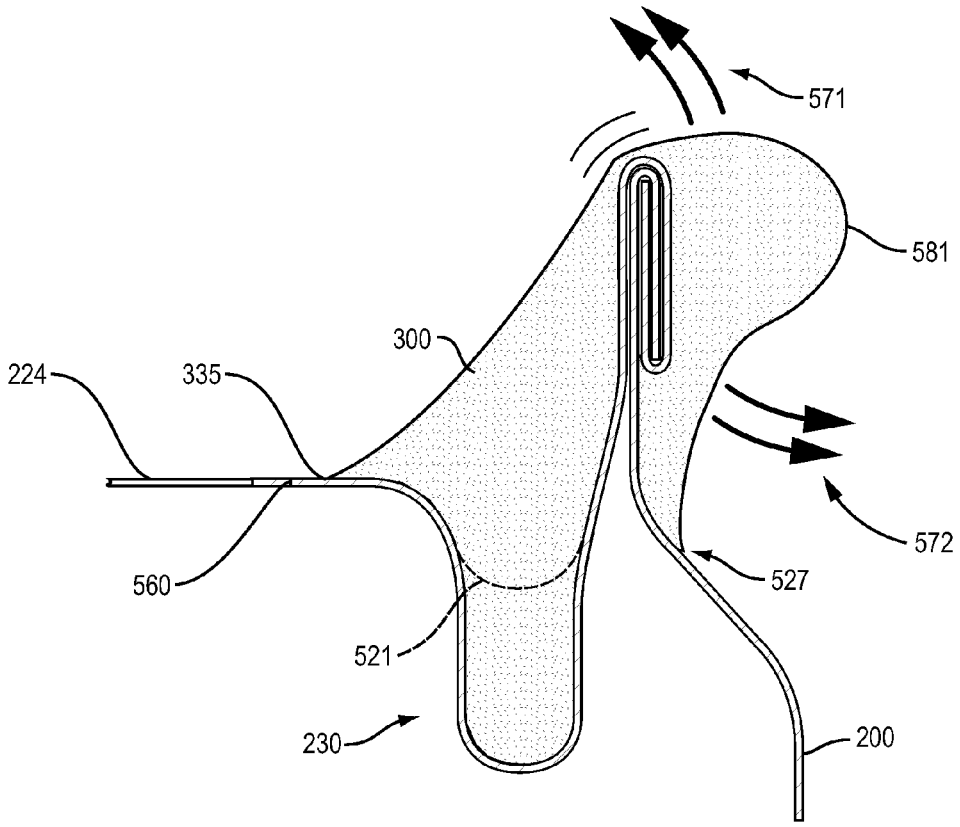
FIGS. 30 and 31 show an example cross sectional profile of a groove cover including a removing tab or handle that can be placed onto and removed off of a conventional rim of a conventional beverage can.
Figure 31:
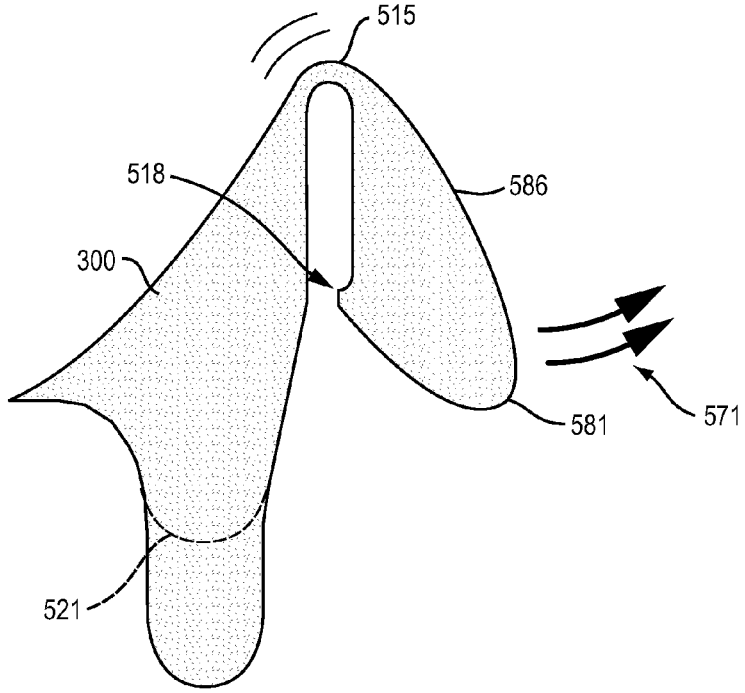
Figure 32:
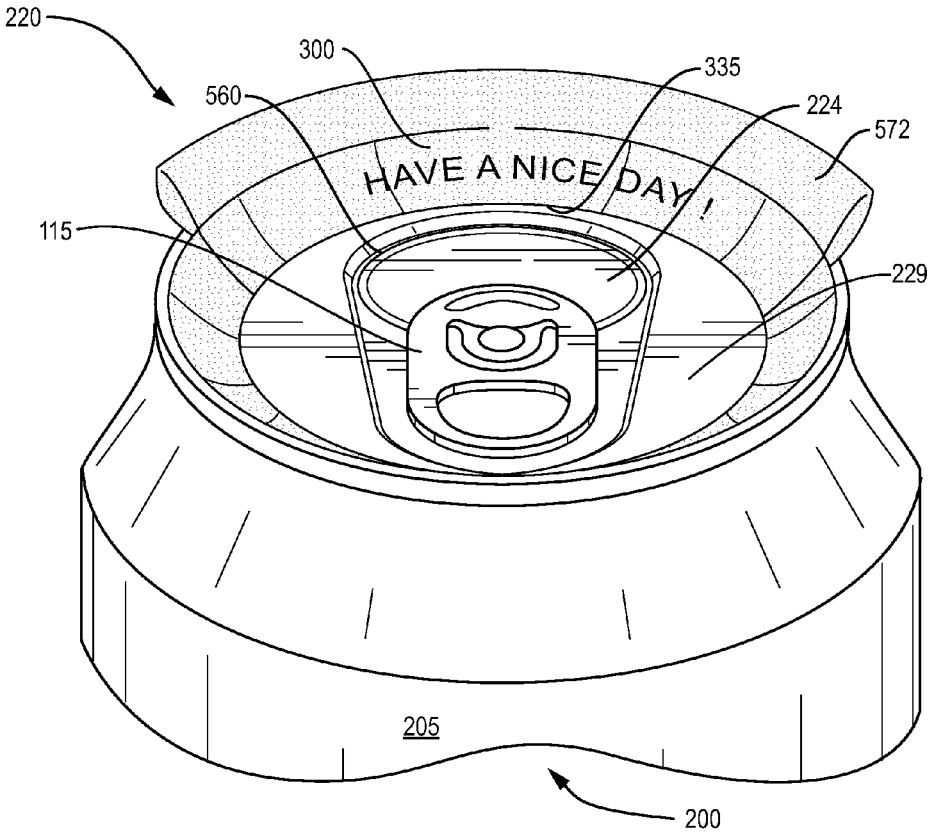
FIG. 32 shows a configuration of a groove cover having a removing tab allowing removal of the groove cover from covering the groove ring.

FIGS. 30 through 32 illustrate embodiments that allow easy removing of the groove cover or cover 300 by providing a removing tab 581 coupled to at least one of the grove covering section (FIG. 32) and/or the rim covering section (FIGS. 30 and 31). The removing tab 581 is operable to remove the groove cover attachment 300 from the rim 222 (ore the can top in FIG. 32) of the beverage can 200.

In particular, in FIG. 30, the removing tab extends outward from the rim covering section of the groove cover attachment 300. In this manner, a person can place his or her fingers on the underside of the removing tab 581 and by providing upward lifting force in the direction shown by arrows 571, the lower region 527 of the rim covering section will pull away from the sidewall and outside edge of the rim 222 of the can 200 in the direction of arrows 572, thus allowing the rim cavity that encapsulates the rim 222 of the can to expand a bit. This action causes the rim connector tip area 518 to pull out form under the rim or the can and allows peeling off of and removal of the groove cover 300 from the rim of the can. If the groove cover attachment 300 is made of a durable material such as plastic, non-toxic rubber, silicone, or other material, the device 300 can be placed onto and be removed from numerous different beverage cans prior to opening and/or prior to liquid being poured form the cans. In this manner, the embodiments with removing tabs allow reuse of the groove cover device 300. It is to be understood that most earlier described embodiments can be configured with a removing tab to allow removal and/or reuse of the device 300 in this manner. Ease of removal may also be useful in situations where the can 200 is to be recycled, but the groove cover 300 is not to be recycled in the same manner as the can 200.

In FIG. 31, the removal tab is disposed at a downward angle from the exterior of the rim 222 of the can top and removal of the groove cover attachment 300 can be accomplished by gentle lifting in the direction of the arrows 571, again causing the rim cavity defined by the groove covering section 514 and the rim connector section (which is now part of the removal tab 586) to expand slightly and be lifted off of the rim of the can. Likewise, when placing the groove cover attachment 300 shown in FIG. 30 or 31 onto a can top (i.e. over the rim 222), the removal tab 581 can be used to increase the size of the rim cavity defined by the groove cover attachment 300 to allow it to easily slip onto the rim 222.

Also as shown in the embodiments illustrated in FIGS. 28 through 31, it is to be understood that the amount and depth to which the groove cover material 300 extends into the actual groove 230 can assist in maintaining the inside edge 335 flush against the top surface of the can top. That is, as shown in these figures, the groove cover material 300 extends all the way to the bottom of the groove. In this configuration, since the groove cover extends down deep into the groove, it would be difficult to lift or pry up the edge 335 from the can top surface. Likewise, if the groove cover material 300 extends to a depth that is substantially shown as that by line 521 (about ⅓ into the depth of the groove), this portion of groove cover material 300 that exists with the groove definition also prevents lifting of the upper groove cover surface 331 (and hence prevents lifting of the inside edge 335) from the surface of the can top.

FIG. 32 illustrates a configuration discussed above in with a handle, or removal tab, extends from the groove cover 300 that is configured without the wrap around rim connector section as described in the embodiments in FIGS. 28 through 31. That is, the embodiment in FIG. 32 is much like that shown in FIG. 8 (and described in many other areas of this disclosure), but for the handle or removal tab 581 that allows easy removal of the groove cover 300 from the can top 220.

Figure 33:
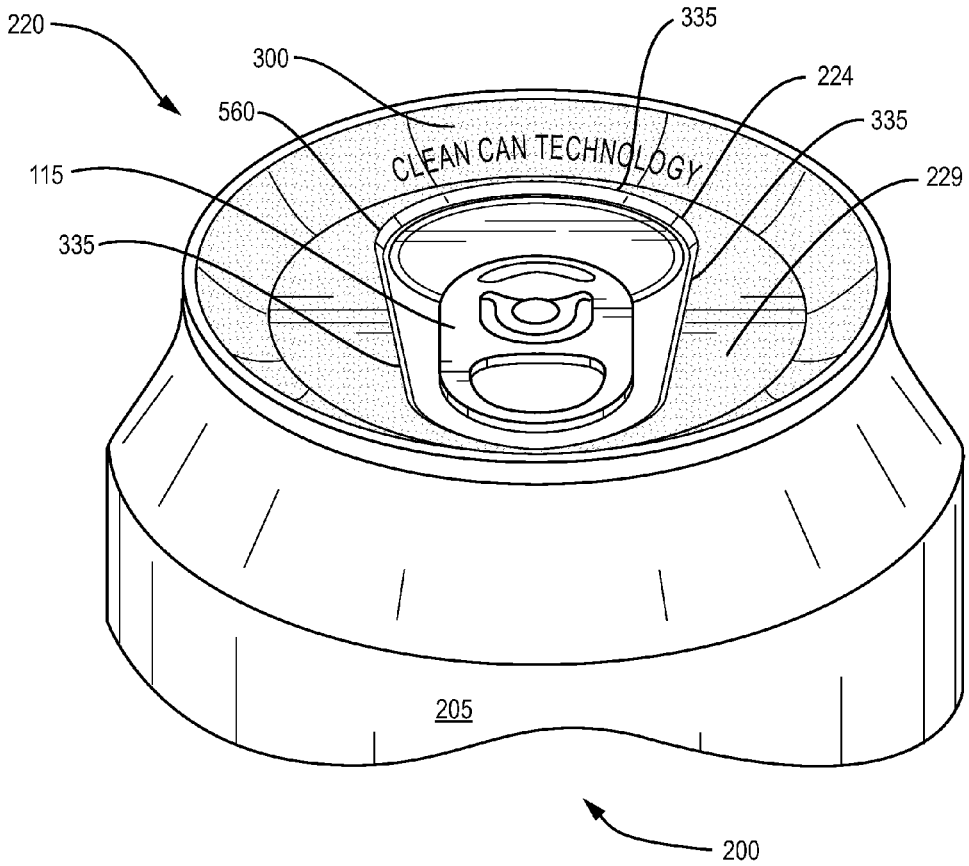
FIG. 33 shows an example configuration of a groove cover that extends onto various regions of the upper can top surface.

FIG. 33 shows an alternative embodiment in which the groove cover material 300 extends out onto certain areas of the upper can top surface 229 and has an inside edge 335 that terminates prior to covering the openable section 224 of the can top. In many conventional can top designs, the openable section as well as the tab connecting region of the can top are provided for within a sunken or slightly lowered section of the can top. As shown in FIG. 33, the inside edge 335 provides of defines an opening or hole in the groove cover that, upon installation onto the can top, can be aligned with the openable section 224 to allow liquid from the openable section to be poured through the opening in the groove cover. As in previous embodiments, the groove cover 300 needs no interaction with the user and is installed on, and remains on the can top before, during and after opening of the can and during pouring of the beverage from the can.

In this example embodiment, the groove cover material 300 can continue onto and over regions of the upper can top surface 229 that includes areas up to this lowered section. In this example can top design, the lowered region is illustrated as a oval section having a large oval end to accommodate the openable section 224 of the can top and a narrower oval section at the opposite end into which the can tab 115 resides. One purpose for the groove material extending onto these other areas of the can top is that the groove cover material 300 can include marketing or advertising message embossed or printed on its surface, thus providing a larger surface area that can be decorated in this manner. Note that in this example embodiment, the groove cover material 300 does not cover the openable section of the can and does not interfere with opening of the openable section via operation of stay tab 115.

As noted above, in FIG. 33 the stay tab 115 and openable section 229 are placed on the can top within a slightly depressed or recessed area 625 of the upper surface 229 of the can top 220. This recessed area 625 includes the openable section 224 of the can top 220 as well as a region for placement of the stay tab 115. The recessed area 625 is shown, in this example can configuration, as an oval slightly teardropped shaped recessed area 625 on the can top 220. In some other beverage can configurations such as that shown in FIG. 33, the groove cover material 300 extends from the inside edge of the rim of the can, over the groove, and out onto the upper surface 229 of the can top but has an inside edge 335 that terminates at or near the edge 625 of the recess upon which openable section 224 is defined and upon which the tab 115 is attached. That is, the inside edge 335 of the groove cover in this example terminates just before the recess 625 area begins. In other embodiments, the groove cover material 300 can extend down into the recess 625 but can end or terminate before covering or extending over the openable section 224, or before interfering with or passing under the tab 115. In this manner, the inside edge 335 of the groove cover material 300 extends out onto the upper surface 229 of the can top a bit more that is illustrated certain other embodiments and provides an opening shaped substantially like that of the openable section and that outlines the perimeter of the openable section 224. The upper surface 331 provides a substantially large surface upon which logos, trademarks, brand names, etc of the beverage or other information may be embossed, printed, etc. Depending upon the embodiments, some or all of the recessed area 625 can be covered with the groove cover 300, but the openable section can remain uncovered. That is, other embodiments allow for the groove filer material to extend out onto the can top upper surface 229 as a thin layer, and continue down into the recess area 625 and reside under the tab 115, but terminate before just the openable section 224, again providing a substantially large amount of upper surface area upon which marketing material may be placed. That is, in some embodiments, the groove cover material covers the entire surface of the can top (inside the rim) except the openable section 224. Since the openable section 224 is not covered by the groove cover material 300, the groove cover material 300 does not need to account for or interfere with opening of the openable section 224. In embodiments that include antimicrobial growth inhibitors, this provides for a large amount of surface area of the can top that is more resistant to bacterial contamination.

FIG. 34 illustrates an example version of the embodiments in FIGS. 28 through 31 installed onto a beverage can. As shown, the inside edge 335 in this example defines a circular opening that presses against the top of the upper can top surface 229. In this example, the circle defined by the inside edge 335 of the groove cover has a groove cover inside edge radius that is larger than a openable section radius as measured from the center of the can top to the outermost edge of the openable section 224 of the can top, but that is less than a grove radius as measured from the center of the can top to the center of the groove 230. In this example, this edge 335 resides in between the openable section and the top of the groove 230. That is, the inside edge 335 of the central opening lies or terminates at a position 887 that resides somewhere in between the far edge 892 of the openable section 224 (the far edge 892 being that farthest or outermost edge of the openable section 224 as measured from the center of the can) and a top inside edge of the groove 230. In example beverage can tops 220 where the tab 115 and the openable section 224 are provided for within a slightly recessed area defined by edge 560 in FIG. 34, the inside edge 335 of the material 300 can reside just to the outside of the upper edge 891 of this recessed area. In this manner, the groove cover 300 provides an attractive can top by covering, overlaying or spanning the groove 230 and provides a smooth curved banked surface (in this example) that provides a nice transition from the upper can top surface 229 up onto the groove cover to allow easy wiping of debris across, up and then off of the can top 220. The upper groove cover surface 331 also provide a very visible platform or surface upon which a message 899 (e.g. marketing message or brand name) can be printed, stamped, countersunk or embossed (or that may be embedded within the groove cover material) on the surface 331. This can include providing a message on the outside surface 524 that is outside and below the top of the 222 of the can 200. In other embodiments, the message 899 may be any picture, symbol, trademark, emblem, sticker, or other visible image applied to the surface 331. It is important to note that since in many example embodiments disclosed herein, the groove cover material 300 does not simply cover the groove, but extends upwards along the inside of the rim. This upper surface 331 provides a substantially larger surface area upon which the message 899 or other information may be provided, printed, etc as compared to a configuration such as that shown in FIG. 5. That is, since the upper surface 331 slopes upwards from the inside edge 335 on a slope, bank or angle towards the top 515 of the rim (which in these examples, the upper surface 331 extends up and over and down the outside of the rim of the can), a large amount of real estate is provided to include a branding message 899. Example uses of this surface include messages to present a brand to consumers of the beverage when those viewers are viewing just the top of the beverage can. Other examples include using the surface to promote contests, events (sporting events, holidays, etc) and the like.

Figure 35A:
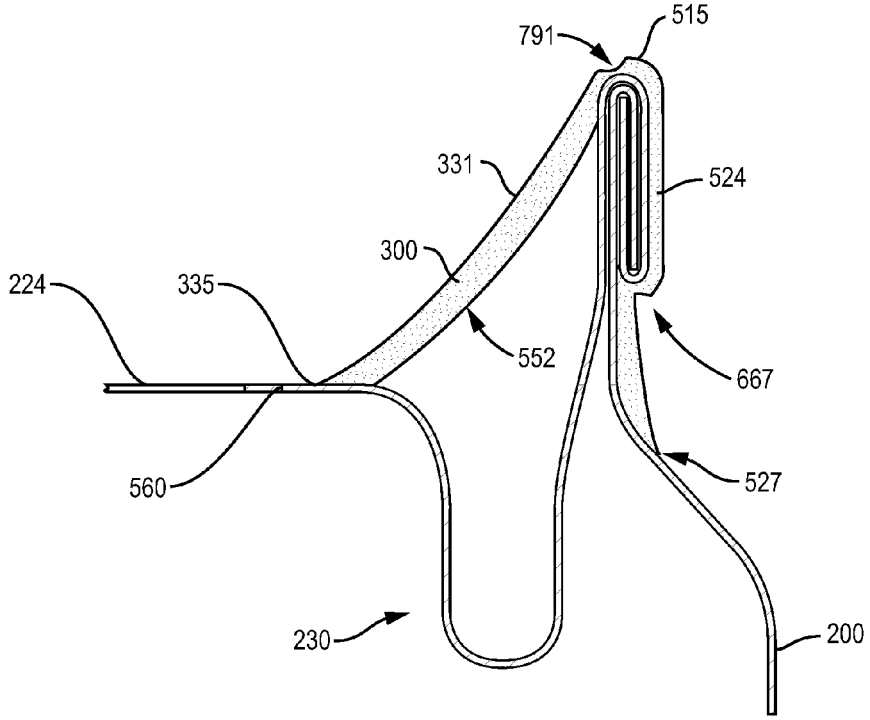
FIG. 35A shows a side profile view of a groove cover that is similar to that of the embodiments in FIGS. 28 and 29A and 29B but that does not provide groove cover material that extends down into the groove defined in the can top.

FIG. 35 illustrates an alternative embodiment to those such as shown in FIGS. 28 through 31 in which the groove cover material 300 does not enter into the groove 230 defined in the can top. In other words, the material 300 is not a groove filler at all (since it does not actually fill in or even enter into the spaced that defines the groove), but rather extends from a region just outside of the outermost edge. This embodiment uses less material when being manufactured and therefore can be less expensive to produce. In this example, the groove cover attachment only covers and does not fill-in or enter the groove 230. That is, in this example shown in FIG. 35 the groove covering section 514 is substantially the same thickness over the groove as measured from the upper groove cover surface 331 at the center of the groove to a lower groove cover surface 888. Stated differently, portions (other than the inside edge 335 and the top area 515) of the upper groove cover surface 331 and lower groove cover surface 522 are somewhat parallel and define a substantially uniform thickness and the groove cover material need not enter the groove 230. In other configurations, the portion of the material 300 in between the top 515 of the rim 222 and the openable section 224 can taper. Additionally as show in the example in FIG. 35, the top area 515 of the rim can include a bevel or notch 791 to accommodate the underside of a beverage can that may be stacked above the can on the rim. In this manner, even though the rim is covered with the rim connecting section 524, the upper surface or top 515 of this rim connecting section can be profiled to receive or conform to the base or bottom of another can stacked on top of the can containing the device 300. Likewise in this example embodiments, the exterior lower portion of the rim connecting section 524 includes a six pack carrier notch 667 that can receive and hold onto a stretched six pack carrier that is stretched over the top of the can (and hence around the covered rim) in order to carry a six pack (or more) of beverage cans.

Thus in example configurations, at least one of the rim connecting section 524 and the skirt edge 527 define carrier notch 667 that extends around the circumference of the device. The carrier notch provides an interface to allow multi-can carriers to hold onto and carry the weight of the beverage can during transport.

Using the above description of various embodiments of a groove cover or cover used to cover or fill in the countersink groove in a can top, the following description provides examples of processes and/or methods for insertion of the groove cover into the groove of the can top 220.

There are various methods of installing a groove ring 300 into the groove 230 in the can top 220 in the configuration of a can 200 as shown in the above examples. In one method, the groove cover 300 may be a groove ring including a split (e.g., like the split 430 in the ring in FIG. 19D). The split or break in the ring allows the groove ring 300 to be deformed (e.g. increase or decrease in diameter) and/or compressed during installation. If the installation is a press fit as could be used in the configuration shown in FIG. 24A, the split 430 (FIG. 19) can allow the ring to be made a bit smaller in diameter during the operation of press fitting the ring 300 into the groove in order to be able to pass through the smaller diameter inside edge 478 of the rim 475 caused by the inward facing lip 476.

Alternatively, a split in the ring can allow pressing of one end (on one side of the split) of the groove cover 300 into the groove and working around the circumference of the groove continually pressing the groove ring 300 into the groove under the lip 476. Since the groove ring 300 can be made of somewhat flexible material, the split allows temporary deformation of the groove ring 300 slightly during this installation process and the ring 300 can return to its normal profile as shown in FIG. 24B once installed in the groove 230. A rubber wheel or roller rolling around the circumference of the top of the rim of the can may be used, by way of example, to press fit the material 300 in place onto the rim 222.

The disclosure provided herein further provides methods of applying the groove cover to any of the types of beverage can or can tops as disclosed herein, as well as methods of creating or forming (i.e. shaping) can tops or lids (can ends) that have been adapted to secure a groove ring in place, as well as methods for application of the groove cover to such lids containing such adaptations. Other embodiments include a mold for forming the material into the shapes disclosed herein. An example would be a mold used by an injection molding machine that defines a shape of the material 300 as shown herein and that can receive hot molten material such as plastic that is injected into the mold and that thereafter hardens to form the shape(s) of the groove cover 300 as shown herein. Various methods are disclosed that allow application of the groove cover 230 into the groove 230 of a can top 220 either before can seaming is performed, or during the can seaming operation, or after can seaming is complete.

In particular, it is to be understood that depending upon the embodiment, the groove cover 300 can be applied during a can top manufacturing process so that the can tops 220 are shipped or supplied to the canning seaming machinery (i.e. supplied of the bottling process equipment) with the groove cover 300 already installed on the can top 220 within the groove 230.

Figure 2:
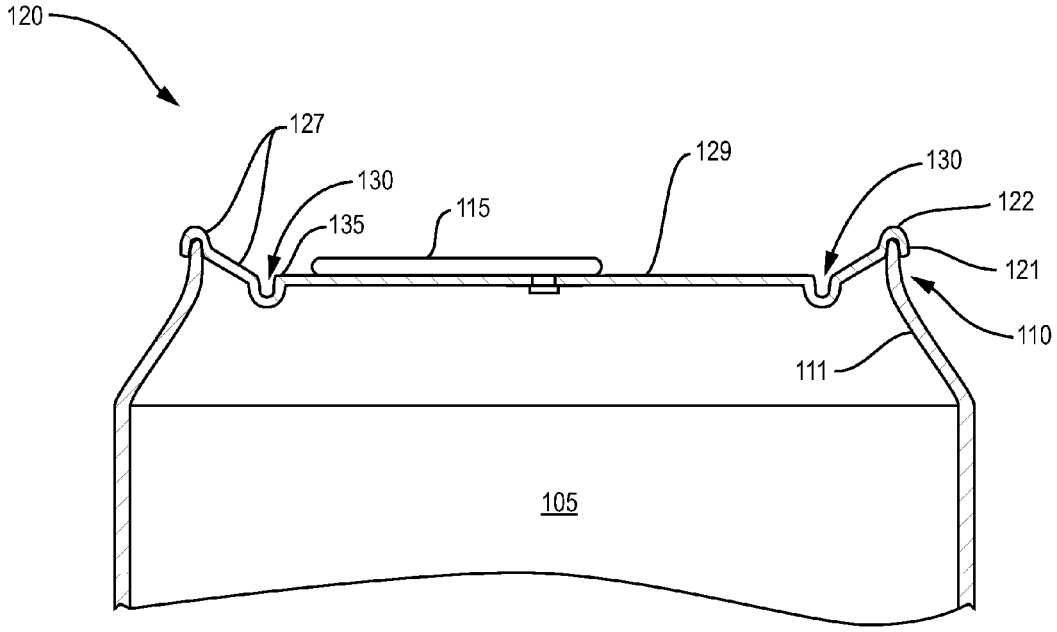
FIG. 2 (PRIOR ART)
FIG. 2 illustrates an example cross sectional view of a can top of a conventional beverage can.

A conventional double seaming operation and examples of shapes and cross sectional profiles of conventional beverage can tops are described, by way of example, in U.S. Pat. No. 7,100,789 (hereinafter the '789 patent), the entire contents of which is hereby incorporated by reference in its entirety. In the '789 patent, a seaming chuck 28 as shown in various figures (e.g. FIGS. 1 and 2) in that referenced issued patent includes a lower end with finger like appendages that extend into the countersink groove formed by the shaped of the can top. The groove is generally formed by the can top material at locations 12, 16 and a portion of reference numeral 6.

Figure 35B:
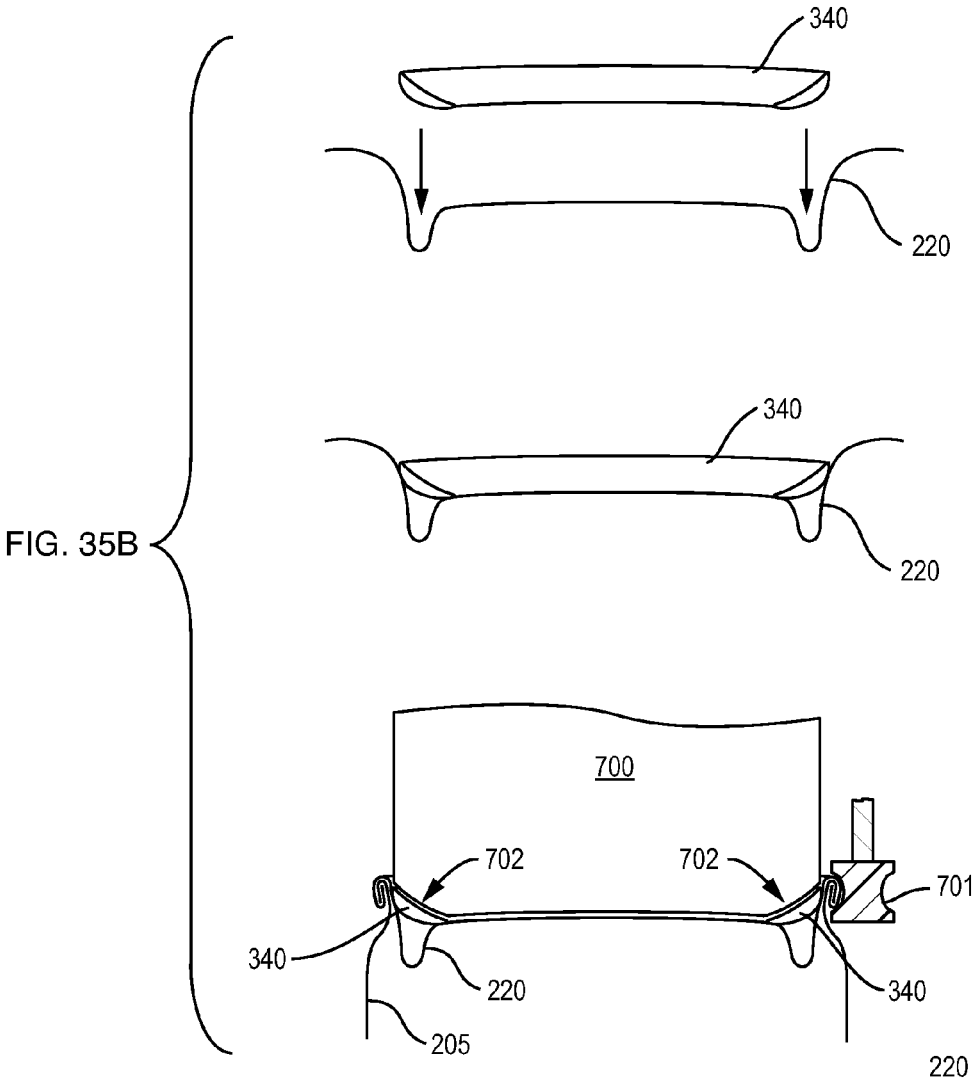
FIG. 35B shows a flow chart of steps to put a can top on a can using a chuck configured according to embodiments of the invention.

Returning attention now to the present disclosure, FIG. 35B shows a series of steps that include novel features and devices for installing a groove ring 300 (as disclosed herein) into a beverage can top 220 prior to operation of a double seaming operation that secures the top 220 to a can housing 205. In such embodiments, the present disclosure provides for a special chuck 700 and/or roller 701 that operate together to seam the can top 220 to the housing 205. In this example, the chuck 700 has a lower end 702 does not have fingers that enter the groove (i.e. does not have lower fingers as does the chuck 28 in th e'789 patent). In contrast, the chuck disclosed herein provides for a lower profile or shape that allows for or conforms to the pre-existence or pre-placement of a groove ring to overlay the groove 230 defined in the can top 220 prior to the seaming operation taking place.

Referring now to FIG. 35B of the present disclosure, in step A, prior to seaming, a groove ring 340 such as that shaped and as shown in FIG. 8 is placed onto a conventional un-seamed can top 220.

In step B, the can top 220 is shown with the groove ring 340 in place, and no double seaming operation has taken place. As noted above, in one configuration, the groove ring can be held in place with adhesive that may be placed onto the lower side of the groove ring 340 at areas that will come into contact with the upper side metal of the can top 220, during or after the seaming operation is complete.

In step C, the seaming operation takes place using a seaming chuck 700 and roller 701 that form the double seam. One novel element of this shown at this step is that the lower end of the chuck 700 is shaped to allow for the presence of the groove ring 340 pre-placed on the can top 220 prior to bringing the chuck into position for the double seaming operation. That is, the chuck does not have fingers that enter the groove as did that chuck disclosed in the '789 patent. The lower end edge of the chuck 700 in the present disclosure can have an outer shape or profile that exactly conforms to the upper surface 331 of the groove filler 340. During the seaming operation, the chuck 700 can press on the groove ring 340 and as the seam is formed, the groove ring is held in place by the chuck. In embodiments where an adhesive is used, the adhesive on the underside of the groove ring 340 will be pressed firmly in between the can top 220 and the groove ring 340.

Figure 35C:
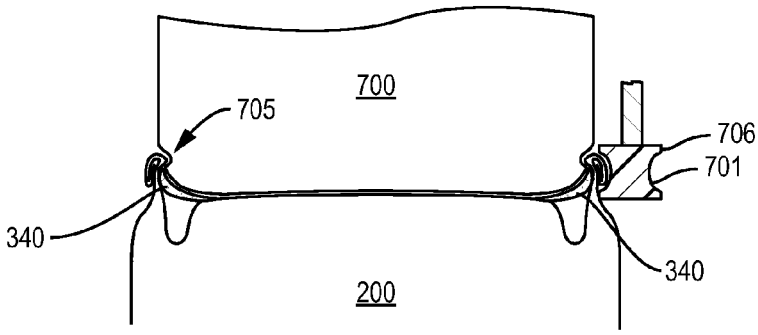
FIG. 35C shows a chuck and roller in use to seam a can top to a can while a groove cover is in place.

FIG. 35C shows an example of a shape or profile of a chuck 700 and roller 701 that can used to secure the groove ring 340 in place on the can top during seaming if no adhesive is used in the process. In particular, the chuck 700 has a lower end profile 702 that conforms to the curved banked shape of the upper surface 331 of the groove covering material 340. Likewise, roller 701 can have a shape that includes a protrusion 706 that causes the top of the rim to be formed, during the double seaming process, so that a resulting shape such as that shown in FIG. 24A is provided. The chuck 700 has a corresponding indentation 705 that allows for the formation of the rim as shown in FIG. 24A. Similar profiles of the chuck and roller can be provided to produce double seamed rims that have profiles such as that shown, for example, in Figures, 24*a*, 25 or 26. Related methods include placing the groove cover 340 into the groove before the seaming process is started, and having the seaming process itself produce the double seam and also deform or shape the can top (such as shown in FIGS. 24 through 27) to secure the groove cover in place.

As a specific example, consider the can top 220 shown in FIGS. 24 and 25 in which the rim of the can is bent inwards to secure the groove cover in place. In such embodiments, the groove cover 300 can be placed into the groove 230 of the can top 220 prior to seaming of the can top to the can. During the seaming operation, a chuck including a chuckwall that maintains placement of the can top 220 has a profile that is formed or shaped in a manner as shown in FIG. 35C so that the presence of the groove cover 300 within the groove 230 during seaming does not interfere with the existence of a chuck that resides within the can top upper surface area during the seaming operation. The seaming machinery can perform the seaming operation with the groove cover already in place.

In such installation methods, the deformations of the rim as shown in FIGS. 24A, 25 or 26 can be created at the time of seaming, or shortly thereafter. Embodiments also cover unique seaming machinery to shape the can top seam to securely coupled the groove cover in place in the groove and prevent its easy removal. In other configurations, methods covered herein include placing the groove cover in place on the can top during or after the seaming process is complete. As an example, if one or both of the groove sidewalls of the can top include the impressions shown in FIGS. 18A, 18B and 18C, as well as in other figures, a groove cover 300 (330 in FIGS. 18A, 18B and 18C) can be quickly applied later in the canning assembly line after the can seaming operation is complete. In such cases, the groove cover 300 can be dispensed or placed onto the top of the groove 230 and pressed or stamped into place by automated machinery. In other configurations that do not rely on a mechanical fit between the can top groove and the groove cover, the methods of applying the groove cover can include applying an adhesive into the groove 230, and then placing the groove cover 300 into the groove to be secured by the adhesive. This process can also be done before the can top 220 is seamed to the can such that the groove cover (e.g. as described above)

The following processing discloses example method steps or operations for applying a groove cover 300 to a can top 220 (and upper sides of the can body 205 for embodiments where the groove cover material extends over the rim 222 and down the side of the body).

In a first step, a can handler positions a can top to align a groove cover applicator with at least a portion of a groove defined between an inside edge of the rim of the can top and an outer edge of an upper surface of the can top. The groove cover applicator may be a singulator machine that selects a single pre-formed groove cover 300 (e.g. a plastic preshaped and preformed groove ring, such as that have a cross section shaped as shown in FIGS. 29B) from a batch.

In a second step, the applicator disposes a groove cover into or over at least a portion of the groove. The portion is located adjacent to an openable section 224 of the can top defined on the upper surface of the can top. The groove cover preventing collection of debris in the at least a portion of the groove in which the groove cover is disposed and assists in removal of debris during wiping of the can top. In this second step then, the applicator places the groove filler over the groove.

If the applicator applies a fluid groove cover, the step of disposing the groove cover can be performed, for example, by spraying a groove cover material onto the can top (and an upper edge of the body in embodiments where the rim groove is covered), or by dipping the can in a reservoir of liquid groove cover material, or by painting the groove cover material onto the can top, or by supplying a flow of liquid groove cover material that flows into the groove to fill in the groove. It is to be understood that these embodiments are not intended to be limiting and these methods are disclosed by way of example only.

In embodiments where the liquid groove cover is fluid for a short period of time after application, the processing can include rotating or spinning the can during hardening of the groove cover (e.g. during exposure to radiation to quickly cure and harden the groove cover) so that the groove cover will swell up on the inside edge of the rim of the can to create the upwardly curved profile of the upper groove cover surface.

If the applicator applies a groove ring, the step of disposing the groove cover into at least a portion of the groove can include placing the groove ring over the groove, and then press fitting, rolling or snapping the groove ring in place over the groove, or melting the groove ring to cause the groove ring to flow into the groove in a liquid state (after which the material can solidify and harden), or treating the groove ring (e.g. via a chemical) to cause the groove ring to conform to the profile of the groove.

Figure 36:
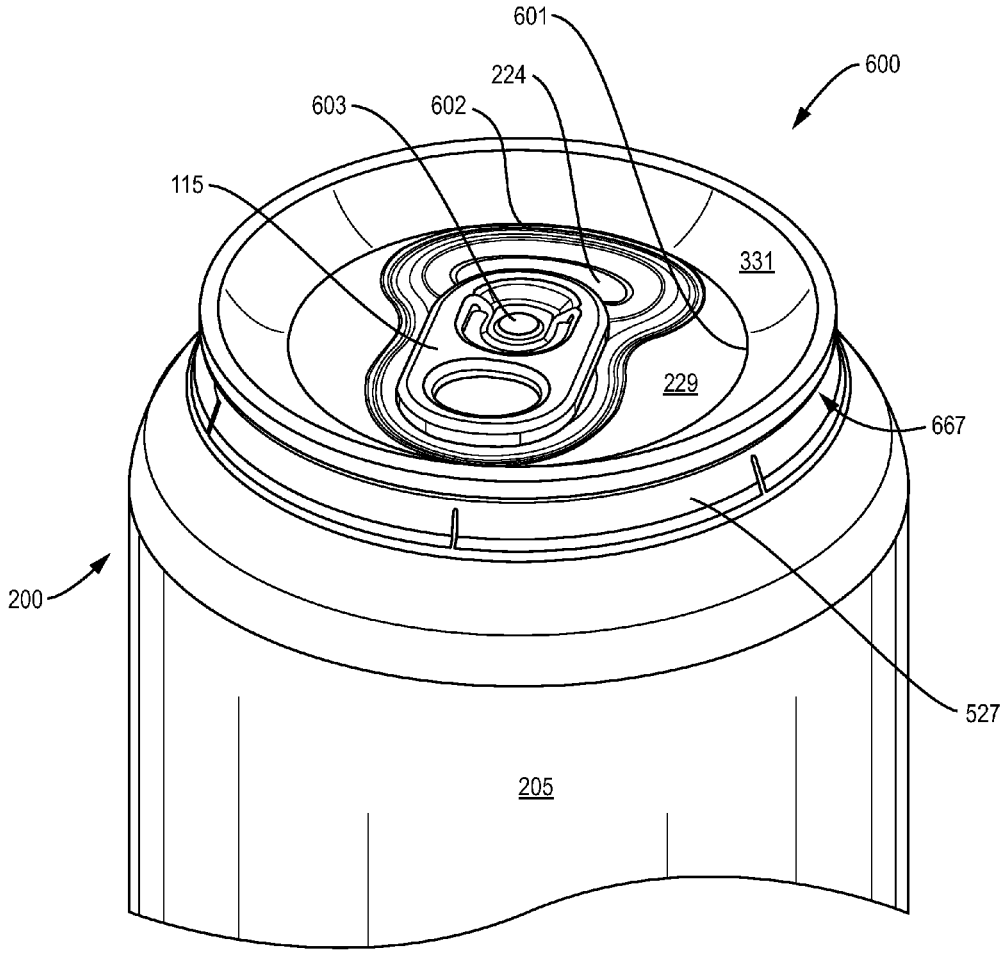
FIG. 36 shows an embodiment including a skirt.

FIG. 36 shows an example embodiment of a beverage can 200 that includes a device 600 attached to or installed on a rim on an openable end of the beverage can 200.

Figure 37:
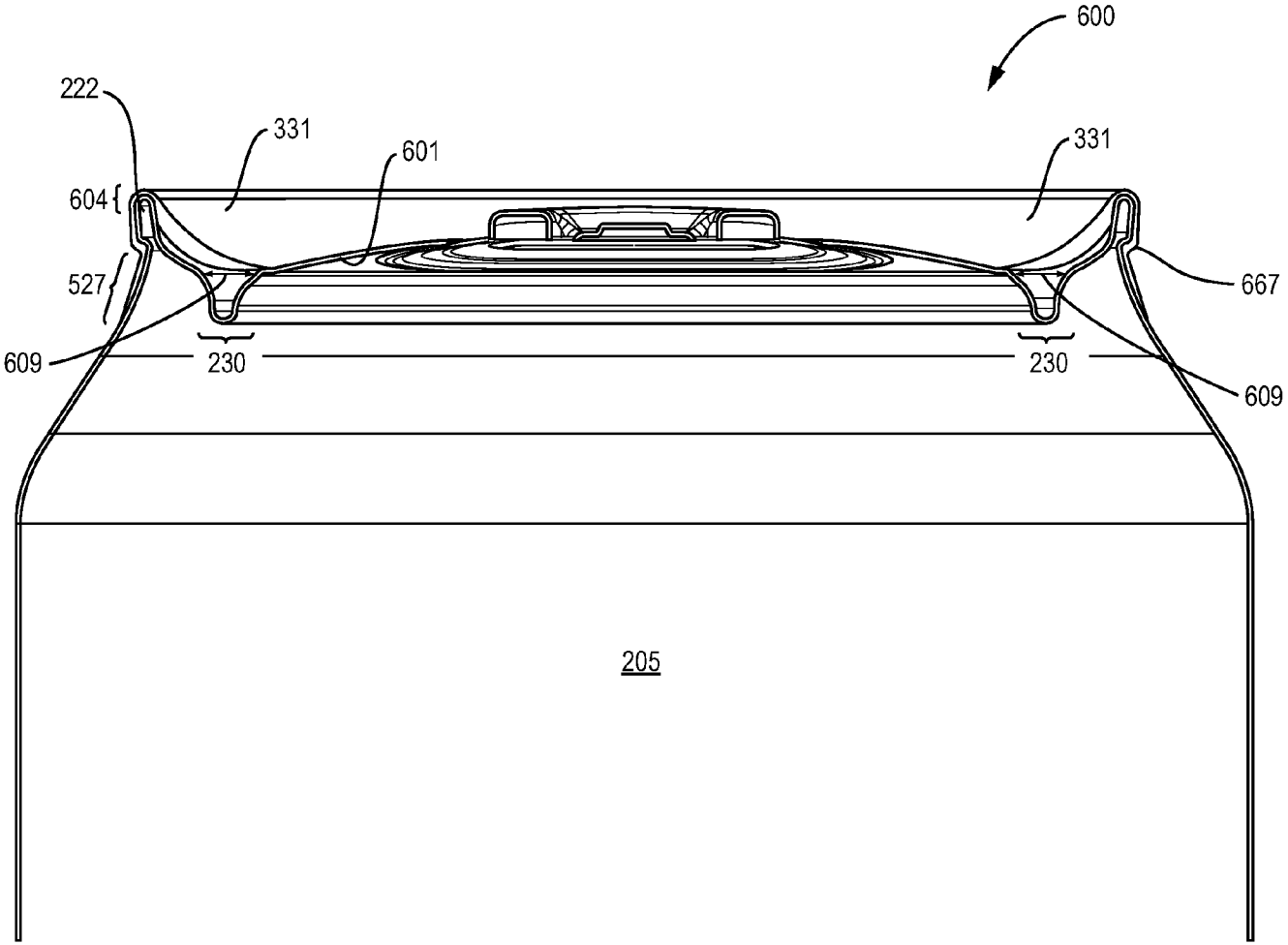
FIG. 37 shows a cross section profile of the embodiment in FIG. 36.

FIG. 37 shows a cross sectional view of the upper end of the same beverage can 200 from FIG. 36 with the same device 600 installed onto the rim of the can 200.

Figure 38:
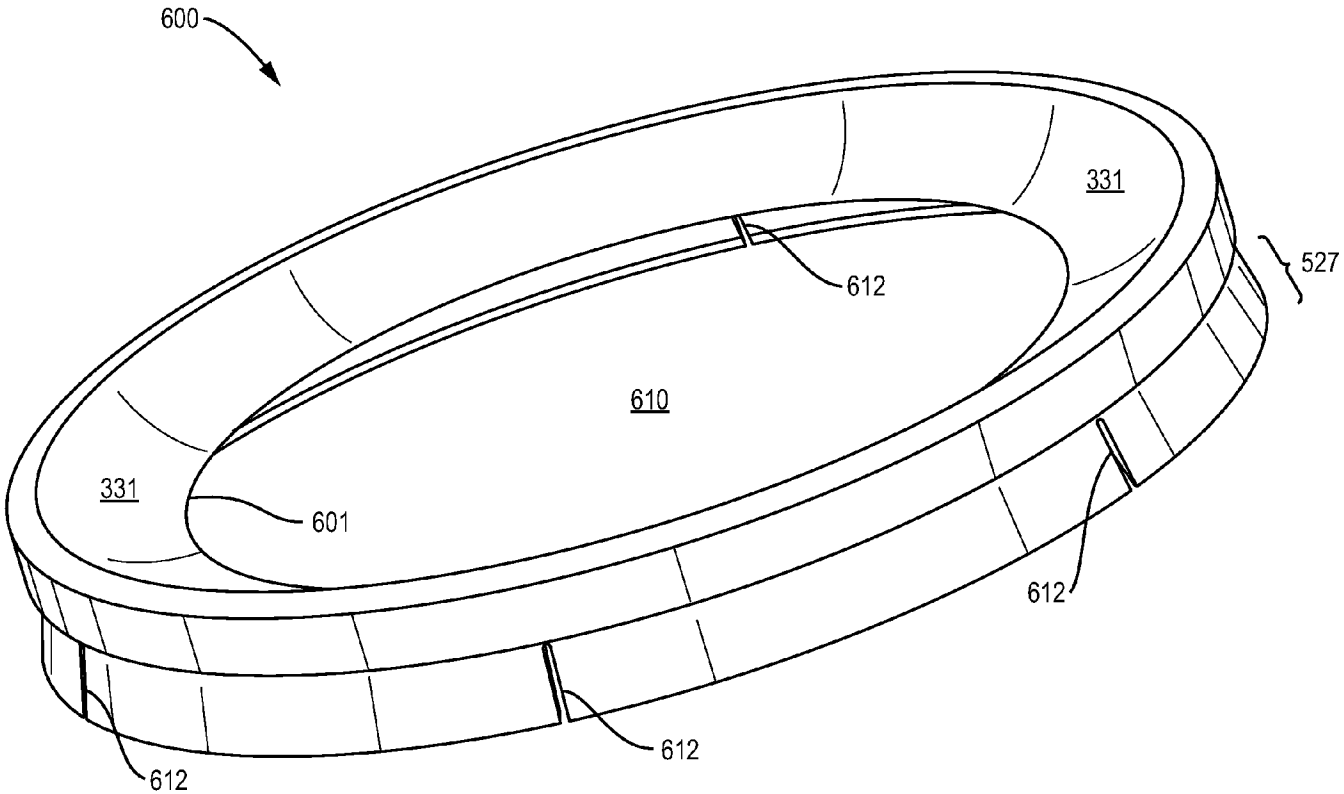
FIGS. 38, 39, 40, and 41 show additional views of an embodiment including a skirt.
Figure 39:
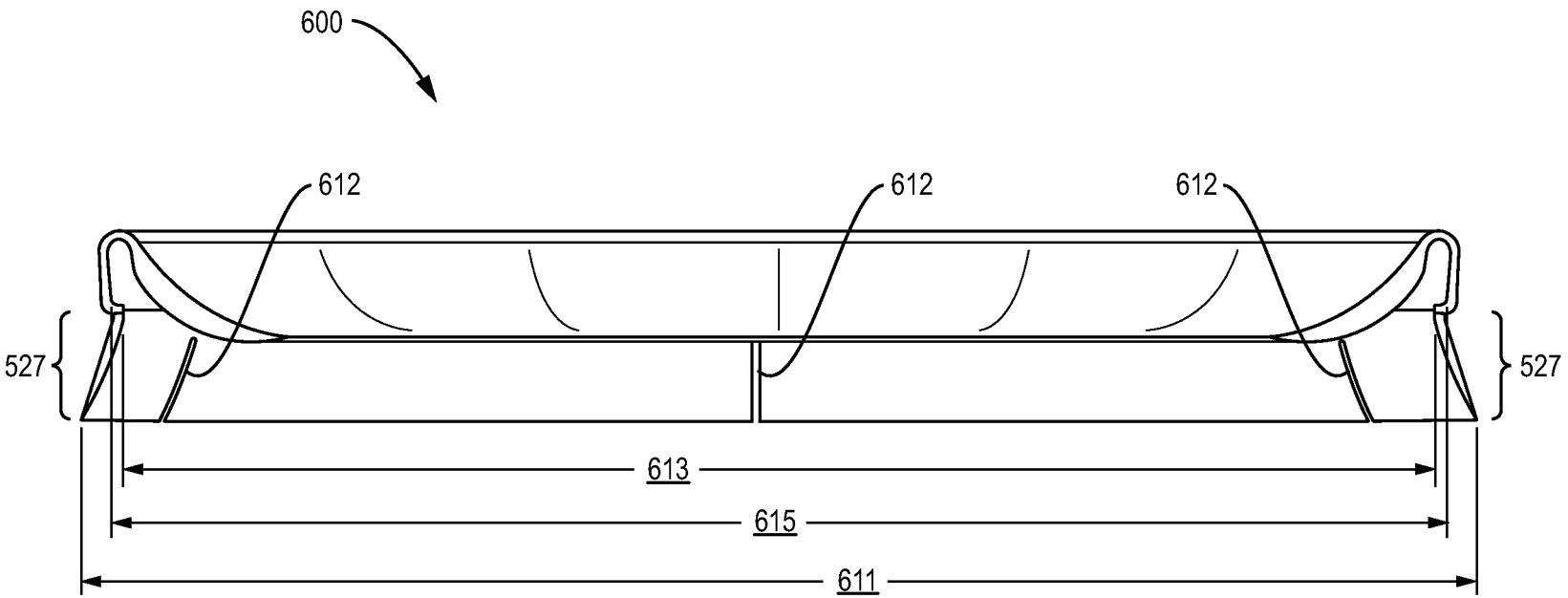

FIGS. 38 and 39 show views of the same device 600 alone that was shown in FIGS. 36 and 37, but prior to installation onto the can 200. The view in FIG. 38 is the full device, while the view in FIG. 39 is a cross sectional view showing the profile of the device 600.

In the example embodiment shown in FIGS. 36 through 39, the device 600 is similar to the groove covering device 300 in FIG. 35. The device 600 in this example embodiment comprises an inner edge 601 having at least one section that terminates upon an upper can top surface 229 at (i.e. along) a first location 602. The first location 602 defines a circle in this example that is radially further from the center 603 of the can top than an outermost edge of an openable section 224 defined in the upper can top surface 229. The device 600 includes an upper groove covering surface 331 that extends radially outwards and slopes upwards from the inner edge 601 towards an upper region 604 (FIG. 37) of a rim 222 of the top of the beverage can 200. The upper groove covering surface 331 covers (i.e. passes above) a countersink groove 230 defined in the can top and provides a substantial upper surface 331 upon which a printable message can be placed for marketing purposes.

The banked or sloped surface 331 that passes over the groove 230 is substantially larger than any horizontal surface defined as the top of the groove 230, shown as dotted line 609 in FIG. 37. The device 600 includes an underside device (just above the dotted line 609 in FIG. 37) having a profile in the direction of its radius that begins at the inner edge 601 and extends outward, below the exterior device surface 331. The underside device surface extends radially outwards and upwards away from the inner edge towards the inside sidewall of the rim of the beverage can. As shown, the underside device surface passes over the countersink groove defined in the can top and does not enter the grove. Depending on the embodiment, the underside surface may or may not enter the groove.

It is noted that the disclosure of U.S. Pat. No. 6,729,495 illustrates a material that fills in the groove and provides a horizontal top surface at the top of the groove. This device shown in the '495 patent does not provide a surface that significantly assists in wiping the can top since the horizontal nature of this surface does not assist in wiping material up and over the rim, and the top surface of the material in the '495 patent terminates at either side of the top of the groove, and does not continue or extend up the inside sidewalls of the rim of the can. As a result, the upper surface area provided by the device that fills in the groove in the '495 patent provides substantially less surface area to provide for a marketing platform as compared to embodiments disclosed herein.

In the attachment of device 600, the upper groove covering surface 331 extends radially outwards and upwards on an angle from the inner edge 601 towards the upper region 604 of the rim 222 of the top of the beverage can 200. The upper groove covering surface 331 thus provides a banked surface that provides a smooth transition from the upper can top surface 229 that is relatively horizontal or flat to the upper region 604 of the inside (or up and over the top) of the rim of the can that is relatively vertical. The banked or sloped surface 331 in this example assists in transporting debris up and over the rim of the can top when wiping the can top. The inner edge 601 defines a central opening 610 (FIG. 38) through which a tab 115 used to open the openable section 224 protrudes when the attachment 600 is secured to the openable end of the beverage can. This central opening 610 allows the openable section 224 to dispense liquid when opened and poured from the beverage can 200.

In the examples in FIGS. 36 to 39, the central opening defined by the inner edge 601 is substantially circular or ring-like in shape, and when the attachment 600 is secured to the openable end of the beverage can 200, the inner edge 602 resides substantially flush against the upper can top surface 229 along a circle having a radius from the center that is at a distance shown at location 602 in FIG. 36. In one example embodiment, the location 602 is generally a position on the central panel 229 (the upper can top surface) from the center of the can that is located somewhere in-between the inner edge of the groove 230 and the outermost edge of the openable section 224 defined on the central panel 229. As noted previously, in embodiments where the openable section 224 and tab are provided within a recessed area of the central panel, the inside edge 601 in one configuration resides somewhere in between the outermost upper edge of the recessed area of the central panel and the inside edge of the top of the groove 230. In this manner, when the opening 610 is a circle (or is substantially circular), it can rest on a portion of the central panel 229 (the upper can top surface) that is continuously flat around the entire inside edge 601, thus forming a tight seal and leaving little or no gaps in between the underside of the inside edge 601 and the top surface of the central panel 229.

Note the embodiment shown in FIGS. 36-39 includes the portion of material that extends down the side of the can housing below the rim for a short distance. This portion was referred to in FIG. 29A above as the lower tail section 527. It is also referred to in these embodiments as a "skirt" 527. Referring to FIG. 29, the lower most portion of the skirt 527 ensures that when the device 600 is placed onto a beverage can top, the lower diameter as shown by line 611 in FIG. 39 is larger than both the center diameter 613 of the top of the rim, as well as the outside diameter 615 of rim of the beverage can (as shown by line 613). In this manner, the device 600 is self-centering when placed on the beverage can top for press fitting or snapping into place, and it is ensured that the devices lower edge at the bottom of the skirt will fall to the outside of the rim 222 as the device 600 is pressed into place over the rim of the can 200.

The device 600 includes an exterior device surface 331 that extends down below the rim connector section 524 and includes a skirt edge 527 that couples from the bottom of, and extends below, the rim connecting section 518. The skirt edge 527 overlay a portion of the exterior of the can housing existing below the outer lower rim edge. The skirt edge 527 extends around the circumference of the can housing and has a lowermost portion that has an inside diameter that is larger than the outside diameter of the rim of the can top.

Further note that relief cuts 612 can be provided to assist in expansion of the lower portion of the device 600 as the device is press fit onto and over the rim of a beverage can. Depending upon the elasticity and stretch-ability of the material (e.g. 1 plastic) of the device 600, there may be 1, 2, 3, 4, 5 or more relief cuts can be provided to allow the device to snap over the rim of the can. The relief cuts 612 can be spaced evenly around the perimeter of the device, and can extend from the bottom upwards as shown.

From the foregoing, an example embodiment includes a ring shaped device 600 that is attachable to an openable end of a beverage can, the device comprises an inner edge 601 having at least one section that terminates upon an upper can top surface 229 at a first location 602. The first location for this section is radially further from the center of the can top than an outermost edge of an openable section defined in the upper can top surface. The device includes an exterior device surface having a profile in the direction of its radius that begins at the inner edge and extends and slopes radially outwards and upwards from the inner edge towards an upper region of a rim of the top of the beverage can. The exterior device surface extends around a rim of the beverage can and over and above a top of a countersink groove defined in the can top. The exterior device surface 331 provides a smooth surface over which debris on the can top can be wiped up and over the rim of the can top and providing a surface on which a marketing message may be presented.

From the foregoing, in one example configuration, a portion of the exterior device surface 331 that exists and slopes in between the inner edge 601 and an uppermost region of the exterior device surface (i.e. above the rim in this example) provides an overall surface area that is substantially larger than a substantially horizontal groove covering area 609 (FIG. 37) that is defined as a top of the groove between the inside upper edge of the countersink groove and an opposite location located horizontally across the countersink groove (that end against the lower sidewall of the inside of the rim).

In one example configuration, the exterior device surface extends radially outwards and upwards as a banked surface from the inner edge towards the upper region of the rim of the top of the beverage can, the upper groove covering surface providing a banked surface that provides a smooth transition from the upper can top surface that is relatively horizontal to the upper region of the inside of the rim of the can that is relatively vertical, the banked surface assisting in transporting debris up and over the rim of the can top when wiping the can top.

In another configuration, the inner edge 601 defines a central opening 610 through which a tab 115 used to open the openable section protrudes when the attachment is secured to the openable end of the beverage can, and through which the openable section can dispense liquid when opened and poured from the beverage can. The attachment or device 600 remains secured to the beverage can before, during and after opening of the openable section.

In another configuration, the central opening 610 defined by the inner edge 601 is substantially circular or ring-like in shape, and when the attachment 600 is secured to the openable end of the beverage can 200, the inner edge 601 resides substantially flush against the upper can top surface 229.

In another configuration, the central opening 610 defined by the inner edge is shaped to conform substantially to a shape of a tab recess area (e.g. FIG. 33) defined in the upper can top surface 229. The tab recess area as noted above provides an area on the upper can top surface within which the openable section and a tab are provided for on the beverage can top. Depending on the design of the can top, in some example configurations the inner edge 601 defines a central opening that is at least one of an hour glass shape or a tear drop shape.

In one configuration, the surface area of the exterior device surface 331 that extends radially outwards and slopes upwards from the inner edge 601 towards an upper region of a rim of the top of the beverage can provides a banked surface area that is substantially greater in overall area than an area defined by a substantially horizontal plane 609 passing over the countersink groove in between a lower region of the rim of the beverage can and an outside edge of the upper can top surface.

In another configuration, the exterior device surface 331 includes a rim connecting section 524 that extends up and over the top of the rim of the beverage can and extends down the exterior side of the rim of the beverage can. The rim connecting section 524 extending around a circumference of the exterior of the rim of the beverage can and adheres the device to the rim of the beverage can.

Figure 40:
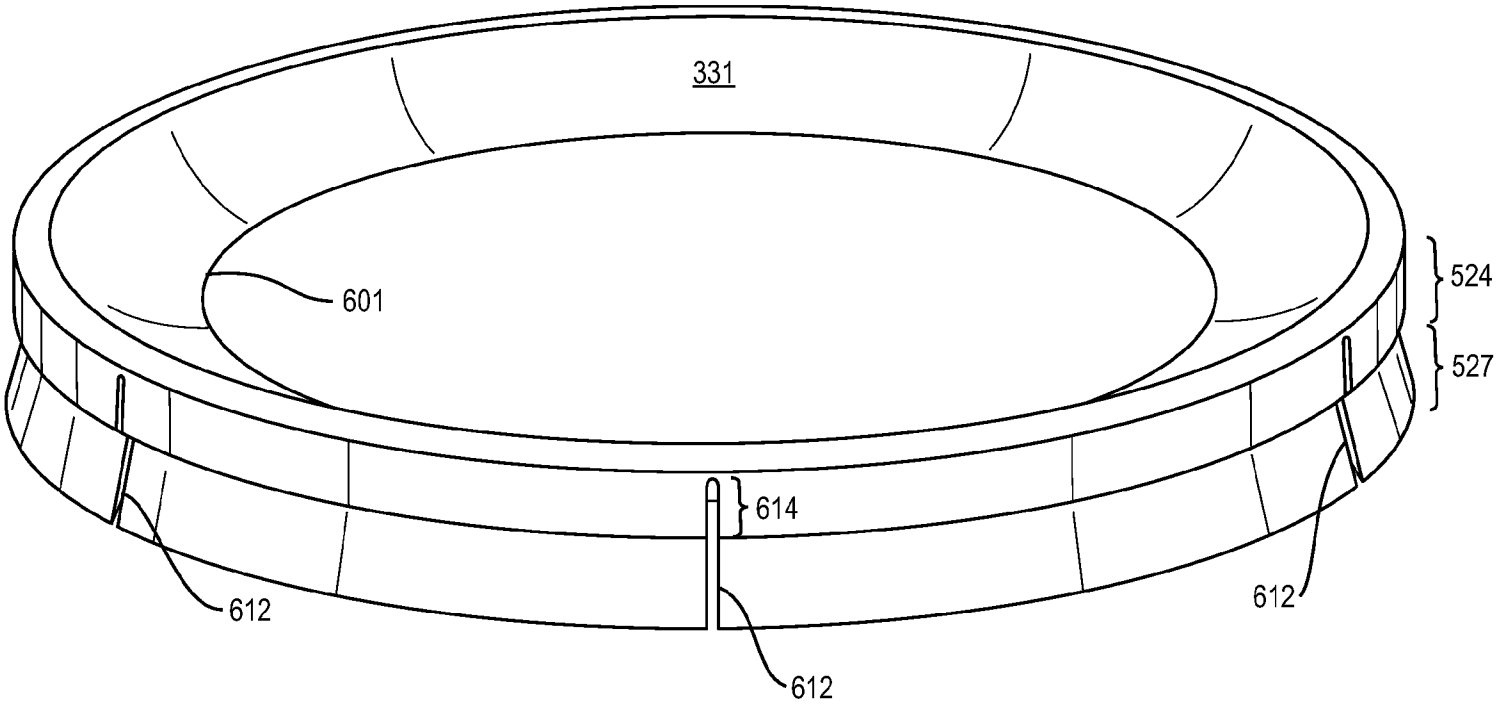

FIG. 40 shows a version of the device 600 from FIGS. 36-39 in which the relief cuts 612 extend up into the rim connector section 524. That is, the relief cuts extend through the material of the device 600 and pass through the rim connector tip 518 region and through at least a portion 614 of the rim connector section 524 that exists on the outside of the rim 222 of the beverage can. In this manner, as the device 600 is pressed onto and over the rim of a beverage can, the rim connector tip 518 (that forms an inner circle (at the inner tip 518) that is slightly smaller in diameter that the outside diameter 615 of the rim of the can) will be allowed to momentarily (during installation over the rim) stretch, deform, or flex outward to allow momentary expansion of the inside diameter of the rim connector tip region 518 as it expands to flex over the rim. Once the device is pressed onto the rim low enough, the rim connector tip 518 (that extends in this example as a radially inward protrusion around the rim) will snap into place into the rim groove defined at the juncture of the can top and can housing. The rim connector tip 518 forms a radially inward pointing ring (and slightly upward pointing in the illustrated examples) on the inside of the device 600 that thus holds the device 600 in place on the can top by grabbing onto the underside of the rim (much like the plastic six-pack "hi-cone"™ holders provide when carrying six cans at one time). Note that "Hi-Cone" is a trademark of Hi-Cone corporation of Itasca, Ill, USA.

Figure 41:
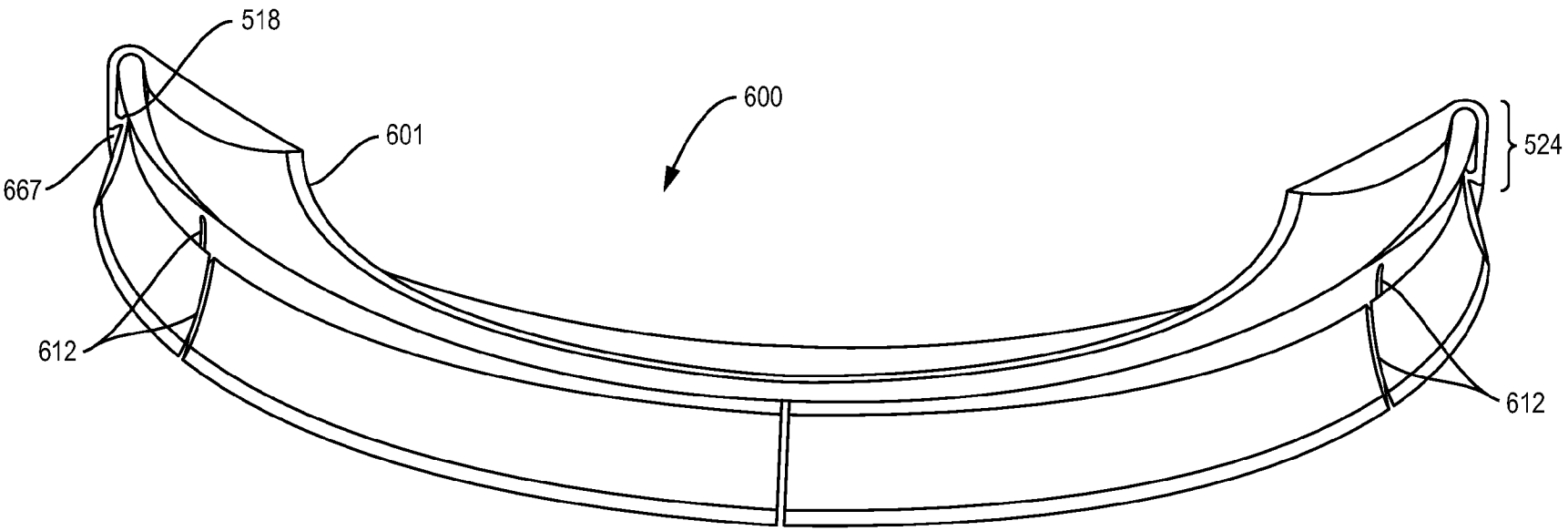

FIG. 41 shows an underside view of cross sectional profile of the device 600 from FIG. 40 in which the relief cuts extend up into the rim connector section 524 of the device 600.

Figure 42:
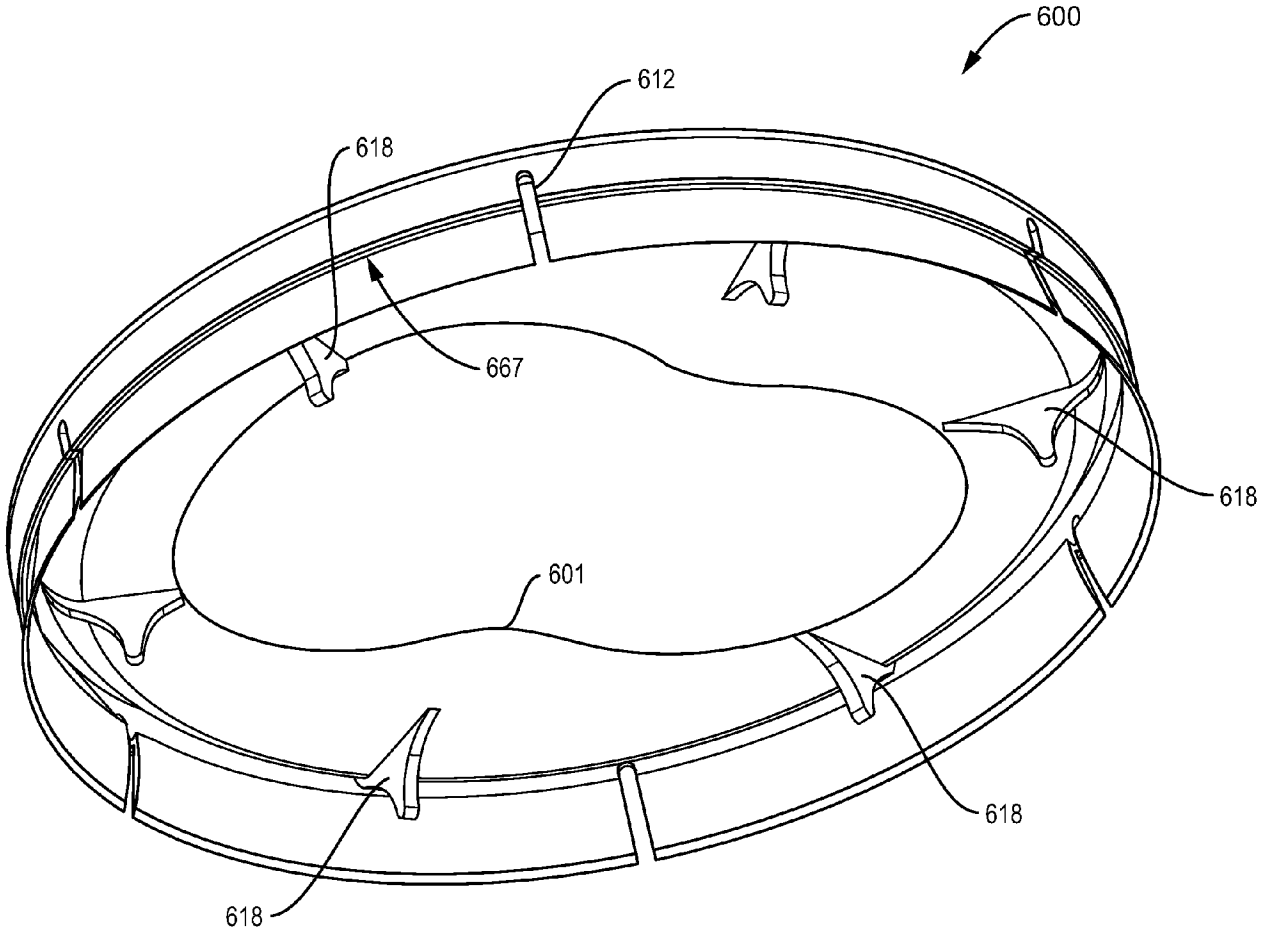
FIG. 42 shows an embodiment including struts that enter the groove.

FIG. 42 shows an example of an embodiment in which the underside of the device 600 includes support struts 618 that extend into the groove 230. The support struts can provide stability and puncture resistance to the upper surface 331 since the extend into the groove and provide supporting structure. Also note in FIG. 42 that the inside edge is shaped to conform the shape of a recessed area of a central panel 229 that contains the openable section 224 and tab 115. The shape defined by inside edge 601 is somewhat different than the previous version discussed above with respect to FIG. 34 (where the inside edge was referenced as reference numeral 335).

Figure 43:
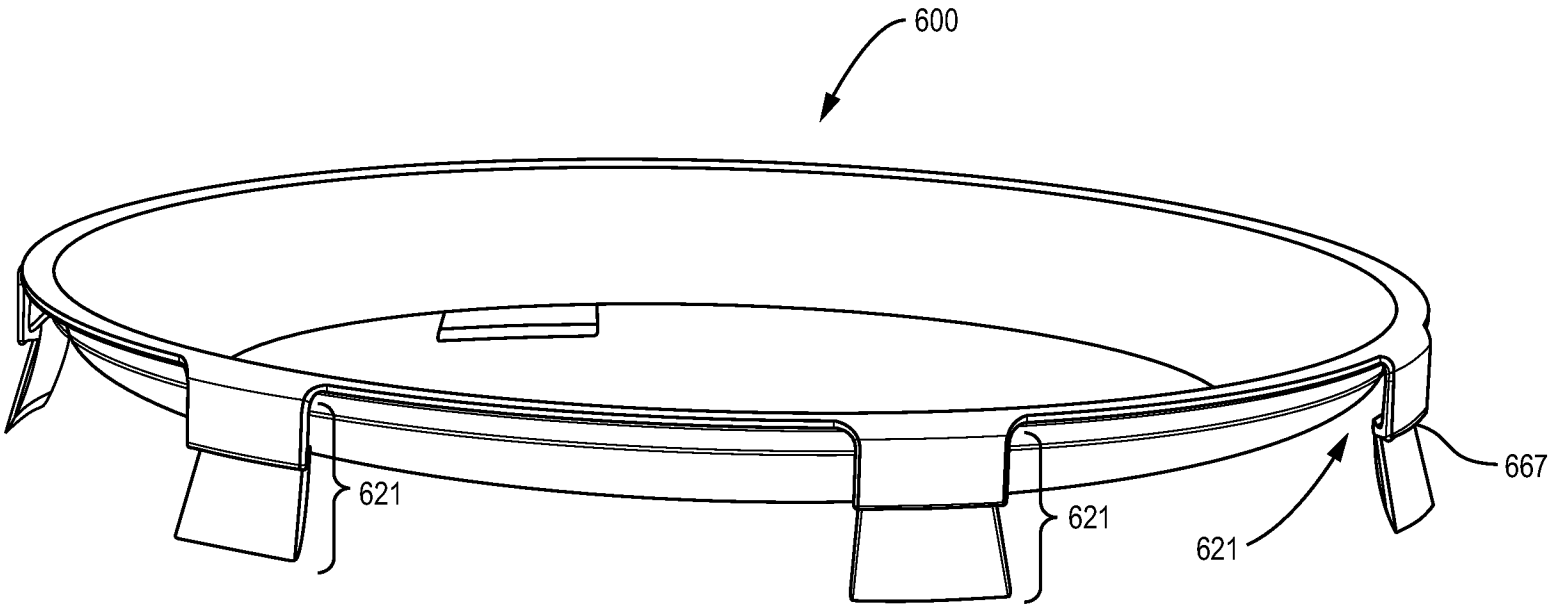
FIG. 43 shows an embodiment that has fingers that secure the device to a can top.

FIG. 43 illustrates an embodiment in which there are fingers 621 that extend over the rim of the can top and down the outside of the rim and that latch onto the rim groove and continue to extend partway down the outside of the can housing. The embodiment in Figure that provides the fingers 621 uses less material to hold the device 600 onto the can top and thus may cost less to produce.

Note that the embodiments shown in FIG. 36-43 provide for a carrier notch 667 that allows a plastic stretchable holder or "Hi-cone" to slip over the device 600 (that covers the rim of the can) and hold onto the can for carrying purposes. In other words, the notch 667 replicates the presence of the rim groove on a conventional can and allows a Hi-Cone device to function as normal to carry, for example, a six-pack of cans.

Figure 44:
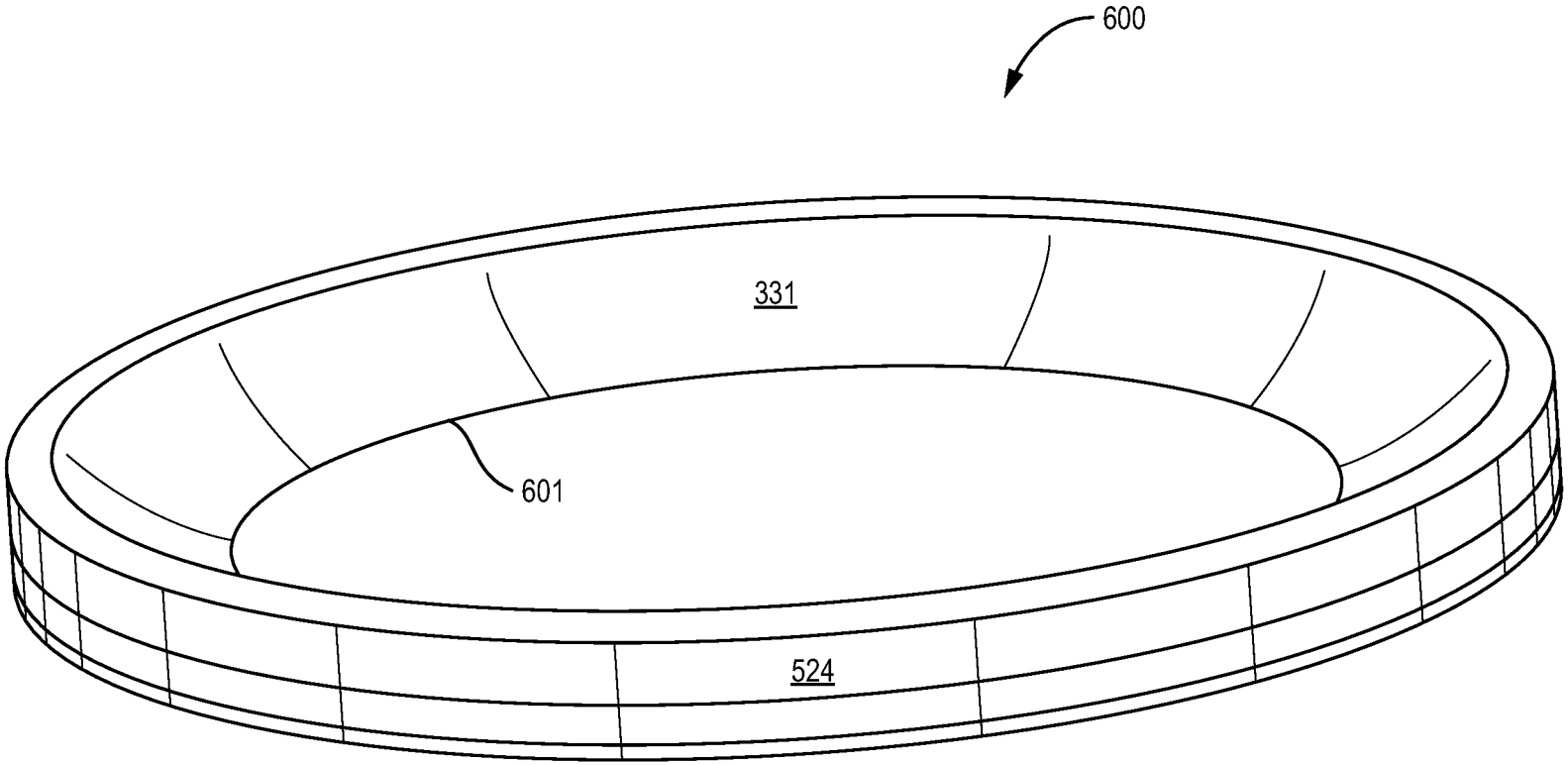
FIGS. 44 and 45 show an embodiment that has a flat rim connecting section.
Figure 45:
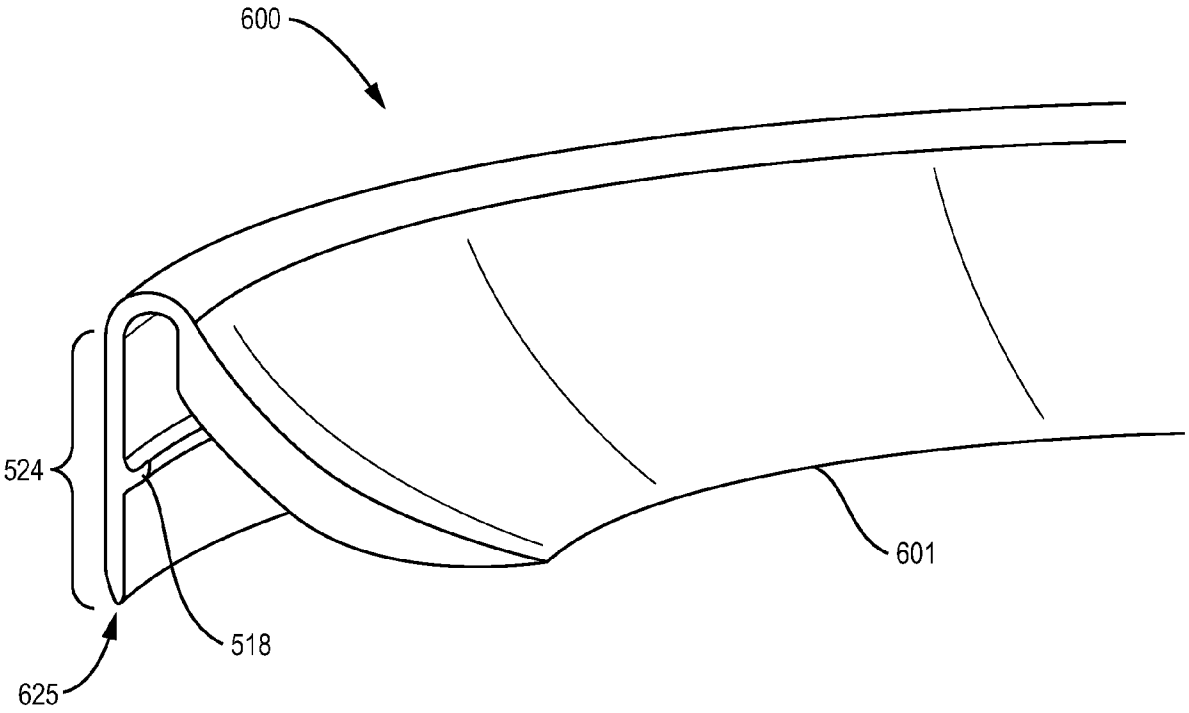

FIGS. 44 and 45 disclose an embodiment that provides for a substantially flat rim connector surface 524 (the exterior surface of the rim connector section 524) that extends from an outside top edge (above and to the outside of top edge of the rim of the beverage can) downwards towards the can housing. This surface 524 is flat in the vertical directional and cylindrical in the horizontal direction.

FIG. 44 is a full top view and FIG. 45 is a cross section view of only one side of the device 600. This version of the rim connector section 524 is an extended rim connector section that does not include a carrier notch 667, and thus enables or provides a flat continuous cylindrical surface upon which a marketing or branding message can be placed around the outside of the rim of the can 200, and this message can extend somewhat down the housing of the can below the bottom of the rim. As the housing diverges away and outward in diameter, the region below the rim connector tip 518 can continue down the side of the housing of the can for any distance that may be required or desired thus providing additional marketing/branding surface. Thus, in this embodiment, the entire upper surface 331 that resides from the top of the rim and slopes downward and inward towards the inner edge that rests on the central panel 229 can be branded with content. This content (e.g. logo, text, message, picture, graphics, embossment, depression, or even cut away material to form an image or text) can extend from the surface 331, up and over the rim of the can, and can continue down the outside surface 524 and down the exterior of the rim of the can 200 and over the upper portion of the can housing 205. This example shows the rim connector section 524 material extending substantially below the rim connector tip 518 that engages with the rim groove to hold the device 600 in place on the can 200. Note that relief cuts 612 are not provided or shown in this example, but it is to be understood that relief cuts 612 can be included to allow expansion of the rim connector tip 518 as it is placed and snap fit over the rim 222 of the can 200.

It is noted that the lower tip 625 of the version of the device 600 shown in FIG. 45 can include a flat or outwardly beveled edge shape that enables the use of a Hi-Cone carrier to carry the cans in a group (e.g. as a six pack). That is, the lower tip 625 can be formed to allow a multi-can carrier device to stretch over the outer flat sidewall 524 of the device until is reaches the lower tip 625 where is constricts and snaps into a groove or junction formed by the tip 625 and the can housing 205.

Figure 46:
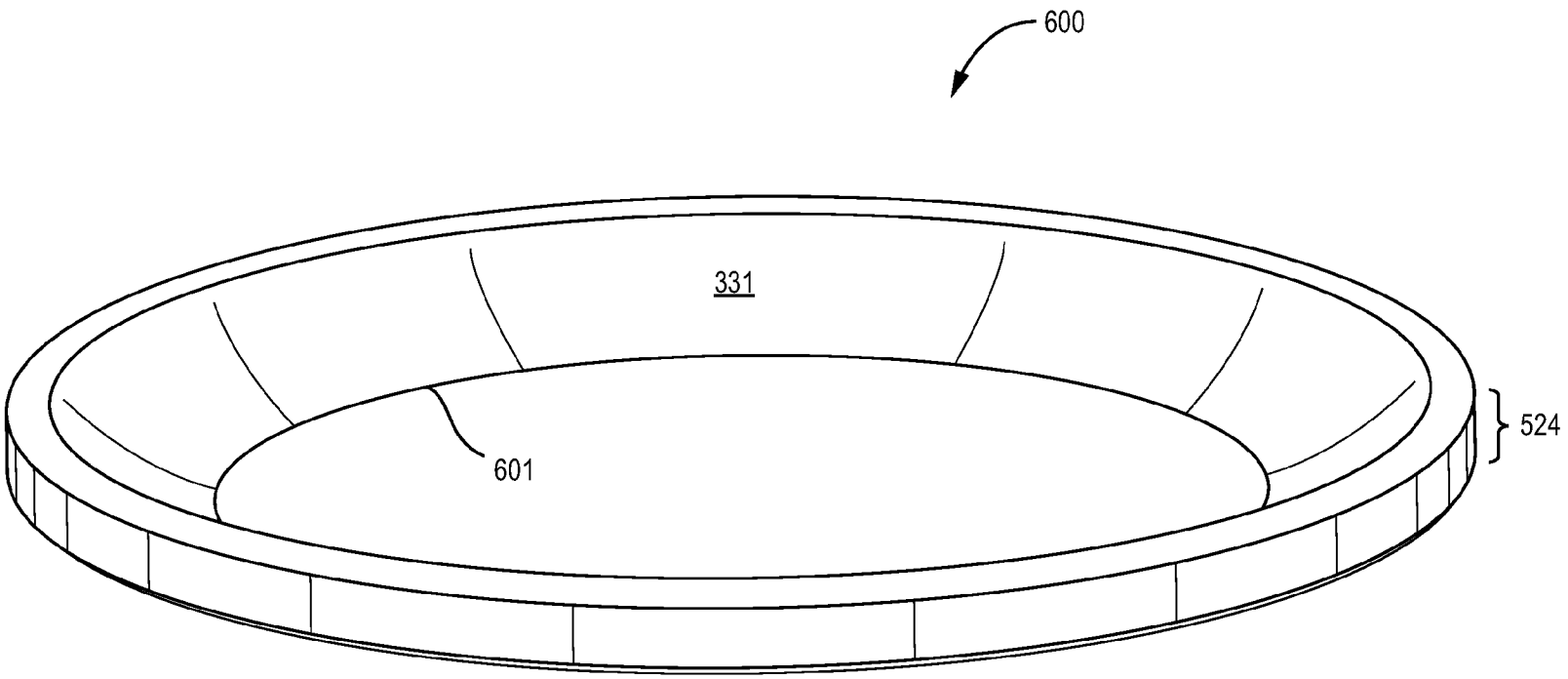
FIGS. 46 and 47 show an embodiment with no skirt.
Figure 47:
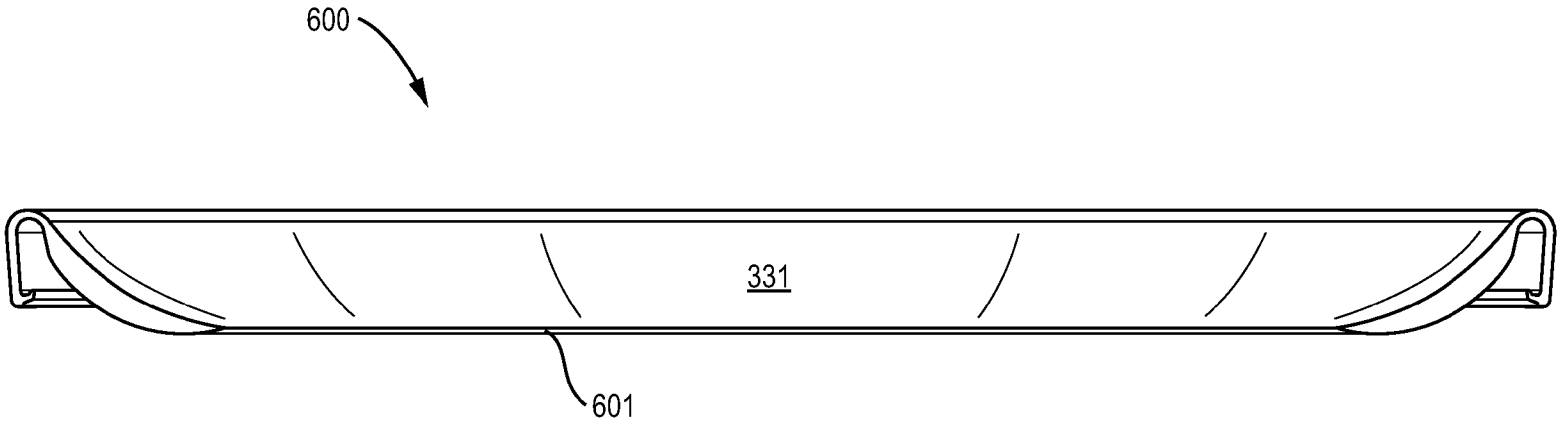
Figure 48:
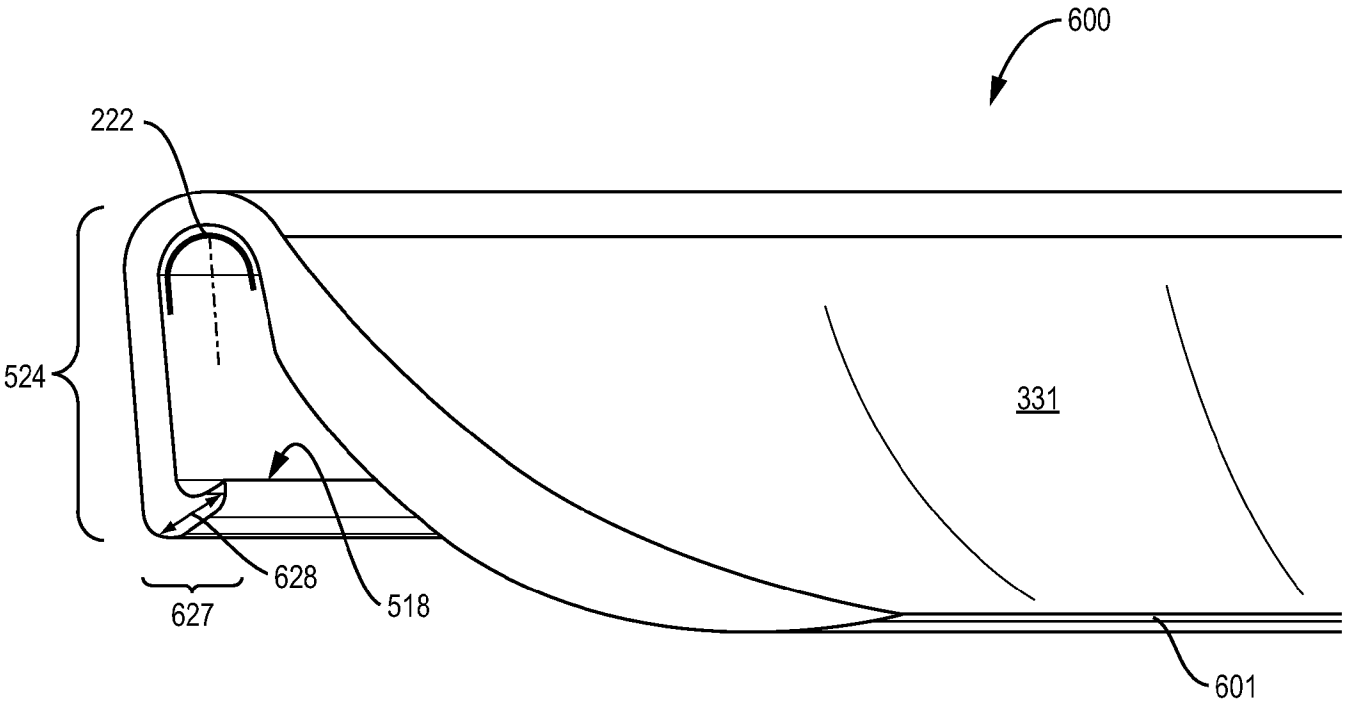
FIG. 48 shows details of how the no-skirt embodiment secures to the rim of a can.

FIGS. 46-48 shows a version of the device 600 that does not include the lower skirt 527 (as was shown for example in FIGS. 36-42). The non-skirt version of the device 600 shown in FIGS. 46-48 otherwise operates to attach to a rim of a beverage can in the same manner as previously described.

Example embodiments include a rim cover device 600 for a beverage can that includes a layer of material having an the underside device surface having a rim connecting portion (524) that matably attaches over a rim 222 of a top of a beverage can. An exterior device surface 331 is provided (this is continuous surfaces of 527 (if included), 524 and 331) and extends up the outside of the rim of the beverage can and over a topside of the rim of the beverage can and extends down into an inside area of the rim of the beverage can below the topside of the rim of the beverage can. The exterior device surface 331 extending above and across a top of a countersink groove defined in the can top of the beverage can and has an ring-shaped inner edge 601 that terminates upon an upper can top surface 229 at a first location 602 that is radially further from the center of the can top than an outermost edge of an opening of the can top defined in the upper can top surface. The inner edge defines a central opening through which a beverage contained in the beverage can may be poured.

In another configuration, an apparatus 600 is provided that includes a circular ring of material that matably attaches around the circumference of a rim of a beverage can top. The circular ring of material has a cross sectional profile that includes an outside surface 527, 524, 331 that extends up from an outside area below the outside of the rim of the beverage can and extends up and over a topside of the rim of the beverage can and that extends downwards in a sloping manner away from an inside edge of the rim of the beverage can top and that slopes downward and extends over a countersink groove defined in the beverage can top and that terminates at an inside edge onto a surface of a center panel of the can top. At least one region of the inside edge 601 terminates in between an outermost edge of an openable section defined in the center panel of the can top and an outermost edge of the center panel of the can top.

FIG. 47 shows a cross-sectional profile of the device 600 shown in FIG. 46. FIG. 48 shows a detailed view of one side of the device from FIGS. 46 and 47. Note in FIG. 48, the rim connector tip 518 is directed upward to tightly fit under and into the rim groove formed at the intersection of the rim of a can top 220 and can housing 205 of a beverage can 200. This rim connector tip 518 forms protrusion that has an inner diameter that is somewhat smaller than the outermost diameter of the rim of a beverage can. Further note the detail of the underside 627 of the rim connector tip 518 and how this underside 627 is beveled and slopes radially inward and upward towards the rim connector top 518 as shown by the direction of the arrow 628 in FIG. 48.

During installation of the device 600 onto an openable end of a beverage can, this inwardly and upwardly (or downwardly and outwardly) sloped region 627 engages with the top of the rim 222 (only a portion of the rim is sketched in FIG. 48) and helps to ensure that the rim connector section 524 stretches to the outside of the rim 222. In other words, this beveled surface on the lower most end of the rim connector section causes the rim connector section 524 and the entire device 600 to "self-center" when placed on the rim 222 of the beverage can 200 and when the device 600 is pressed down firmly onto a rim 222 of a beverage can, this circular ring-like protrusion formed by the rim connector tip 518 and its lower beveled edge surface stretches or deforms momentarily to stretch radially outward and over the outside diameter of the rim of the beverage can and then as the device 600 is continued to be depressed onto and over the rim 222, the rim connector tip 518 stretches and begins to slide down the outside surface of the beverage can rim 222 and approaches the lower edge of the outside of the rim 222. As rim connector tip 518 then clears the lower edge of the rim, it snaps back radially inwards into the rim groove, thus holding the device 600 firmly in place on the openable end of a beverage can. If no relief cuts 612 are provided in the rim connector section 524 and the material (e.g. a plastic similar to that as used for twist off soda bottle plastic caps) selected for manufacturing of the device 600 is of proper firmness, durometer and stiffness, yet has some slight elasticity or deformability, the device 600 is able to be aligned onto the top of the rim of the can, self-centers via the beveled surface 627, then can be firmly press fit onto and over the rim, and then snaps into place with the rim connector tip 518 firmly gripping the underside outside edge of the rim 222. This device 600 installed in this manner is extremely fast to install and is very difficult to thereafter remove. In one example configuration, no adhesives or glues are required to firmly secure the device 600 to the can top, and no modification to current conventional can top designs are required. It is noted that specific dimensions of can top profiles, shapes, diameters, central panel depths, groove depths and widths, and the like can vary in different can designs used by different can manufacturing companies and the device 600 disclosed herein can be modified accordingly to provide for the functionality as disclosed herein. It is also noted that for a given can type of given dimensions, modern canning machinery can produce many hundreds of thousands of cans in a canning process that have dimensional tollerances of such accuracy that the device 600 made in bulk, for example, from an injection molded plastic processing mold, can be used on such cans with excellent accuracy as to proper fit and attachment to such cans.

In one configuration (e.g. method embodiment) the device 600 can be installed in a canning line operation via automated machinery shortly after the can top 220 is double seamed onto the can housing and the device 600 becomes an integral part of the beverage can 200 and says on the can during packaging, shipping, vending, purchase, storage, then opening, pouring/drinking from the can, and after consumption of the beverage is complete.

This device 600 thus provides an excellent platform and provides a new, non-obvious, inventive and novel surface area 331 to convey a branded message to consumers. The branding can exist on the surface 331, as well as on the region above the rim 222, and down the outside exterior surface of the rim connector section 524, thus allowing placement of the branded message around and over the rim of a can as has never been available before. And while the countersink groove 230 is still physically present underneath the device 600, for all practical purposes, the groove 230 is essentially eliminated from view by the device 600 (unless the device is made of a translucent material) and an entirely new packaging look and feel is provided by the device 600 for any beverage cans that includes a rim. In these example configurations noted as numeral 600 in this disclosure, the device 600 does not fill in the groove. In fact, other than the embodiment in FIG. 42 that provides struts that extend into at least a portion of the groove, the device 600 does not need to touch or interface with any portion of the groove. In the example configurations, the inside edge 601 rests on the central panel 229 (upper can top surface) at a location that is radially inward from the upper inside top edge of the groove 230. That is, the device 600 provides for material that resides above the top of the groove in these example configurations and thus does not fill in the groove.

The device 600 can be color coordinated with the labeling or printing provided on the can housing. Additionally, the device 600 can be color coordinated with the tab 115 on beverage can tops to provide a distinctive look and feel to the can that can increase product visibility on store shelves. Note the device 600 can be attached even to cans that do not include a countersink groove (e.g. soup cans that are not pressurized) and provides a mechanism to assist in wiping the can top surface of any dust, debris, dirt, etc. prior to opening the can since the surface 331 provides a nice upwards sloped or banked surface 331 to allow transport and ejection of debris up and over the rim of the can.

In one configuration, the rim connecting section 534 includes at least one relief cuts to allow expansion of the rim connecting section when the device is pressed down onto and over the rim of the beverage can.

In one configuration, the underside device surface (as shown in FIG. 48 just above line 222) extends up and over the top of the rim of the beverage can and forms an inside surface of a rim connecting section 524 of the device. The inside surface of the rim connecting section secures the device to the rim of the beverage can.

Ion one example, the rim connecting section 524 includes a rim connector tip 518 the extends around an inside surface of the rim connecting section. The rim connector tip protrudes radially inward towards the center of the device. The rim connector tip 518 engages with a rim groove formed at an intersection of the can top and a can housing to secure the device to the can top.

In another configuration, a lower side of the rim connector tip includes an outwardly beveled lower surface 627 to direct the rim connecting section 518, upon initial contact with the top of the rim 222 of the beverage can, away from the center of the can top during installation of the device on a beverage can.

Figure 49:
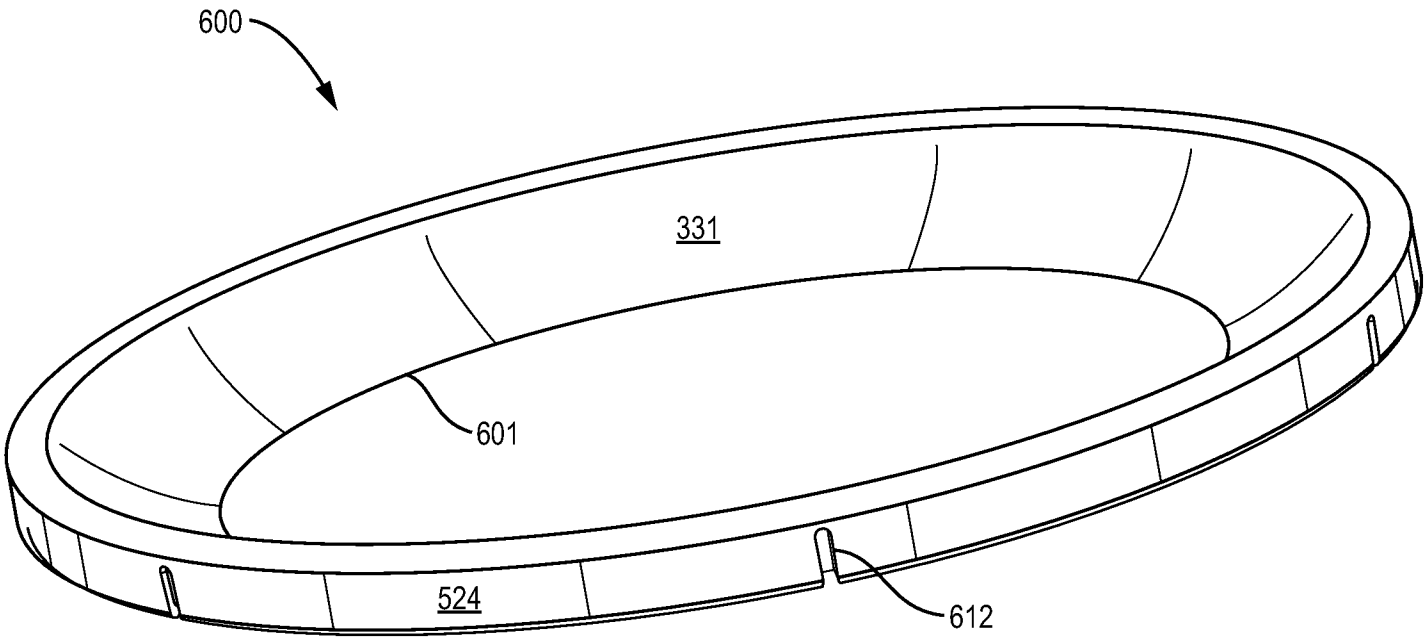
FIG. 49 shows a no-skirt embodiment with relief cuts.

FIG. 49 provides an example of the previous embodiment in FIGS. 46, 47 and 48 but that provides relief cuts 612 in the rim connector section 524 to assist in the expansion of the rim connector tip region 518 as the device 600 is installed onto cans. Note in this example, the relief cuts 612 include a slightly rounded top to assist in preventing of tearing of the material (e.g. plastic) from which the device 600 is made during installation and can use and handling.

Figure 50:
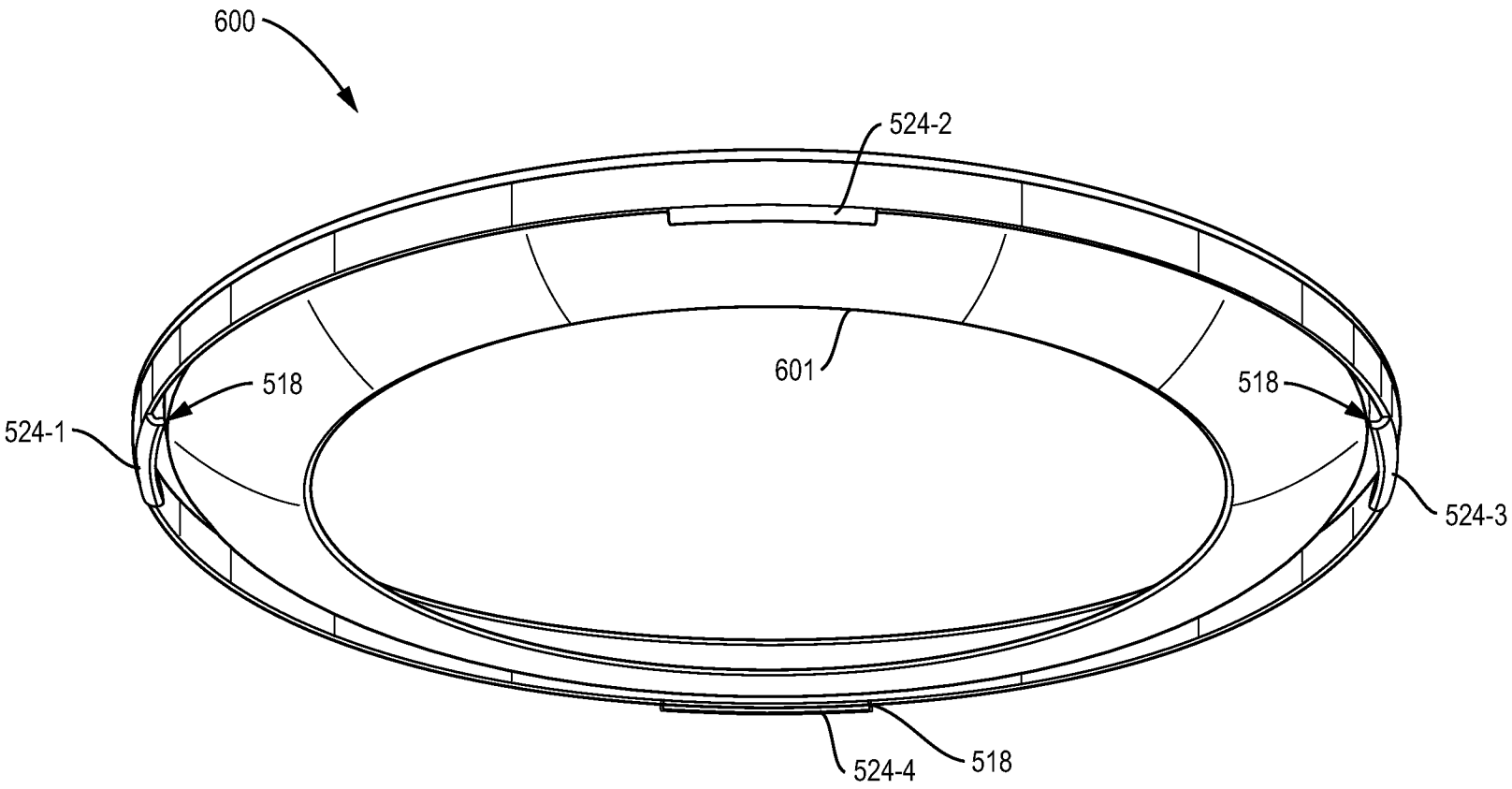
FIGS. 50 and 51 show an embodiment that uses hook-like appendages to secure to the rim of a can.

FIG. 50 illustrates an example embodiment of an underside of a device 600 in which there are only small sections or segments of the rim connector section 524 that extend under an exterior underside of the rim 222 of the beverage can 200. Each section hooks (via rim connector tip 518) onto the rim groove defined at the intersection of the rim of the can top and the beverage can housing. In the illustrated example, there are four rim connector sections 524-1 through 524-4.

Figure 51:
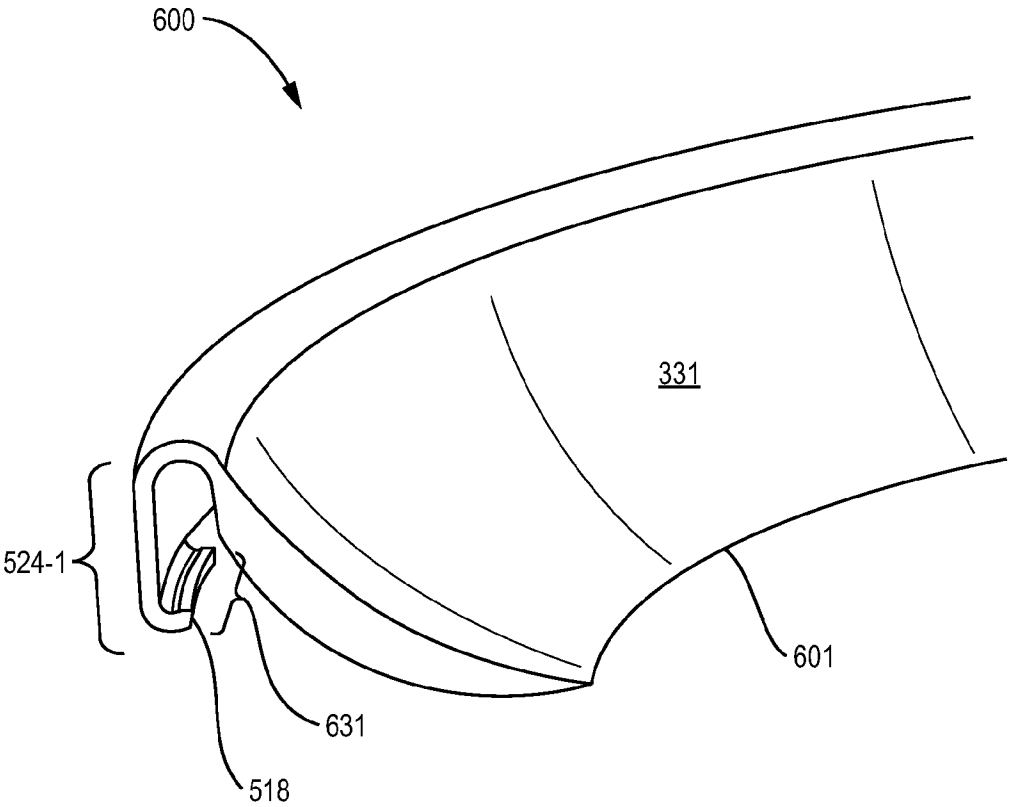
Figure 52:
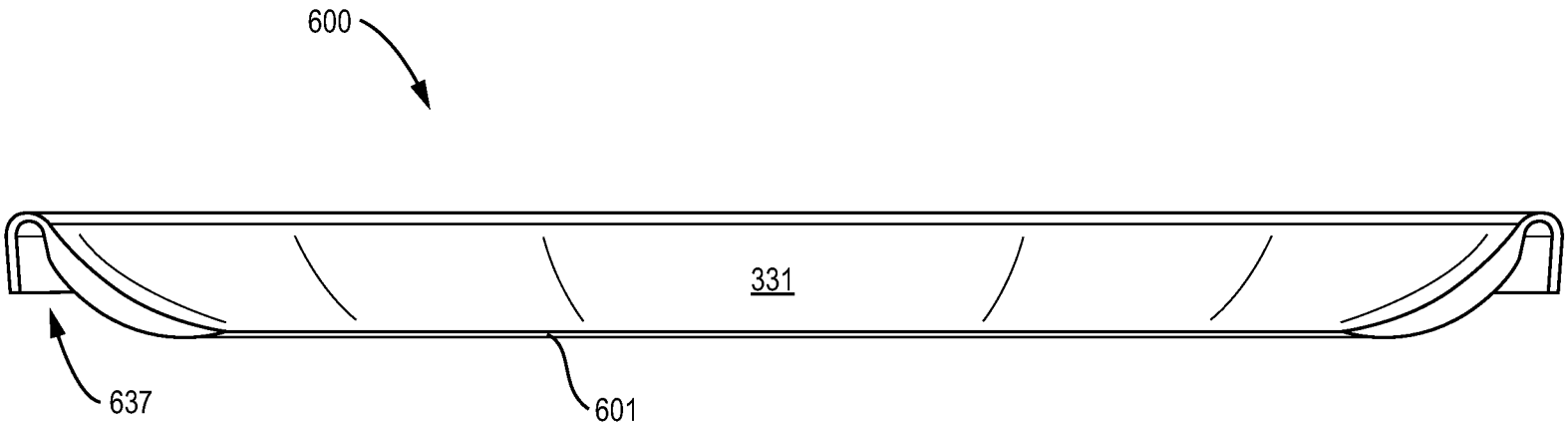
FIGS. 52 and 53 show an embodiment that either press fits or uses adhesive to secure to the rim of a can.
Figure 53:
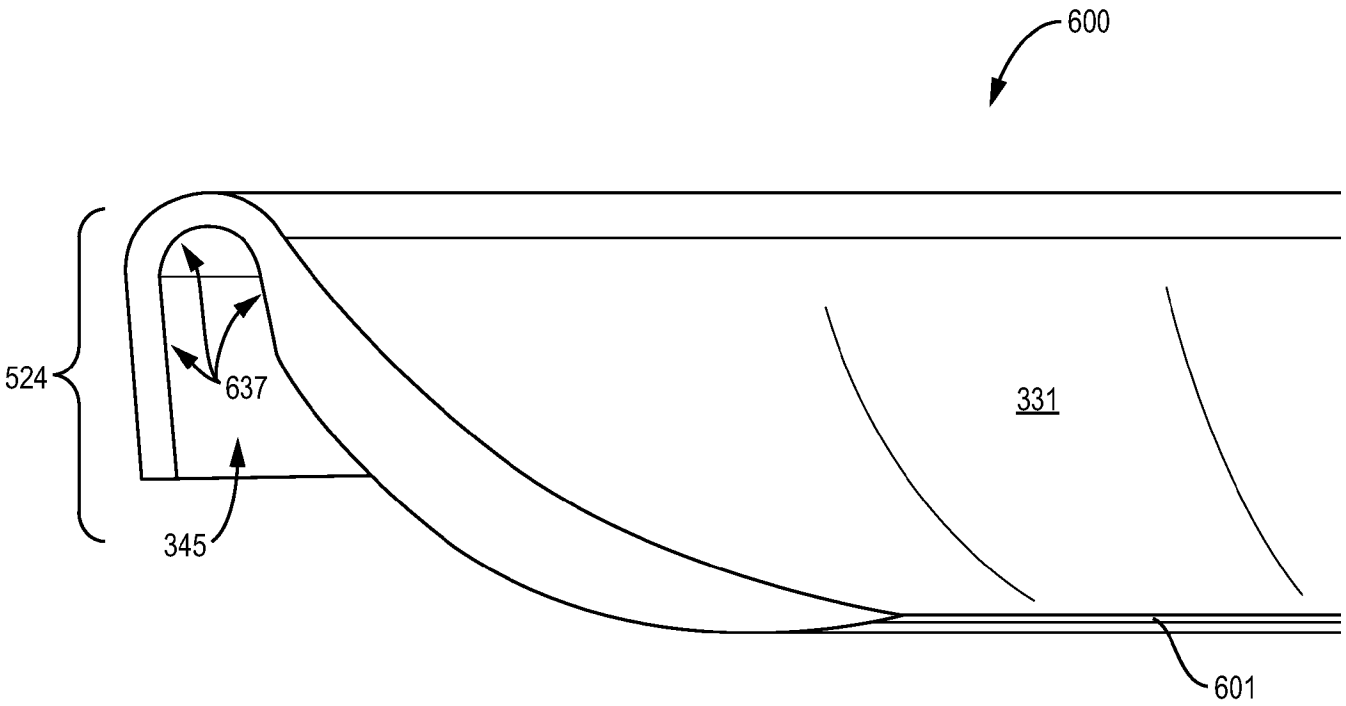

FIG. 51 illustrates a detailed cross sectional view of one side of the device 600 and shows one example of the a rim connector section 524-1. As can be seem in the illustration, the rim connector section 524-1 includes a hook-like appendages that extends from its lower side and hooks to the outside bottom edge of the and when installed resides in the rim groove to secure the device 600 to the beverage can 200. The distance around the perimeter of the underside of the rim that each hook resides can vary and the number of hook-like rim connector sections can vary as well. There are four shown in this example, but there may be more or less. They may be evenly spaced about the lower side of the exterior rim connector wall that extends around the entire outside of the rim 222 of the can 200. The distance 631 that each extends may be, for example, 1-2 centimeters (about ½ inch). It is understood that this is by way of example only. FIGS. 52 and 53 show an alternative arrangement of a device 600 that can couple to a rim of a beverage can via a compression fit, or via an adhesive or other material to resides in between the rim 222 of the can top and the inside surface 637 of the portion of the device 600 to contacts the rim area of the can. Note the outside lower edge of the rim connector section does not containing any structure to protrudes under the outside lower edge of the rim.

FIG. 52 is a cross section view of the profile of the device 600. In one example, the rim connecting section 524 adheres the device 600 to the rim of the beverage can using an adhesive.

FIG. 53 is a detailed up close view of the cross section of one side of the device 600. The inside surface 637 can be dimensioned so as to press fit over the rim of the can to provide a snug fit on the rim 222. Depending upon the material the device 600 is made from (e.g. metal of deformable plastic), after placement onto the rim 222, the material may be crimped (e.g. via rollers, or heated to shrink) onto and around the rim 222 of the can to enable the device 600 to remain in place securely on the rim 222. Alternatively, or inconjuction with a snug fit as provided above, an non-toxic adhesive 345 may be applied either to the rim 222 of the can top (prior to applying the device 600 over the rim) or to the underside of the device at locations 637. When the device 600 is then press fit over the top of the rim 222, the adhesive can dry, harden or otherwise cure to form a bond that assists in securing the device 600 to the rim of the can.

Figure 54:
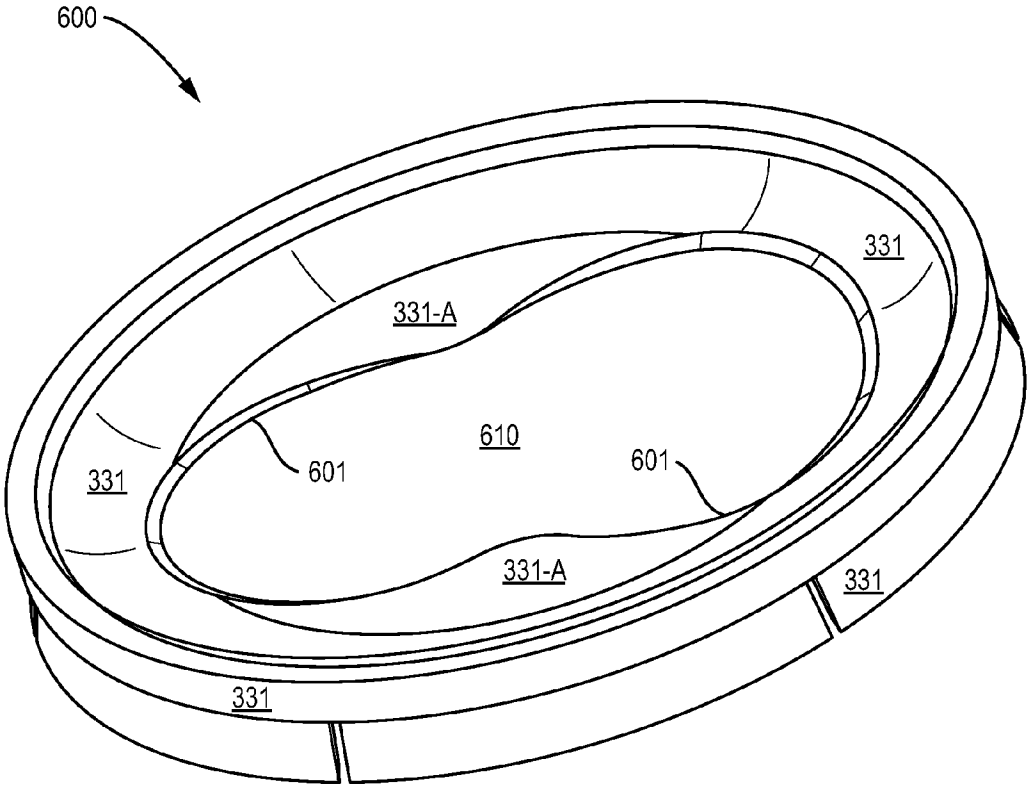
FIG. 54 shows an embodiment with additional marketing surfaces.

FIG. 54 shows an example embodiment in which the center opening defines by the inner edge 601 is not circular in shape. In particular, the device includes material that extends out over the central panel of the beverage can. In this manner, the device 600 provide additional surface area 331 upon which to place a branding message, logo, or other information. Note the addition material at location 331-A provides a substantially larger region upon which information or content may be provided.

Figure 55:
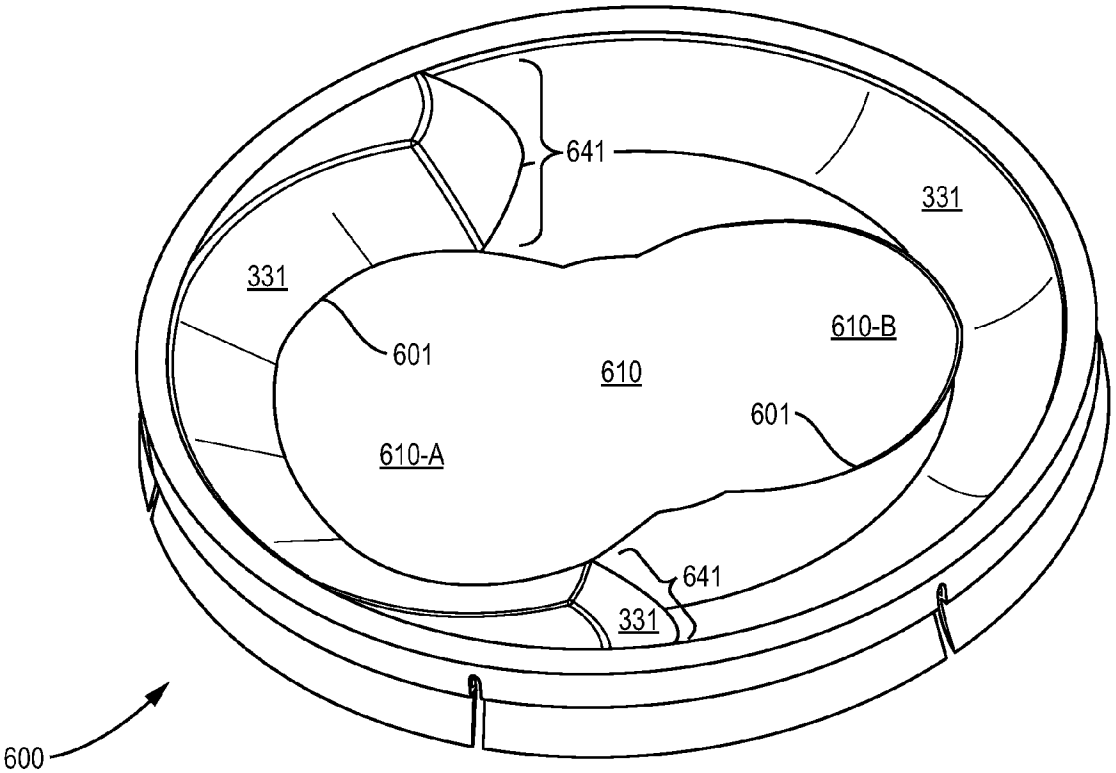
FIG. 55 shows and embodiment that provides a spout to assist in drinking from the can.

FIG. 55 shows an alternative embodiment in which the device 600 includes a formation 641 on the openable section end 610-A of the central opening 610. This formation 641 is a thicker section of material from which the device 600 is created such as plastic, that conforms to the shape of a persons upper lip. The formation 641 creates a spout-like shape that can enable a better seal between a person's lips when drinking from the beverage can 200.

Figure 56:
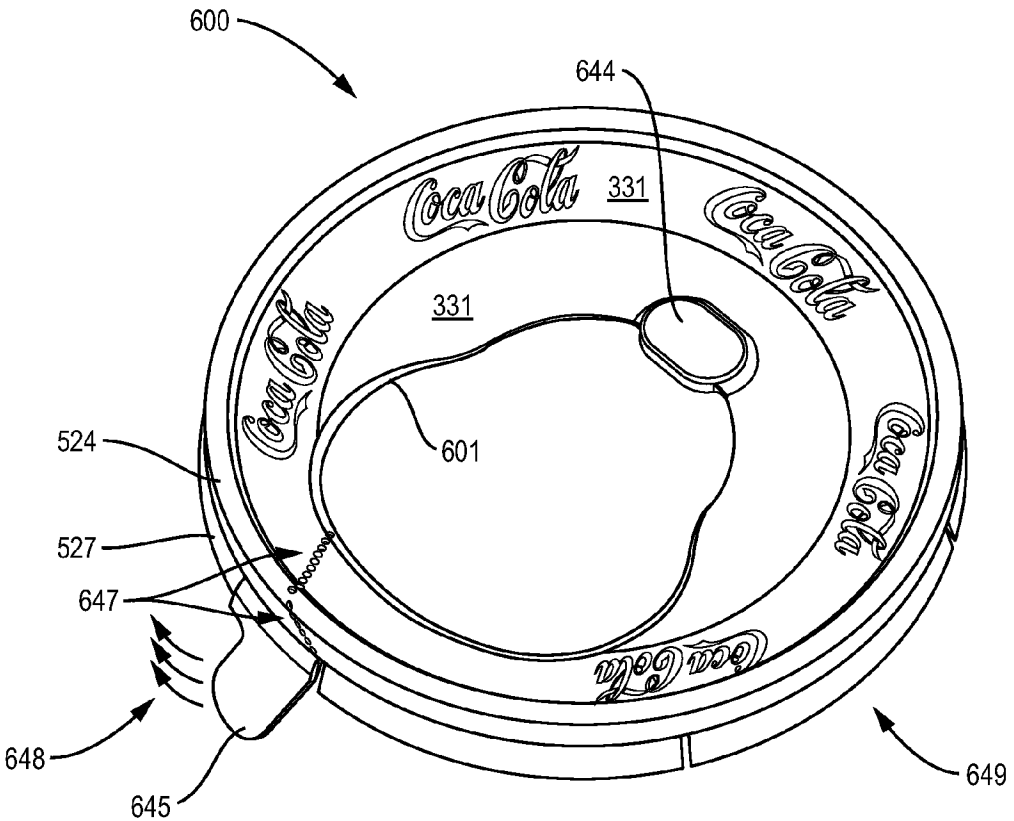
FIGS. 56, 57, 58, 59, 60, and 61 show embodiments that provide a pull tab to expose and/or remove at least a portion of the device from the can to view hidden information under that portion.
Figure 57:
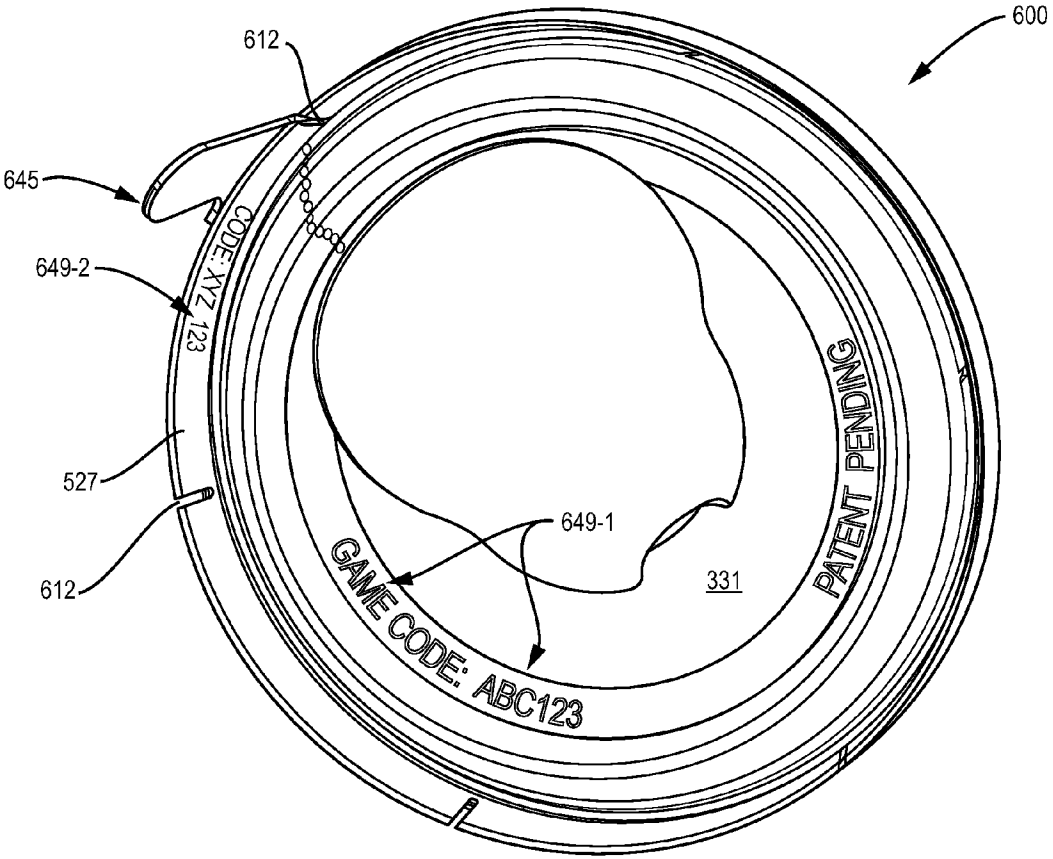
Figure 58:
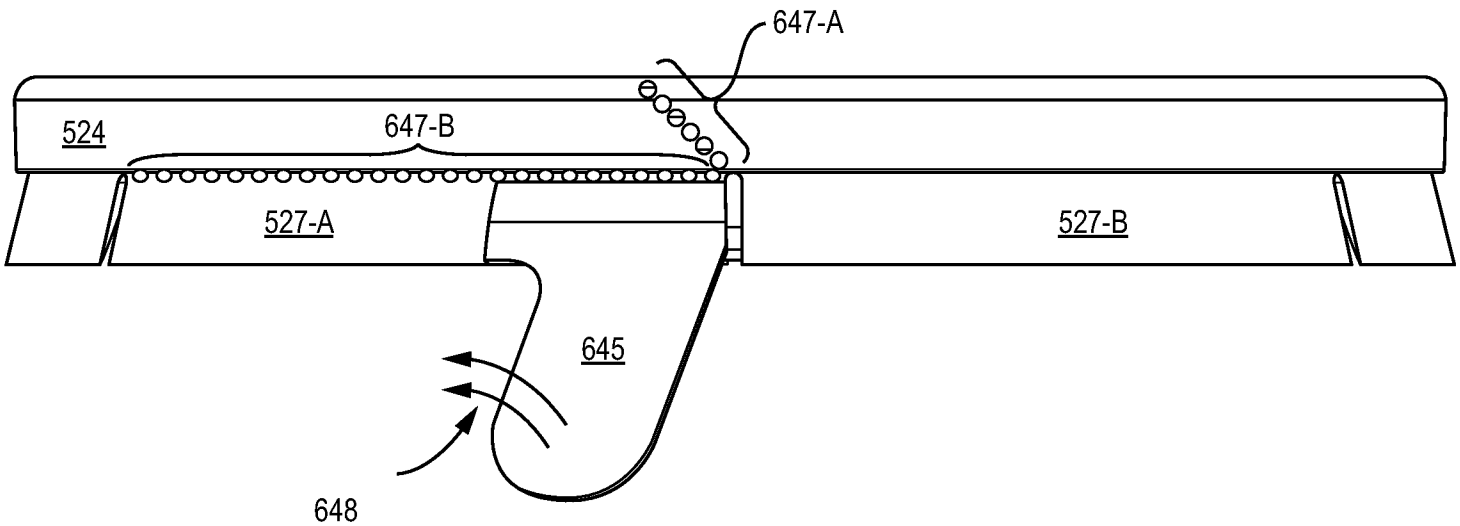

FIGS. 56, 57 and 58 illustrate example embodiments of a device 600 that include the ability to remove a portion of, or all of, the device 600 from the top 220 of the beverage can 200. In particular, in FIG. 56 the device 600 includes a removing tab 645 that a consumer of the can pulls on in the direction of arrows 648 to cause removal. In response to such pulling force, breakaway section(s) 647 tear away to enable removal of the skirt 527 and/or the rim connector section 524 from engagement with the rim joint. In this manner, if a person pulls on the tab 645, the connectivity between the rim connector tip 518 is released in the device 600 can be pulled upwards off of the can top for removal. The ability of the device 600 to be removed from a can top can be provided for a variety of the reasons. Examples include recycling of the device material and/or the ability to include contest codes or other information 649 printed or placed on the underside of the device 600 that is not visible to the consumer until the device 600 (or a portion thereof) is removed from the can top the beverage can 200.

FIG. 57 provides an example of the underside of a removable device 600 after it has been removed from the top of a beverage can 200. This example illustrates two embodiments that are variations of placement of a gaming code 649 on the underside of the device 600. In the first example, only the skirt section 527 in between relief cuts 612 is removed (the skirt section that includes the pull tab). In this example, the game code 649-2 can then been viewed by the person removing the skirt section. This game code can be used to participate in contests, such as those provided by beverage companies who place similar codes on the underside of bottle caps that are twisted off of soda bottles. In another configuration where the entire device 600 is removed, the game code or other information 649-1 can appear anywhere on the underside of the device 600.

FIG. 58 shows a bit more detail indicating how a breakaway seam can be formed in the device 600 (e.g. during injection molding of the device) to allow removal of a portion of the device 600 or the whole device 600 from the beverage can top. In FIG. 58, seam 647-A can allow a breakaway tear to be formed when the tab 645 is pulled in the direction of arrows 648 that enables removal of the entire device 600 from the can top. In contrast, breakaway seam 647-B exists along the boundary between the lower skirt of the device 600 and the upper rim connector section 524. For breakaway seam 647-B, when the tab is pulled in the direction of the arrows 648, only the skirt section 527-A is removed and the remainder of the device 600 remains installed securely on the can top. In this manner, the device in embodiments shown in FIGS. 56, 57 and 58 enables messages or other information 649 to be imprinted on the underside of the device 600 prior to device installation on the can top and enables removal for access to that information by consumers after purchase of the can.

Referring back briefly to FIG. 56, note a tab riser 644 is provided on the upper surface 331 of the device to enable engagement with a center hole of the tab 115 of the beverage can top. To install this device 600 on a can top, the tab is first rotated 1870 degrees from its conventionally installed position. This allows the material of the tab riser 644 and the device as a whole to be placed onto a can top and snapped into place without interfering with the tab. Then, after installation of the device 600 on the beverage can, the tab can be rotated back 180 degrees to its conventional position. During this second rotation, the tab will encounter the tab riser and will bend up slightly to slide up and over the tab riser 644. As the tab continues to rotate to its final position, it snaps back down with the tab riser 644 protruding up into the center hole of the tab. Once purpose for the tab riser is to prevent removal of the device 600 prior to opening of the can (e.g. to prevent theft in stores of just the device 600). The tab riser 644 is a raised area that, in the example, rises up slightly from the substantially smooth and flat surrounding surface 331 and when the tab 115 is rotated into final position (after installing the device 600 onto a can), the riser protrudes through the hold in the center of the tab. It is to be understood that the specific placement of the tear away sections 647 on the device 600 is not limited to those shown in the Figures. An example alternative is to provide a tab 645 located along the inside edge 601 of the device to allow removal of some portion of the device 600 that exists above the upper can top surface 229 (i.e. above the central panel).

Figure 59:
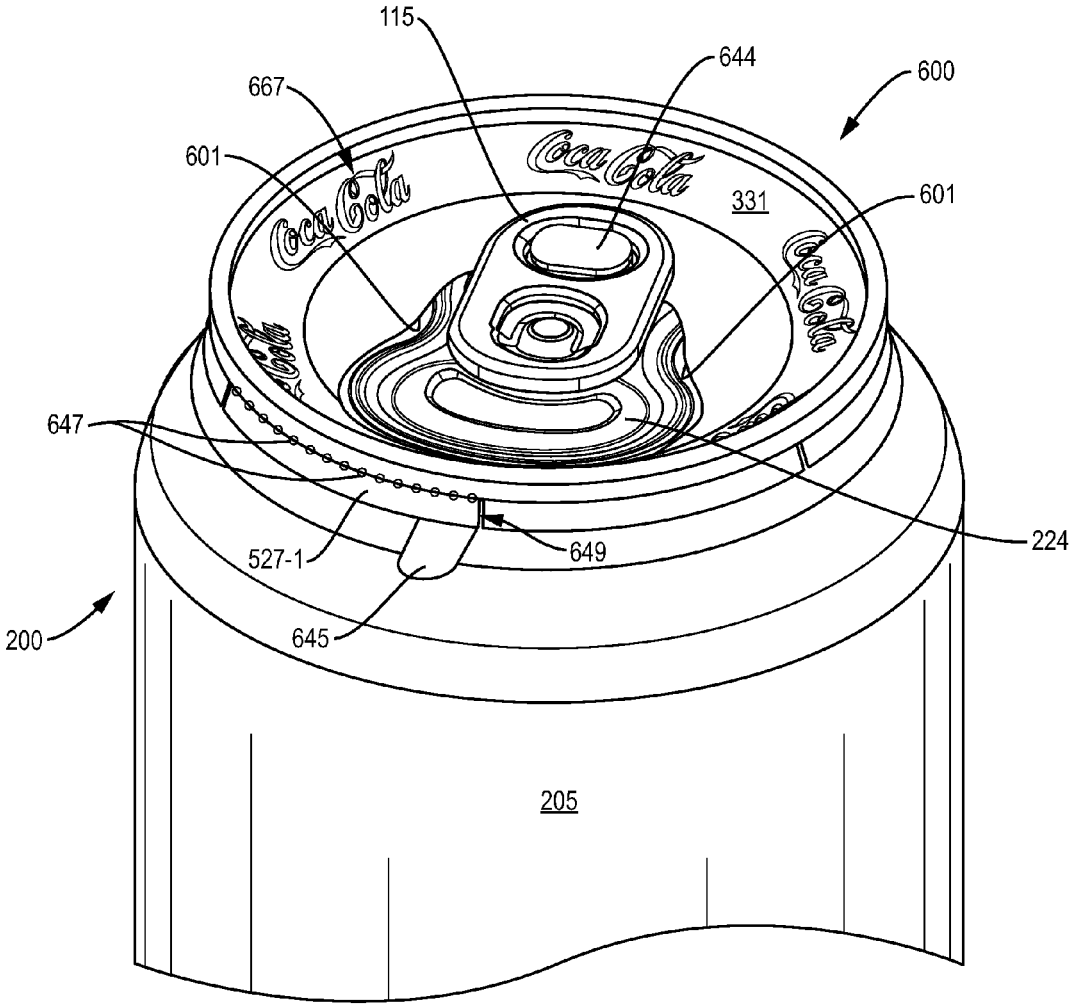

FIG. 59 shows an example of the device 600 that includes a removable section (tab 645 and skirt portion 527-1) installed onto a beverage can 200. If the consumer pulls on the tab 645, the breakaway seam 647 begins to tear allowing removal of the skirt portion 527-1 upon which a code 649 can be provided or printed on the underside. The code is not visible until the tab 645 is pulled to remove the skirt section 527-1. The code 649 can allow the user, for example, to visit a website to obtain rewards or participate in contests and enables a manufacturer of the beverage brand to track customer loyalty (e.g. Coke-rewards for beverage cans). Also shown in this example figure is an example us of the marketing surface 331 for display of a beverage brand name 667. Note in this example that the brandname 667 is also provided around the outside rim connection section and skirt 527 by way of example only. The brandname Coca-Cola™ is used in this example to illustrate the effectiveness of the device 600 in visually promoting a commonly known brand of beverage to the eyes of a consumer on the top surfaces of beverage cans via the use of the device 600. Coca-Cola is a registered trademark of the Coca-Cola Company of Atlanta, Ga., U.S.A. No offense is meant by the Applicant for this patent to Coca-Cola or any other beverage company in selecting the Coca-Cola brand name for use in these example illustrations and Coca-Cola has not been made aware of this device, nor has Coca-Cola endorsed or assisted in the design of this device 600 in any way as of the time of filing this patent application.

In one configuration then, a removing tab is secured to at least a portion of the device and allows for a consumer to actuate the removing tab 645 to expose at least a portion of a hidden surface of the device that was not exposed prior to actuation of the removing tab. The hidden surface of the device includes information 649 not viewable prior to actuation of the tab. In one example, the tab is a removing tab that causes a breakaway seam in the device to tear thus enabling removal of at least a portion of the device for viewing of the hidden surface of the device.

In another example, the tab is connected to a skirt extending below a rim connecting section that covers the rim of the can. The tab 645 enables removal of at least a portion of the skirt to gain access to the hidden information on an underside of the removed portion of the skirt.

In another configuration, the tab 645 allows removal of at least a top portion of the device that overlays a central panel of the beverage can top to gain viewing access to information on the hidden surface of the device.

In one example, the tab 115 used to open an openable section of the beverage can for consumption of the liquid must be actuated prior to gaining access to the hidden information. In another example, the removing tab is the tab 115 used to open the openable section of the beverage can are the same tab.

Figure 60:
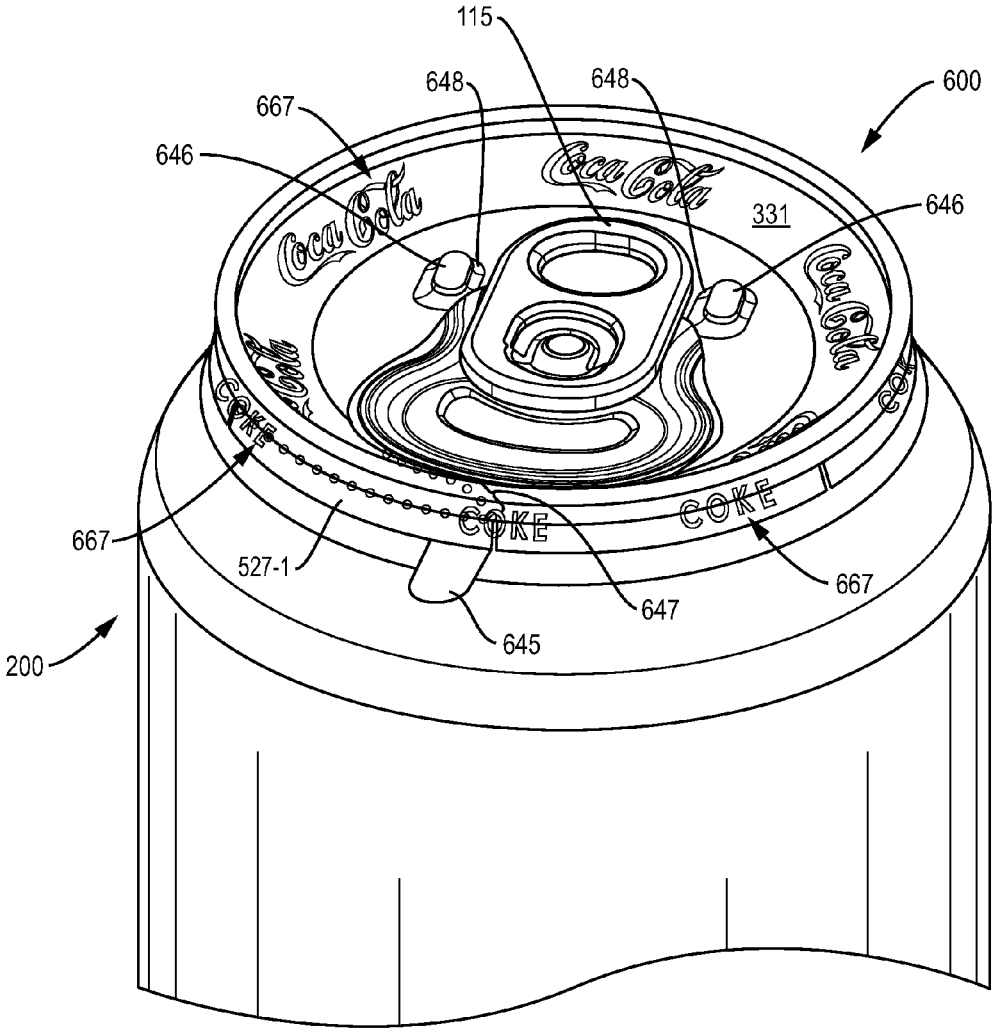

FIG. 60 shows an alternative configuration of the device 600 in which upper surface of the device 331 includes tab risers 646 on either side of the tab 115 to prevent rotation of the tab 115. In embodiments where the tear away seam(s) 647 allow removal of the entire device 600 from the can top, the upper surface 331 can extend under the tab 115 to thwart removal of the device 600 prior to purchase and opening of the can 200. To install the device 200 prior to shipping of the can from the canning facility, during the canning operation, the tab 115 affixed to the can top can be rotated 180 degrees about the central rivet that attaches the tab 115 to the central panel 229. The can top is double seamed to the can housing 205 and then the device can be aligned so that the inside edges 601 properly align with the openable section 229. The device 600 can then be pressed or snap fit into place. This can be done extremely quickly. Next, the tab can then be rotated in either direction. During rotation , when one of the tab risers 646 is encountered, the tab will slide up and over the riser 646 and come to rest as shown in FIG. 60. While not shown in this example, inside walls 648 of the tab risers can be vertical with respect to the flat upper device surface 331, while the outside walls of the risers (walls opposite those of 648 in the figure) can be sloped. This allows the tab 115 to slide and rise up the outside of either tab riser 646 during rotation, and once the tab rotates clear of the inside walls, it snaps back down flush onto the flat upper surface 331. The inside walls 648 that are non-ramped and that exist on either side of the tab in its final resting position (i.e. after rotating to the position shown) will prevent re-rotation of the tab 115 back around 180 degrees (without lifting the tab substantially which will cause the openable section to be opened).

The tab risers 646 thus assist in preventing removal of the device 600 from a can without first opening the can (via use of the tab 115), and thus consumers in stores will not be tempted to remove the device 600 from a can without first purchasing the beverage can 200. Theft of the device 600 might be tempting in scenarios where a constant is offered by the beverage company that includes substantial prizes or give always.

Figure 61:
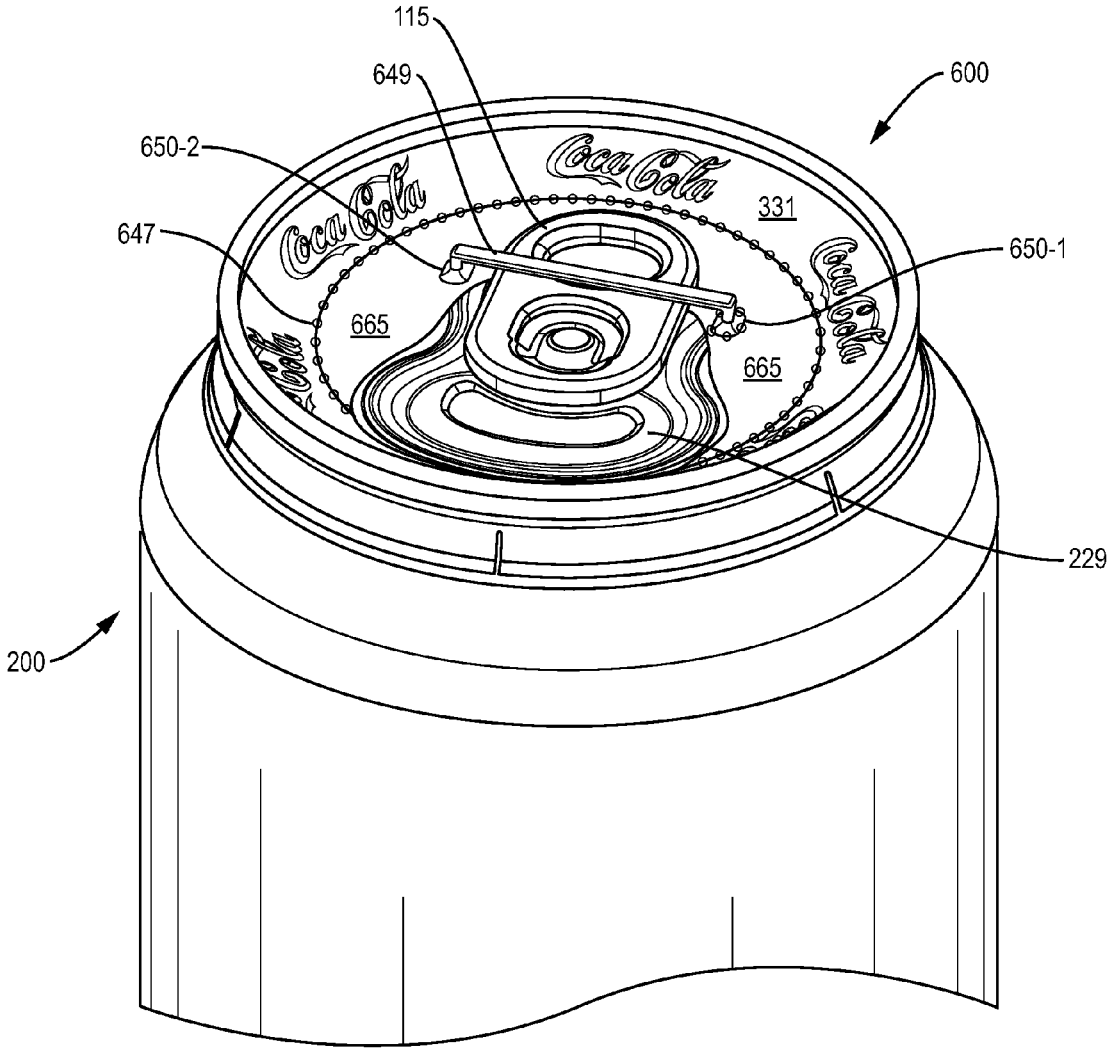

FIG. 61 shows another alternative embodiment of the device 600 that includes a removable center section 655 upon which a code of other information can be imprinted on its underside prior to installation on the can 200. The removable center section 655 is surrounded by a breakaway seam 647 shown by the dotted line of small circles. In this example, the device 600 includes a tab crossbar 649 that interfaces (passes over in this example) with the tab 115. When the tab 115 is lifted to open the beverage can, crossbar seam 650-1 breaks away on one side from the surface of the device 600 and allows the tab to open the openable section 229. The consumer can then pull on the crossbar to cause the seam 647 to tear along the path shown. This results in removal of the center section 655 of the device 600 and after removal, the device has an appearance such as that in FIG. 38. Due to the crossbar 649, the removability of the center section 655 is contingent on first opening the can. As noted above, a contest code or other information can be printed on the underside of the removable center section 655.

Figure 62:
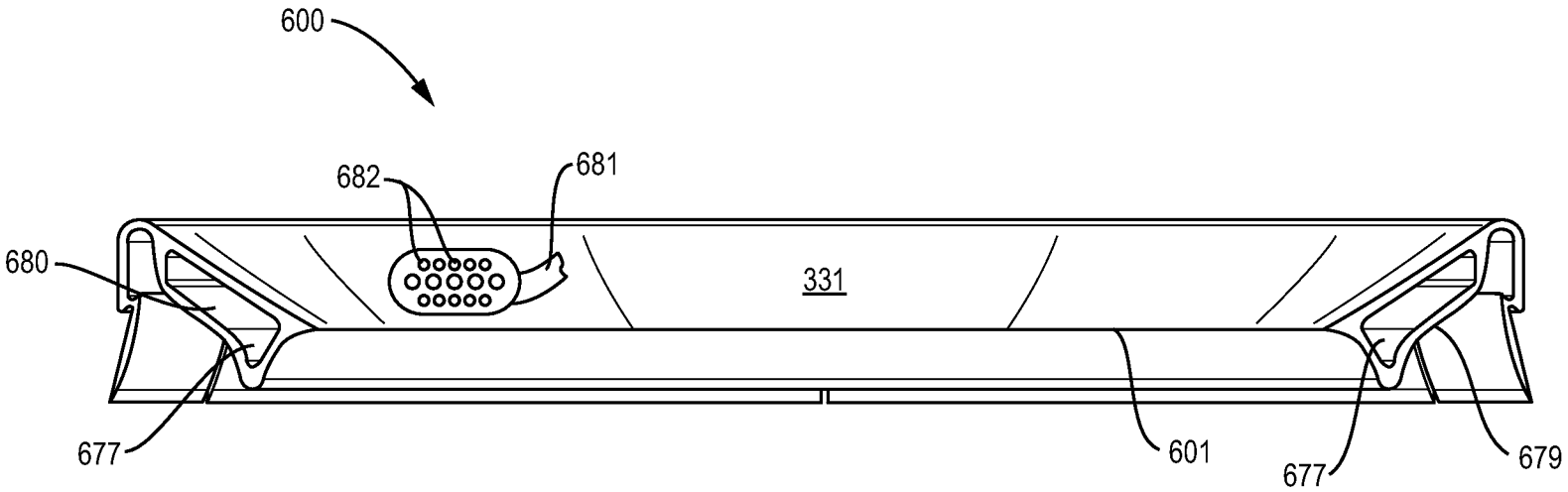
FIG. 62 shows a hollow embodiment that can include flavoring.

FIG. 62 shows an alternative embodiment of a cross section of a device 600 that can be installed over the rim of a beverage can top and that provides or defines a hollow region 677 in between the upper surface 331 of the device 600 and the lower or underside surface 679. This hollow region 677 can be used for a variety of purposes. In one example, if the device 600 is made from a translucent or semi-translucent material, the hollow region 677 can be filled (during manufacture of the device 600) with visually appealing contents 680, such as sparkle filled water, or bubbles, for example, that can be see through the upper surface 331 when holding a can 200. In another configuration, small holes or other apertures 682 can be provided and a liquid flavoring contents 680 can be provided within the hollow region 677. An removable aperture cover 681 can be provided and that can be removed after opening of the can. If the device 600 is installed on the can 200 so that the apertures are aligned closest to the openable section 229 of the can top, as a consumer tilts the can to drink form the can, liquid from the openable section can flow over the surface of the device and can draw out and mix with some of the liquid flavoring contents 680 stored within the hollow section 677. This can allow, for example, a beverage in the can (e.g. iced tea) to include a sweetener in the hollow section 677, and if the consumer chooses to have sweetened iced tea they can simply remove the cover 681 allows the sweetener to mix with the non-sweetened can contents as it is poured from the can. Other contents within the hallow section can include messages, or valuable objects such as gold and the device 600 can be of the removable kind as described above and the beverage can be advertised as having certain cans in which the device contains such valuable objects. This may increase sales of the beverage by consumers in the hopes of buying one of the cans in which the valuable object is contained within the hollow section 677. Other variations of this concept including placing the valuable object into groove 230 prior to applying a device 600 such as that shown in FIGS. 36 and 37 to the can and allowing the device to be removable to obtain access to the object within the groove.

Figure 63:
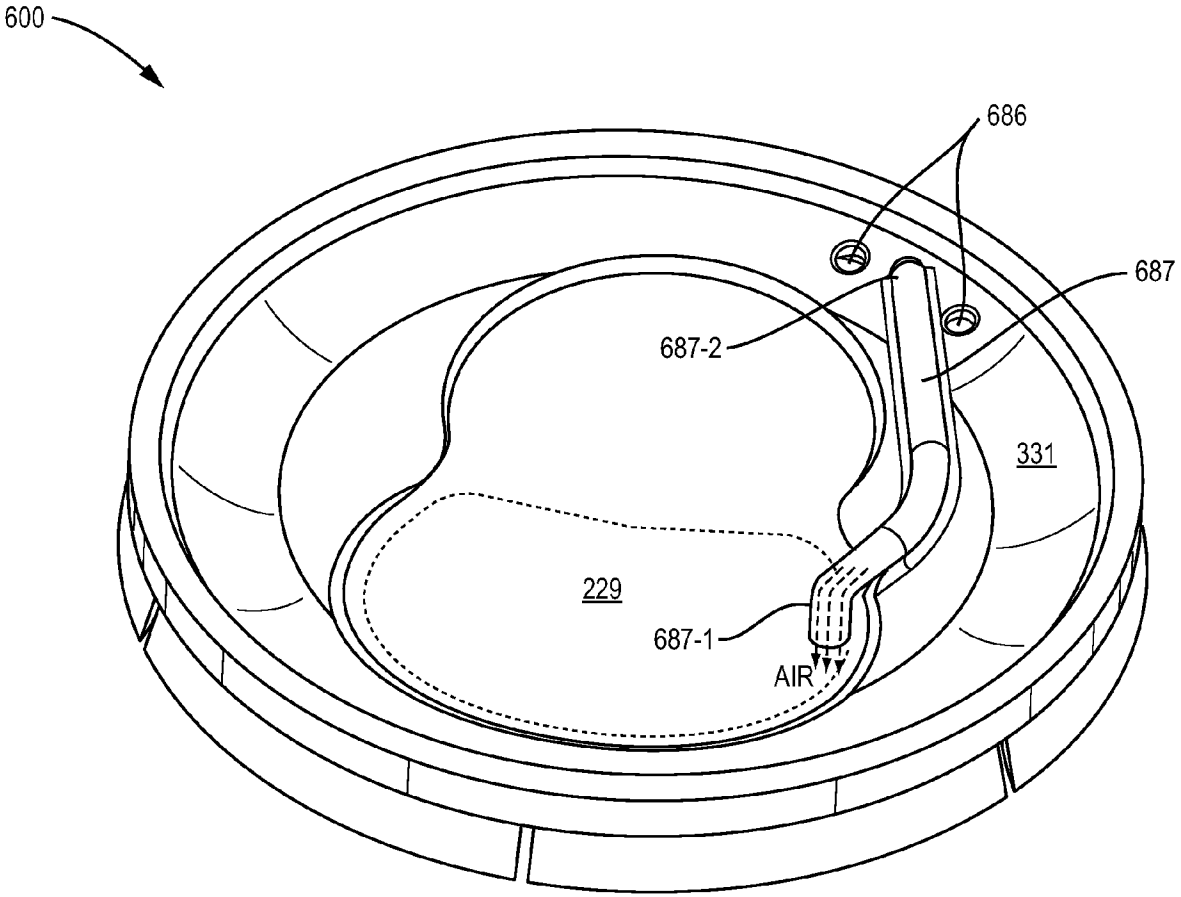
FIG. 63 shows an embodiment that provides an air duct to allow air to enter the can as liquid is removed from the can.

FIG. 63 illustrates an embodiment of the device 600 that includes or defines a built in air-duct 687 to assist in allowing air to flow into the can housing 205 as the liquid contents is being poured or consumed from the can 200. In this example design, the air duct 687 has a first end 687-1 that extends out and over a small area of the openable section 229 of a can top of a beverage can. This is shown in detail on the right of the diagram. The air duct 687 is shown as a tub that is formed as part of the advice 600 in this example, but it is to be understood that the air duct can simply be a deformation of the device to create an air channel or air passageway underneath the device 600. In either design, the air duct 687 provides a small hollow channel through with air can enter via apparatus 686 in the device, pass through the passageway or duct 687, and enter into the can body 205 as liquid contents of the can is poured or sucked (e.g. chugged) from the can. By providing a small portion of the device 600 (e.g. a portion of upper surface 331) that extends just over the openable section 229 (shown in dotted lines in this figure) in an upper corner of the openable section (closest to the center of the can top), a passageway for air to enter the can housing is provided. The apertures 686 provide air inlets to allow air to enter the inlets 686, pass through the duct or defined passageway 687, and enter into the can housing. Since the upper surface 331 of the device 331 forms the airduct, it cannot be blocked for airpassage for example, by a persons upper lip. That is, since the air inlet that extends over the openable section faces downwards into the can housing, it cannot be easily blocked by the flesh of a person upper lip if that person is covering the entire openable section when chugging the contents of a can 200. While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting.

As noted above, in one example the material in between the underside device surface and the outward and upwardly sloped exterior device surface 331 defines a hallow ring-shaped cavity that can contain material that can move within the hallow cavity as shown in FIG. 63. In one example, the material is a flavoring that can be exposed to liquid poured form an openable section of the beverage can as the liquid passes over the exterior device surface when being poured form the beverage can.

For the air duct version, at least one of the underside device surface and the exterior device surface define an air passageway to enable air to be provided into the can housing during pouring of liquid from the can.

Due to the large number of embodiments disclosed in this application, a number of different claim groups are presented—each with a heading identifying that claims group. It is to be understood that claims in a claim group that depend from one another are intended to depend from the claim in that claim group (as if that group were a separate set of claims). It is also to be understood that these claim groups are not intended to be limiting, and that the specific combination of claim limitation presented here does not reflect all embodiments that may be claimed based on the aforementioned disclosure.

What is claimed is:

1. A ring shaped device that is attachable to an openable end of a beverage can, the device comprising:

an inner edge having at least one section that terminates upon an upper can top surface at a first location, the first location being radially further from the center of the can top than an outermost edge of an openable section defined in the upper can top surface; and an ring-shaped exterior device surface having a profile in the direction of its radius that begins at the inner edge and extends and slopes radially outwards and upwards from the inner edge towards an upper region of a rim of the top of the beverage can, the exterior device surface extending around a rim of the beverage can and over and above a top of a countersink groove defined in the can top, the exterior device surface providing a smooth surface over which debris on the can top can be wiped up and over the rim of the can top and providing a surface on which a marketing message may be presented.

2. The device of claim 1 comprising:

an underside device surface having a profile in the direction of its radius that begins at the inner edge and extends outward, below the exterior device surface, the underside device surface extending radially outwards and upwards away from the inner edge towards the inside sidewall of the rim of the beverage can, the underside device surface passing over the countersink groove defined in the can top.

3. The device of claim 2 wherein a portion of the exterior device surface that exists and slopes in between the inner edge and an uppermost region of the exterior device surface provides a surface area that is substantially larger than a substantially horizontal groove covering area that is defined as top of the groove between the inside upper edge of the countersink groove and an opposite location located horizontally across the countersink groove.

4. The device of claim 1 wherein the exterior device surface extends radially outwards and upwards as a banked surface from the inner edge towards the upper region of the rim of the top of the beverage can, the upper groove covering surface providing a banked surface that provides a smooth transition from the upper can top surface that is relatively horizontal to the upper region of the inside of the rim of the can that is relatively vertical, the banked surface assisting in transporting debris up and over the rim of the can top when wiping the can top.

5. The device of claim 4 wherein the inner edge defines a central opening through which a tab used to open the openable section protrudes when the attachment is secured to the openable end of the beverage can, and through which the openable section can dispense liquid when opened and poured from the beverage can, the attachment remaining secured to the beverage can before, during and after opening of the openable section.

6. The device of claim 5 wherein the central opening defined by the inner edge is substantially circular in shape, and wherein when the attachment is secured to the openable end of the beverage can, the inner edge resides substantially flush against the upper can top surface.

7. The device of claim 5 wherein the central opening defined by the inner edge is shaped to conform substantially to a shape of a tab recess area defined in the upper can top surface, the tab recess area providing an area on the upper can top surface within which the openable section and a tab are provided on the beverage can top.

8. The device of claim 1 wherein a surface area of the exterior device surface that extends radially outwards and slopes upwards from the inner edge towards an upper region of a rim of the top of the beverage can provides a banked surface area that is substantially greater in overall area than an area defined by a substantially horizontal plane passing over the countersink groove in between a lower region of the rim of the beverage can and an outside edge of the upper can top surface.

9. The device of claim 2 wherein the exterior device surface includes a rim connecting section that extends up and over the top of the rim of the beverage can and extends down the exterior side of the rim of the beverage can, the rim connecting section extending around a circumference of the exterior of the rim of the beverage can and adhering the device to the rim of the beverage can.

10. The device of claim 9 wherein the underside device surface extends up and over the top of the rim of the beverage can and forms an inside surface of a rim connecting section of the device, the inside surface of the rim connecting section securing the device to the rim of the beverage can.

11. The device of claim 10 wherein the rim connecting section includes a rim connector tip the extends around an inside surface of the rim connecting section, the rim connector tip protruding radially inward towards the center of the device, the rim connector tip engaging with a rim groove formed at an intersection of the can top and a can housing to secure the device to the can top.

12. The device of claim 11 wherein a lower side of the rim connector tip includes an outwardly beveled lower surface to direct the rim connecting section, upon initial contact with the top of the rim of the beverage can, away from the center of the can top during installation of the device on a beverage can.

13. The device of claim 11 wherein a marketing message is present on at least a portion of the exterior device surface.

14. The device of claim 1 comprising:

a removing tab secured to at least a portion of the device, the removing tab allowing for a consumer to actuate the removing tab to expose at least a portion of a hidden surface of the device that was not exposed prior to actuation of the removing tab, the hidden surface of the device including information not viewable prior to actuation of the tab.

15. The device of claim 14 wherein the tab is a removing tab that causes a breakaway seam in the device to tear thus enabling removal of at least a portion of the device for viewing of the hidden surface of the device.

16. The device of claim 15 wherein the tab is connected to a skirt extending below a rim connecting section that covers the rim of the can, the tab enabling removal of at least a portion of the skirt to gain access to the hidden information on an underside of the removed portion of the skirt.

17. A rim cover device for a beverage can, the rim cover comprising:

a layer of material having an the underside device surface having a rim connecting portion that matably attaches over a rim of a top of a beverage can;

an exterior device surface opposite the underside device surface, the exterior device surface extending up an outside area of the rim of the beverage can and over a topside of the rim of the beverage can and extending down into an inside area of the rim of the beverage can below the topside of the rim of the beverage can, the exterior device surface extending above and across a top of a countersink groove defined in the can top at a location next to an openable section defined in the upper can top surface while allowing full exposure of the openable section and having an inner edge that terminates upon an upper can top surface at at least a first location that is radially further from the center of the can top than an outermost edge of an opening of the can top defined in the upper can top surface.

18. A beverage can comprising:

a can body;

a can top coupled to the can body, the can top shaped to define a rim and an upper surface that includes an openable section of the can top, the can top shape further defining a groove between an inside lower edge of the rim of the can top and an outer edge of the upper surface of the can top; and a groove cover disposed over the groove to cover at least a portion of the groove at a location adjacent to an openable section defined in the upper can top surface while allowing the openable section to remain uncovered, the groove cover providing a substantially sloped surface sloping downwards and inwards from a top region of the rim of the can top towards the upper surface of the can top, the groove cover preventing collection of debris in the at least a portion of the groove over which the groove cover resides.

19. The beverage can of claim 18 wherein the groove cover is disposed over the groove to cover the groove between the inside edge of the rim of the can top and the upper surface of the can top along an entire length of the groove, the groove cover providing an upper groove cover sloped surface extending between the inside edge of the rim of the can top and the upper surface of the can top to prevent collection of debris in the groove defined by the can top.

20. The beverage can of claim 17 wherein the groove cover defines a central opening through which a tab can be operated to open the openable section of the can top.

21. The beverage can of claim 18 wherein the groove cover defines a central opening through which a tab can be operated to open the openable section of the can top.

22. The beverage can of claim 18 wherein the groove cover includes a visible message.

23. A groove cover for a beverage can top, the groove cover comprising:

groove cover material operable to be secured to a can top prior to the can top being secured to a beverage can housing, the groove cover material having an exterior device surface extending above and across at least a portion of a top of a countersink groove defined in the can top, the at least a portion existing at a location adjacent to an openable section defined in the upper can top surface, the exterior device surface providing a surface that extends upwards and outwards from the center of the can top, the exterior device surface preventing collection of debris within the at least a portion of the top of the countersink groove.

24. The groove cover of claim 23 wherein the groove cover material includes a visible message.

25. A can top operable to be secured to a beverage can, the can top comprising:

an upper surface section that defines an openable section on the can top;

a seaming edge section that extends around an outer periphery of the can top and that is operable to be seamed to an upper edge of a can housing of the beverage can;

a groove section that connects the upper surface section of the can top to the seaming edge section of the can top, the groove section defining a countersink groove on a topside of the can top between the upper surface section and the seaming edge section of the can top; and a groove cover disposed on the can top prior to securing the can top to the beverage can, the groove cover having an exterior device surface extending above and across at least a portion of the groove section that is adjacent to the openable section, the exterior device surface providing a surface that extends upwards and outwards from the center of the can top, the exterior device surface preventing collection of debris within the at least a portion of the countersink groove.

26. The can top of claim 25 wherein the groove cover includes a visible message.

27. A device that secures to a can top, the device comprising:

a ring-shaped top edge;

an upper surface that slopes downwards and radially inwards from the ring shaped top edge, the upper surface extending above and across at least a portion of a countersink groove defined by the can top, the at least a portion being adjacent to an openable section defined on the can top, and the upper surface allowing the openable section on the can top to remain uncovered.

28. The device of claim 27 wherein the upper surface includes a visible message.

* * * * *